US008287347B2

(12) United States Patent
Snow et al.

(10) Patent No.: US 8,287,347 B2
(45) Date of Patent: Oct. 16, 2012

(54) METHOD, APPARATUS AND SYSTEM FOR EGREGIOUS ERROR MITIGATION

(75) Inventors: Roger M. Snow, Las Vegas, NV (US); Jennifer K. Farrar, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 787 days.

(21) Appl. No.: 12/291,223

(22) Filed: Nov. 6, 2008

(65) Prior Publication Data

US 2010/0113120 A1 May 6, 2010

(51) Int. Cl.
*A63F 9/24* (2006.01)

(52) U.S. Cl. ..... 463/13; 273/292

(58) Field of Classification Search ..... 463/13, 463/16, 20–30; 273/292, 274
See application file for complete search history.

(56) References Cited

U.S. PATENT DOCUMENTS

| | | | |
|---|---|---|---|
| 1,831,580 | A | 11/1931 | Stecker |
| 2,023,210 | A | 12/1935 | Potter |
| 2,666,645 | A | 1/1954 | Phillips |
| 3,222,071 | A | 12/1965 | Lang |
| 3,735,982 | A | 5/1973 | Gerfin |
| 3,810,627 | A | 5/1974 | Levy |
| 3,876,208 | A | 4/1975 | Wächtler et al. |
| 3,909,002 | A | 9/1975 | Levy |
| 4,339,798 | A | 7/1982 | Hedges et al. |
| 4,467,424 | A | 8/1984 | Hedges et al. |
| 4,497,488 | A | 2/1985 | Plevyak et al. |
| 4,531,187 | A | 7/1985 | Uhland |
| 4,534,562 | A | 8/1985 | Cuff et al. |
| 4,614,342 | A | 9/1986 | Takashima |
| 4,711,371 | A | 12/1987 | Harrigan |
| 4,743,022 | A | 5/1988 | Wood |
| 4,750,743 | A | 6/1988 | Nicoletti |
| 4,755,941 | A | 7/1988 | Bacchi |
| 4,760,527 | A | 7/1988 | Sidley |
| 4,805,907 | A | 2/1989 | Hagiwara |
| 4,813,675 | A | 3/1989 | Greenwood |
| 4,926,327 | A | 5/1990 | Sidley |
| 4,948,134 | A | 8/1990 | Suttle et al. |

(Continued)

FOREIGN PATENT DOCUMENTS

EP 1 814 091 8/2007

(Continued)

OTHER PUBLICATIONS

Dragon Bacc, brochure, pub. Feb. 16, 2007 (2 pgs); retrieved Feb. 4, 2010 from DigiDeal Corporation Web site: http://www.digideal.com/products/dragonbacc.php.

(Continued)

*Primary Examiner* — Masud Ahmed
(74) *Attorney, Agent, or Firm* — TraskBritt

(57) ABSTRACT

A playing card gaming system is disclosed that provides the player with an opportunity to withdraw a game play decision that is less advantageous to a player than at least one other play decision. The system includes a player interface that displays a prompt when a less advantageous decision is made. The display may include an area that provides the dealer with a visual indication that the player is being asked to confirm an election. A card delivery system with a playing card information reader provides card information to the system. A game processor determines if player elections are disadvantageous.

19 Claims, 36 Drawing Sheets

U.S. PATENT DOCUMENTS 4,973,951 A 11/1990 Shigeta et al.
5,022,653 A 6/1991 Suttle et al.
5,033,744 A 7/1991 Bridgeman et al.
5,067,713 A 11/1991 Soules et al.
5,224,706 A 7/1993 Bridgeman et al.
5,265,882 A 11/1993 Malek
5,277,424 A 1/1994 Wilms
5,288,081 A 2/1994 Breeding
5,299,803 A 4/1994 Halaby
5,308,065 A 5/1994 Bridgeman et al.
5,326,104 A 7/1994 Pease et al.
5,328,189 A 7/1994 Malek
5,356,140 A 10/1994 Dabrowski et al.
5,374,061 A 12/1994 Albrecht
5,395,120 A 3/1995 Malek
5,411,257 A 5/1995 Fulton
5,411,270 A 5/1995 Naka et al.
5,437,451 A 8/1995 Fulton
5,437,462 A 8/1995 Breeding
5,586,766 A 12/1996 Forte et al.
5,586,936 A 12/1996 Bennett et al.
5,586,937 A 12/1996 Menashe
5,591,081 A 1/1997 Suzuki
5,605,334 A 2/1997 McCrea, Jr.
5,669,817 A 9/1997 Tarantino
5,688,174 A 11/1997 Kennedy
5,707,287 A 1/1998 McCrea, Jr.
5,722,893 A 3/1998 Hill et al.
5,735,525 A 4/1998 McCrea, Jr.
5,769,417 A 6/1998 Richer et al.
5,770,533 A 6/1998 Franchi
5,779,546 A 7/1998 Meissner et al.
5,803,809 A 9/1998 Yoseloff
5,806,855 A 9/1998 Cherry
5,823,879 A 10/1998 Goldberg et al.
5,863,041 A 1/1999 Boylan et al.
5,863,042 A 1/1999 Lo
5,911,626 A 6/1999 McCrea, Jr.
5,941,769 A 8/1999 Order
5,975,528 A 11/1999 Halaby
6,004,205 A 12/1999 Lauretta et al.
6,039,650 A 3/2000 Hill
6,074,720 A 6/2000 Van Stratum
6,093,103 A 7/2000 McCrea, Jr.
6,117,012 A 9/2000 McCrea, Jr.
6,165,069 A 12/2000 Sines et al.
6,196,547 B1 3/2001 Pascal et al.
6,254,484 B1 7/2001 McCrea, Jr.
6,270,404 B2 8/2001 Sines et al.
6,293,864 B1 9/2001 Romero
6,299,536 B1 10/2001 Hill
6,319,122 B1 11/2001 Packes, Jr. et al.
6,343,989 B1 2/2002 Wood et al.
6,346,044 B1 2/2002 McCrea, Jr.
6,386,973 B1 5/2002 Yoseloff
6,435,970 B1 8/2002 Baerlocher et al.
6,474,646 B1 11/2002 Webb
6,517,436 B2 2/2003 Soltys et al.
6,565,432 B2 5/2003 Moody
6,575,831 B1 6/2003 Gonen et al.
6,582,301 B2 6/2003 Hill
6,626,757 B2 9/2003 Oliveras
6,638,161 B2 10/2003 Soltys et al.
6,651,985 B2 11/2003 Sines et al.
6,659,866 B2 12/2003 Frost et al.
6,666,765 B2 12/2003 Vancura
6,676,517 B2 1/2004 Beavers
6,722,974 B2 4/2004 Sines et al.
6,758,751 B2 7/2004 Soltys et al.
6,835,133 B2 12/2004 Baerlocher et al.
6,896,620 B1 5/2005 Luciano et al.
6,913,531 B1 * 7/2005 Yoseloff ..... 463/13
6,921,337 B1 7/2005 Kennedy et al.
6,939,224 B2 9/2005 Palmer et al.
7,008,324 B1 3/2006 Johnson et al.
7,048,629 B2 5/2006 Sines et al.
7,195,244 B1 3/2007 Feola
7,198,569 B2 4/2007 Wolf et al.
7,201,655 B2 4/2007 Walker et al.
7,201,661 B2 4/2007 Kennedy et al.
7,217,187 B2 5/2007 Vancura
7,255,351 B2 8/2007 Yoseloff et al.
7,255,642 B2 8/2007 Sines et al.
7,316,615 B2 1/2008 Soltys et al.
7,361,086 B2 4/2008 Gazdic et al.
7,367,563 B2 5/2008 Yoseloff et al.
7,374,170 B2 5/2008 Grauzer et al.
7,407,438 B2 8/2008 Schubert et al.
7,481,434 B1 1/2009 Feola
7,699,695 B2 4/2010 White et al.
2002/0002072 A1 1/2002 Sines et al.
2002/0022510 A1 2/2002 Baerlocher et al.
2002/0068635 A1 6/2002 Hill
2002/0077170 A1 6/2002 Johnson et al.
2003/0003997 A1 * 1/2003 Vuong et al. ..... 463/42
2003/0224854 A1 12/2003 Joao
2004/0003395 A1 1/2004 Srinivas et al.
2004/0185933 A1 9/2004 Nicely
2004/0224777 A1 * 11/2004 Smith et al. ..... 463/47
2004/0229682 A1 11/2004 Gelinotte
2005/0164759 A1 7/2005 Smith et al.
2005/0242500 A1 11/2005 Downs, III et al.
2005/0272501 A1 12/2005 Tran et al.
2006/0025213 A1 2/2006 Kane et al.
2006/0030400 A1 2/2006 Mathis
2006/0058092 A1 3/2006 Crawford et al.
2006/0226604 A1 10/2006 Saucier
2006/0234796 A1 10/2006 Nobrega et al.
2006/0279040 A1 12/2006 Downs, III et al.
2006/0281537 A1 12/2006 Abbott et al.
2007/0029731 A1 2/2007 Barker
2007/0072682 A1 3/2007 Crawford et al.
2007/0149283 A1 6/2007 Poh et al.
2007/0205559 A1 9/2007 Webb
2007/0238504 A1 10/2007 Oliveras
2007/0256111 A1 11/2007 Medford et al.
2007/0275762 A1 11/2007 Aaltone et al.
2008/0006996 A1 1/2008 Frankel et al.
2008/0006998 A1 1/2008 Grauzer et al.
2008/0037628 A1 2/2008 Boyce et al.
2008/0051171 A1 2/2008 Lutnick et al.
2008/0076506 A1 3/2008 Nguyen et al.
2008/0113764 A1 5/2008 Soltys
2008/0113783 A1 5/2008 Czyzewski et al.
2008/0119257 A1 5/2008 Stern et al.
2008/0171585 A1 * 7/2008 Jackson ..... 463/16
2008/0176617 A1 7/2008 Kekempanos et al.
2008/0258388 A1 10/2008 Schugar et al.
2008/0303210 A1 12/2008 Grauzer et al.
2009/0017888 A1 1/2009 Kuhn et al.
2009/0098932 A1 4/2009 Longway
2009/0115133 A1 5/2009 Kelly et al.
2009/0118006 A1 5/2009 Kelly et al.
2009/0140492 A1 6/2009 Yoseloff et al.
2009/0191933 A1 7/2009 French
2009/0224476 A1 9/2009 Grauzer et al.
2009/0280904 A1 11/2009 Nicely et al.
2010/0016050 A1 1/2010 Snow
2010/0062845 A1 3/2010 Wadds et al.

FOREIGN PATENT DOCUMENTS

WO 97/38366 10/1997
WO WO 0230529 4/2002
WO 2007/067213 6/2007
WO 2007/103351 9/2007
WO 2008/028148 3/2008
WO 2008/091809 7/2008
WO 2009/025673 2/2009

OTHER PUBLICATIONS

U.S. Appl. No. 12/075,008, filed Mar. 7, 2008, entitled "Side Bet Odds Wagering System."

International Search Report and Written Opinion for PCT/US2009/050562 for Chipless Table Split Screen Feature, Sep. 1, 2009.

Three (3) pictures taken of an Accuplay Table from TCS/John Huxley in use in an Arcade in Buylgaria, Feb. 2008.
Brochure from TCS/John Huxley for Touch Table MultiPLAY™ Roulette, Feb. 2008.
Nevada State Certificate of Registration for Trademark SAFEJACK to Mikohn Gaming Corporation of Las Vegas, Nevada dated Sep. 4, 1997.

* cited by examiner

417b

METHOD, APPARATUS AND SYSTEM FOR EGREGIOUS ERROR MITIGATION

TECHNICAL FIELD

The present invention relates to the field of gaming, particularly gaming with electronic user (player) input, particularly gaming with player input on strategy or wager sizes, and particularly gaming where players may exercise options in gaming strategy, such as symbol replacement, card replacement, wager increases or withdrawals and the like.

BACKGROUND

In some forms of casino wagering games, such as blackjack, poker games and other card games, players have opportunities to make elections or to exercise different game and wagering strategies. For example, in draw poker games, poker games in which additional cards are added to an initial partial hand, and any card game in which there are options in the play of games with additional information or additional symbols or additional cards being provided, the player may elect actions from among various different strategies and directions. Although these types of games tend to enhance player interest and prolong play at tables, players may also take excessive amounts of time in play of such games while making decisions. Players also sometimes make poor strategic decisions.

In certain games, particularly blackjack (also referred to as twenty-one), player Strategy Cards are available for purchase and casinos generally allow the use of these cards at gaming tables. These cards represent a summary of the statistically correct way to play a hand of blackjack. By following these guidelines the house advantage is reduced to a number that approximates the theoretical house advantage. Most players do not follow this strategy and, as a result, the house earns a higher percentage of wagers placed. Despite the fact that casinos and gaming jurisdictions have strict laws and regulations prohibiting almost all types of mechanical or electronic devices at gaming tables and gaming apparatus, strategy cards are tolerated by operators because they tend to speed up play and offer players no real advantage that could not be obtained by simple memorization of a set of Strategies.

Certain technologies have been developed over the years to assist players in making strategic play decisions.

U.S. Pat. No. 6,165,069 (Sines et al.) discloses a display system provided on a gaming table in which best strategy information is displayed for view by each player separately prior to a game play decision. As virtual cards are provided to players (usually at least two cards of a player must be shown, as well as the dealer's up card), the strategy displayed for each individual player is shown. As the number of cards in a player's hand changes with additional hits, the strategy may change. This is particularly described in FIGS. 12-19 of Sines et al.

U.S. Pat. No. 7,407,438 (Schubert et al.) discloses a card handling device in which information read from playing cards is transmitted to a processor. The processor analyzes the data, and analyzed information and data are displayed on a player-viewable and/or dealer-viewable screen. The types of displayable information may include at least one of: cut card presence, stop card delivery state, door open, misdeal, continue to deal, stop card delivery routine, hand outcome, player instructions, history of player hand results, game outcome, game rules, hand count advertising, player announcements, deck counts, running card count, true card count, ace card count and house advantage.

U.S. Pat. No. 7,361,086 (Gazdic et al.) discloses a method and apparatus for conducting a wagering game. A value input device receives a wager from a player to play the wagering game. A processor is operative to define a plurality of possible destinations; define a plurality of possible different movement patterns for moving the objects to the destinations; and for a given one of the objects, assign probabilities to the respective possible movement patterns and select one of the possible movement patterns based on the assigned probabilities. A display depicts the object going to a selected one of the destinations in accordance with the assigned movement pattern. The assigned probabilities for the given object may, for example, depend upon the destination that is selected.

Although each of these systems provides some ability to inform players of best strategies in the play of games, there are still weaknesses in the existing systems. One shortcoming of existing systems is that the advice is only provided before a play decision is executed. Once the play decision has been made, the player has no opportunity to retract a bad play decision. In addition, players are ordinarily wary of advice given by casinos and personnel with regard to playing and wagering strategy, and particularly information given by processors on video displays because they suspect the advice is biased toward the house. For example, typical advice received from dealers is "To win more, you have to bet more." It would be desirable if advancing electronic game play technology could provide an information display that speeds up games, gives players the feeling of being trustworthy and prevents players from making egregious errors of the type not contemplated by player strategy analysis.

SUMMARY OF THE INVENTION

A card game monitoring system, in which playing cards (real or virtual) are provided to at least one player, and possibly a dealer is disclosed. After a player receives the playing cards, play and/or wager options are provided to at least one player. Information on card rank and/or suit is provided to a processor. The processor analyzes the information and determines what options in play and/or wager are available to each individual player. The information may already be available on a look-up table(s). The player makes at least one election and the processor compares that election to all available options for the player at the time of that election. The processor determines whether that election is within acceptable wagering parameters or constitutes an egregious error. If the former, the election may be automatically accepted or an alternative better election may be proposed. If the election appears to be clear error, an error of such magnitude as to constitute egregious error, the player is alerted and the election is not accepted until the player confirms the erroneous election (by positive action or by lapse of time) or the player enters a different and improved election.

BRIEF DESCRIPTION OF THE FIGURES

The following Figures are examples of content within the scope of the present application and invention and are not intended to limit the scope of the invention, the embodiments or the claims.

DETAILED DESCRIPTION

Figure 1:
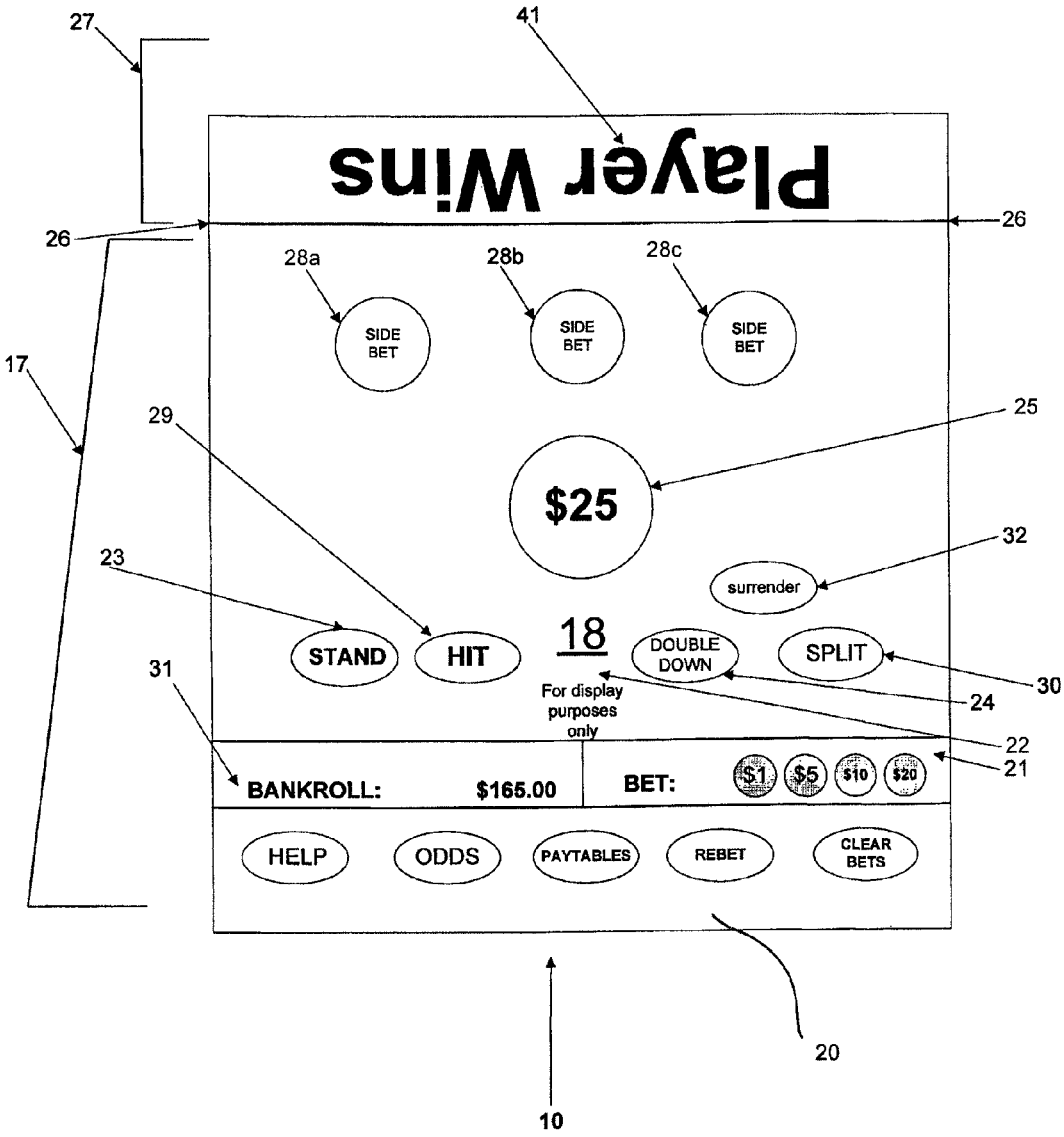
FIG. 1 shows a player display and interface with a dealer area that is displaying a player game outcome in a game of blackjack.

A card game monitoring system is described and enabled. The system may be used on any casino wagering card game system in which a player has some measure of control or election in play of a casino wagering card game. The games may be fully automatic (virtual cards displayed on monitors and electronic wagering through player input controls). The games may also be played on a semi-automatic system, wherein physical playing cards are read and electronic information is sent to a processor, and processed information is used to evaluate decisions and display errors in player decisions. Wagering may be done in these semi-automatic systems by direct token, chip or currency wagers, or by electronic wagering at terminals at each player position. Such automatic wagering systems and semi-automatic wagering systems are disclosed in U.S. patent application Ser. No. 12/231,759, filed Sep. 5, 2008, which is herein incorporated by reference in its entirety, and other alternative automatic and semi-automatic gaming systems (for card games or other table games) are also known in the art.

One facet of the present disclosure is a method of playing a casino table card game in which players have at least one step in which players must make a strategic play election, deciding between at least two alternative play strategies. For purposes of this disclosure, a play election is defined as an election that has the potential for changing a game outcome or payout amount. Examples of play elections made by a player include whether or not to make a base game or ante wager, whether or not to make a side bet wager, whether or not to make a player wager, whether or not to place a double down wager, whether or not to withdraw all or a portion of a wager; whether or not to place a play wager that is a multiple of the ante wager, and the exact multiple elected, whether or not to take a hit card, whether or not to stand, whether to discard a card, whether to discard and draw, whether or not to accept an additional card, whether or not to play a player, banker or tie hand, whether to split cards, whether to set a hand or hands in a particular way, whether or not to hold certain cards, whether or not to utilize common cards, whether or not to switch hands, whether or not to back bet on another player's hand, and a host of other game play strategic decisions that can impact game outcome payouts, either positively or negatively from the perspective of the player. All elections in one example of the invention are made on an electronic player interface. Signals indicating the elections are electronically sent to the game processor.

When the game is blackjack, those strategies may include at least one step of making a first election between a) standing and taking additional hit cards for a point count total, b) splitting cards, and c) doubling down and d) making an insurance wager.

In the play of the method, various steps may occur, such as: a) playing card information on at least rank or count is provided to a processor; and b) a first election between alternative play strategies is performed by a player entering a selection through an electronic player interface. There may be additional selection events throughout the play of the game, but there must be at least one such available election decision available in the play of this method. Certain hands may occur where there are no alternatives (e.g., a blackjack for a player), but in the play of the game, the rules provide that there will be at least some hands where selections must be made. According to an aspect of the invention, the player's selection is sent to a processor. The processor determines if the selection meets a predetermined level of disadvantage to a player. The "predetermined level" may be established by the executable software or hardware built into the system used to practice the method. The predetermined level may be statistically designed (e.g., the selection statistically has at least a 5% less favorable outcome), or designed into a look-up table (e.g., when a player with specific cards has selections available between A, B, C, D and E alternatives, and A is the most advantageous, but B is close in advantage, only selection of C, D or E will be prompted as an error).

When the processor determines that the predetermined level has been met, a prompt is displayed to the player of the determination that the predetermined level has been met. The prompt should be visual, but audio prompts are optional, contemporaneous or alternative modes, especially for sight impaired players. Next, the player is offered a chance to rescind or withdraw the election (or retain the election). The player then elects to withdraw the first election or confirm the election. When the player elects to withdraw the election, an alternate election is entered. The game is then played to conclusion. The method may be played where the casino table card game comprises blackjack (where there are multiple times during play where selections may be required, for example, after the first two cards, and after any subsequent hits), draw poker (where a decision on which cards to discard and replace is made), LET IT RIDE® poker (where multiple decisions may be made on whether to withdraw a part of an initial wager with each community card exposed), Texas Hold 'Em and its variants (where amounts of wagers versus folding are made with each revealed set of community cards), CRAZY 4 POKER® game and FOUR CARD POKER® game in which wagers may be varied depending upon quality of hand or meeting specific hand ranks and the like.

Baccarat variants (for example, where the player elects whether or not to place a side bet wager on the first card drawn), or THREE CARD POKER® variants where the player decides whether or not to play the ante, pairs plus or both wagers based on partial hand information, or how to set Pai Gow Poker hands from the seven available cards, etc. There is a virtually unlimited number of strategic decisions that can be made in different card games. Any decisions that are capable of being statistically evaluated and compared to "ideal" play are play elections that fall within the scope of the present invention.

This list is merely exemplary and is not intended to limit the type or nature of the games that may incorporate play election of the present method and be played on the described apparatus. Preferably, some strategic decisions must be available to players after a wager has been placed and at least a partial hand has been seen by the player.

The method may be practiced preferably with all wagers made by a player entered through the player's dedicated electronic interface, and also played with physical cards dealt to the player(s) and dealer, if a dealer hand is in the game, and to a community card position, if community cards are used. Similarly, it is preferred that all elections made by the player on the player interface are indicated to the dealer on a dealer viewable monitor. Details of player, dealer and player/dealer monitors are discussed in greater detail herein.

The method preferably includes the use of an electronic look-up table provided in the form of data stored in memory associated with the processor. When the game is blackjack, the look-up table uses player count data on player's cards and dealer count data on a dealer's hand up-card, and these point totals are compared to data in the look-up table and the processor determines that the predetermined level (of advantage or disadvantage) has been met on the basis of data associated with the look-up table indicating respective levels of advantage or respective levels of error of at least two available selections. The use of a look-up table avoids having to calculate relative advantages in each selection for each play election. A partial look-up table may be used, with extreme events calculated or partially calculated. The method is preferably practiced wherein no prompt is provided to a player when a most advantageous selection is made or else a positive prompt such as "Good Choice!" may be provided to reinforce a player. The prompt may be provided for any selection other than the most advantageous selection or the prompt may be provided for less than all selections available to the player other than the most advantageous selection.

In one specific example of a method of play with blackjack, the prompt is provided to the player and an option to withdraw a play election is given a player when the election made is to take a hit when a player has a point count equal to or greater than a count of a hard 17. Another specific example would be where a prompt is provided and an option to withdraw an election is given a player when the election made is to take a hit when a player has a point count equal to or greater than a count of a hard 16.

In one example of the invention, all election decisions are displayed on a dealer viewable monitor. This monitor may be a dedicated dealer monitor, may be a portion of a player monitor viewable by the dealer, or both.

In the play of some embodiments of the method, playing card information is provided from at least one source selected from the group consisting of a delivery shoe with a playing card reader, a shuffler with a playing card reader, a playing card reader on a gaming table over which playing cards are moved one-at-a-time, and an overhead camera managing system. The overhead camera managing system as disclosed in U.S. patent application Ser. No. 11/558,810, filed Nov. 10, 2006 describes a game monitoring system comprising at least one camera configured to capture images over a game surface, and is operatively associated with an image processing engine that retrieves information from the images, the content of which is incorporated by reference.

The method of playing games according to the presently disclosed technology can be performed on a playing card gaming system. The system is capable of offering players an opportunity to retract a disadvantageous input selection. The system may have, by way of non-limiting descriptions of components:

a) a card delivery system in which at least one playing card information is selected from the group consisting of i) count and/or ii) rank are read;

b) a gaming table (the table may be a physical table, an electronic table, a virtual table on an internet connection, or the like);

c) at least one and preferably a plurality of player interfaces physically associated (electronically interfaced, physically attached, embedded to the frame or tabletop, cable snapped in, or the like) with the gaming table and each player interface having a player display (or there might be a group display board for all players);

d) at least one game controller receiving read card information originating from the card delivery system;

e) the game controller programmed to identify player selections through the player interface that are less advantageous to the player than at least one other selection available to that player;

f) at least one game controller is programmed to provide the player with a visual indication on the player display that a selection made by the player is a less advantageous selection of a possible game play error; and g) the processor enabling the player interface where a less advantageous result has been indicated to iii) withdraw the selection and make an alternative selection or iv) continue with the election.

The player interface may be configured to allow the player to make a selection between continuing with the identified disadvantageous selection or reversing the error on the selection through the user interface, where the interface includes v) buttons dedicated to the continuing of the selection or the reversing of the selection on a panel or vi) contact sensitive areas on a touch screen enabling continuing the selection or reversing the selection. The card delivery system preferably used may be at least one card reading component selected from the group consisting of a delivery shoe with a playing card reader, a shuffler with a playing card reader, a playing card reader on a gaming table over which playing cards are moved one-at-a-time, and an overhead camera reading playing cards that are face-up. The game controller may contain a look-up table of relative advantages of elections available at a time in the play of a game where a player may exercise at least one election between at least two alternatives and the game controller compares the election made by a player to other elections in the look-up table to identify relative player advantage of the election made to other available elections.

An alternative description of apparatus for the play of a casino table playing card wagering game according to the described method may include a system for providing playing card information to at least one player. The system provides playing card information to the at least one player and also provides the player card information to a processor. A player input interface enabling the player to make at least a first strategic decision in the play of the casino table playing card wagering system after at least a partial hand of playing cards is provided to the at least one player. The processor contains software that may be executed to analyze or compare any entered first strategic decision to determine if that entered first strategic solution is disadvantageous as compared to at least one other strategic decision available to the player at that time. A video display is viewable from a player's position. The processor is enabled to visually prompt a player on the video display if the first strategic decision entered by a player is disadvantageous as compared to at least one other available selection. The processor has the ability to enable the player input to retract the first strategic selection and provide the player with an opportunity to make an alternative first selection through the player input interface.

In the play of a game, playing cards (real or virtual) are provided to at least one player, and possibly a dealer. If the game is executed on a stand alone gaming machine, there may be only one player interface. After a player receives the playing cards (especially an initial hand or partial hand), play (including wager) options are provided to at least one player. The types of play options that may be made by a player at this intermediate junction may include at least one of additional wagers, withdrawal of part of existing wagers, discarding one or more cards for replacement cards, taking additional cards (one at a time or in groups of multiple cards) and the like. Information on card rank and/or suit is provided to a processor. The processor associates the card information with a player position or player, and analyzes the information and determines what options in play and/or wager are available to the player. The information may already be available on a look-up table(s). The player makes at least one play election and the processor compares that election to all available options for the player at the time of that election. The processor determines whether that election is within acceptable wagering parameters or constitutes an egregious error. If the former, the election may be automatically accepted or an alternative, better election may be proposed. If the election appears to be clear error, an error of such magnitude as to constitute egregious error, the player is alerted and the election is not accepted until the player accepts the erroneous election (by positive action or by lapse of time) or the player enters a different and improved election.

By providing the player an opportunity to correct an egregious error, any second thoughts on the part of the player can be addressed without interrupting the play of the game. Providing the "undo" opportunity allows the dealer to avoid undoing subsequent player decisions if the previous player changes his or her mind on a particular play decision. The undo opportunity also prevents the dealer from drawing a card from the card handling device before the destination of the card has been determined.

Allowing players a second chance to alter play strategy also has the impact of building player goodwill, giving the player the feeling that the house is looking out for the player's best interests, and is not taking advantage of periods of inattentiveness, or lack of player knowledge.

Players will feel the game is more fair, and will prefer playing games on gaming systems that provide them with a second chance to make good strategic play decisions.

One method of practice of the present invention is described below. One example of the generic types of semi-automatic equipment that may be used to practice this type of method follows the method description.

A gaming system is provided in which information on card values (e.g., at least rank or count, and sometimes rank and suit, and sometimes rank, suit and count) is provided electronically to a processor. The processor also has software containing game play rules and enabling the processor to analyze the information on card values and define simple and complex situations and options and events that occur in the play of a game of cards in that gaming system, wherein in that game a player has the ability to make elections, selections and choices relating to strategy and/or wagering in the play of the game. For example, the processor may have game information on the play of blackjack, blackjack variants, poker, poker variants (such as LET IT RIDE® poker, where players have options of letting wagers ride or withdrawing wagers), draw poker and draw poker variants, and the like. The process of the present technology has particular value when the underlying game provides the player with choices, options, elections or selections of actions in the play of the game, as opposed to a game such as standard baccarat where a player's only elections are the amount of an initial wager and the selection of a wagering option (Banker hand win, player hand win or tie). There are many situations or stages in these games where a player has a decision to make, and in using electronic gaming equipment, it is often easier to make mistakes in the play of a game, especially in wagering and card play where there are multiple entry options at a single time, and the player may be tired or distracted.

The system may or may not offer advanced information prior to a play election (such as providing statistical probabilities on the play of one choice versus another), but it does offer post-selection alerts or prompts when a possible error has been made by a player, and before that option is finalized (where the player would have full knowledge of the outcome of that selection). When the player is prompted by the system, which prompting may range from a simple "Are you certain this selection is to be completed?" or like prompting, to "The selection indicated appears to be in error or against player's advantage because . . . " (followed or not by a brief explanation of the nature of the error). Along with the prompt, the player may be provided with at least two options, such as "Accept Initial Selection" or "Cancel Initial Selection." The player may enter the option, either accepting the initial selection or may be sent back to the stage where the option was made, offering a chance to make an alternative selection.

The prompt or error message may be tailored to indicate any level of "error" or judgment exercised by the player, such as a decision to make a play that offers less than 5% disadvantage to another play, or to a decision to make a play that offers a more significant or egregious disadvantage as compared to another play, even where the play assures a loss or 100% disadvantage. Both the play of blackjack games and poker games are of particular interest, but blackjack will be used to best exemplify the kinds of errors and options offered in the practice of this method.

In the game of blackjack, there are numerous opportunities for players to make choices in strategies and to make mistakes with some of the strategies. A basic game of blackjack begins with each player making at least one wager in play of a player's hand count against a dealer's hand count. Two cards are dealt to the player, usually face down (as the dealer plays without any ability to exercise any strategy or exercise any options) and two cards are dealt to the dealer, usually with one card face up to give the player partial information on a dealer's hand. Each player in turn, after viewing their own hand and viewing the dealer's up-card, then has a number of options, depending on the player's cards and the dealer's up-card. In different circumstances, the player's options may include one or more of standing, hitting, surrendering, splitting, doubling down, making an insurance wager and the like. In certain situations, these options may be slightly equivalent in advantage to players, while in other situations, the different strategies may vary so significantly that, where selection of one strategy versus another has such a significant difference in player advantage versus the other option, it should be considered as an egregious error. The game of blackjack will first be examined at its various stages, with various option-type situations, and the method according to the present technology evaluated. The game will be illustrated on the Shuffle Master, Inc. I-TABLE® gaming system, in which playing cards are read by a shuffler or delivery shoe, the read information on the playing cards is sent electronically to a processor, and all wagers and player entered commands to the dealer are displayed on one or more player and player/dealer monitors on the gaming table. Wagering is preferably done electronically, and commands to the dealer are entered by the player on a player screen and displayed to the dealer on a dealer viewable screen or screens. It should be noted that a player decision to split a pair of 4's or 5's is an error that could also be considered egregious, and that would result in a prompt from the processor to confirm the play election or change the election.

After the player sees the initial two-card hand dealt to that player position and the dealer's up-card, the player may have various options of stand, hit, split cards, double down (DD), surrender (Surr.), insurance wager, and the like. These various scenarios will be evaluated, using the dealer's up-card as a point of reference. In the table, "D-Up-Card" indicates the point count of the dealer's up card, "P-Count" is the player's first two-card count, "B-Option" is the player's best pption, "Alt-Opt 1," "Alt-Opt 2," and "Alt-Opt 3" are the player's alternative options, and "A" (nearly equivalent), "B" (significantly less), "C" (much less) and "D" (egregious or disastrous) indicate the relative advantage to a player of an option as compared to the best option. Splits are available only when a player's two cards are the same value, such as two 10-count cards, two nines, two fours, etc. It will be assumed that the two cards of equal rank are not 5's or 4's, as it is usually assumed that those pairs should never be split, as that acts to a player's disadvantage in almost all circumstances.

| | D-Up-Card | P-Count | B-Option | Alt-Opt 1 | Alt-Opt 2 | Alt-Opt 3 |
|---|---|---|---|---|---|---|
| 1 | Ace | 21 (BJack) | Stand | Insurance B | Hit D | DD D |
| 2 | Ace | 17-20 | Stand | Insurance B | Hit D | Surr. C |
| 3 | Ace | 3-16 | Hit | Stand B-C | Surr. C | |
| 4 | 10-Count | 21 | Stand | Hit D | | |
| 5 | 10-Count | 20 | Stand | Split C | Hit D | |
| 6 | 10-Count | 17-19 | Stand | Hit D | Surr. C | |
| 7 | 7-9 Count | 21 | Stand | Hit D | | |
| 8 | 7-9 Count | 17-20 | Stand | Hit D | | |
| 9 | 7-9 Count | 12-16 | Hit | Stand C | Surr. C | Split C |
| 10 | 7-9 Count | 3-11 | Hit | Stand C | Split C | |
| 11 | 2-6 Count | 17-20 | Stand | Split C | Hit D | |
| 12 | 2-6 Count | 12-16 | Stand | Hit B | Split A | |
| 13 | 2-6 Count | 3-11 | 10-11 DD | Hit A | Stand B | Split C |

These events in the table are not intended to be all inclusive of events, but are instructional as to many of the more common first two-card events for a player. It must be remembered that, where electronic options are entered by players, some entries may be mechanical errors by the player (pushing a wrong button or touching the wrong surface on the touch screen), so that even an absurd selection may be made.

In situation 1 in the table, no alert would be presented when a player elected to stand. In fact, the apparatus might make this a compulsory step, as no other choice is reasonable, other than an insurance wager. If the player accidentally enters "Hit" or double-down (if allowed on a count of 21) on his option, the display screen viewable at least to the player would prompt the player to reconsider his entered option. The election would not be implemented until the player indicated his override of the prompt by confirming the original election. The player might be prompted by a message such as:

Player Alert—Possible Error in Selection

Player Has Blackjack—Guaranteed a Win or Tie

Overrule Selection

YES NO

The player, when so prompted, would press the "overrule yes" option, and the screen would return to the initial two cards of the player where he would elect to stand or pay the insurance wager amount.

Situation 2 is another mechanical or accidental election error with regard to a "Hit" election. The prompt could be displayed such as:

Player Alert—Possible Error in Selection

Player Has Pat Hand—Bust Possibility in Excess of 60%

Overrule Selection

YES NO

The player, when so prompted, would press the "overrule yes" option, and the screen would return to the initial two cards of the player where he would elect to stand or pay the insurance wager amount. Each of the various situations 1-13 would be played out with similar prompts in the play of blackjack.

The type of preferred system or apparatus on which the method of the present invention would be played would include at least a player input for making game play decisions, a processor for receiving a first game play decision and comparing the game play decision made by the player with multiple options for game play decisions available at that time to the player, determining if the game play decision made by the player is disadvantageous to the player's likelihood of success in the play of the game, and if determining that the disadvantage is so great that the player should be alerted, alerting the player in advance of irretrievably accepting the decision and offering the player an option to withdraw the first game play decision and enter a second game play decision instead. The system would also require a player input interface for the player to make wagers and player selections, and a display for the player to view the prompts by the processor with regard to apparently erroneous or highly disadvantageous elections. The processor should also enable accounting, debiting, crediting and payout functions on the play of the game. These tend to be fairly minimal requirements for the apparatus, but other desirable aspects of the system are further described below.

A more preferred system would include, by way of a non-limiting example:

a. a card shoe with card imaging capability;
b. a physical gaming table with a horizontal, planar play surface;
c. a plurality of player interfaces flush-mounted into the gaming table surface and a player display associated with each player interface; and
d. a game controller, wherein the game controller is programmed to provide the player with a visual indication of a possible game play error and further provides a visual indication of a player choice to reverse said error; and wherein
e. the player interface is configured to allow the player to make a selection between continuing with the error or reversing the error on the play of each game.

The following description of apparatus and system technology emphasizes accounting, crediting, debiting and change (exchange values of chips or tokens displayed) functions in a semi-automatic table gaming apparatus using a playing card-reading shuffler or playing card-reading delivery shoe to provide information to a processor about hand count values.

Players also may independently (at their own initiative) initiate a change of value of one or more virtual chips displayed on their individual player input screen or their individual region on a shared (player with player or player with dealer) screen region. This activity can be initiated through player contact with the touch screen by various types of player contact with individual virtual chips, groups of virtual chips (less than all virtual chips in a stack) or stacks of virtual chips of different denominations. After initial virtual chip contact on a touch screen, there may be a continued contact (e.g., touch and drag) or a separate contact (tap on a first virtual chip value location, lift and tap on a different virtual chip value location). Predetermined activities or sequences of activities will cause an apparent change in at least some virtual chip denominations, changes in virtual sizes of stacks of virtual chips and enable players to provide denominations of chips to themselves for use in virtual wagering from their individual touch screens.

Methods and systems according to the present technology may include at least a method for providing player control of wagering on an electronic interface comprising:

a) providing a player with a touch screen monitor player interface;
b) the player touch screen interface in communication with an accounting function in a processor;
c) the touch screen interface showing at least a portion of a player's available credit balance as one or more stacks of virtual chips;
d) the touch screen interface provides at least two separate areas where individual stacks of different value chips may be displayed;

the method comprising:

a player indicating through contact with the touch screen to the processor that one first value of chip(s) is to be exchanged for another value of chip(s);

the player indicating through contact of the touch screen a second value for which the one first value of chip(s) is to be exchanged;

the processor identifying a number of second value of chips for which the one first value of chip(s) is to be exchanged; and the processor reducing displayed numbers of the first value of chip(s) displayed on the touch screen monitor as directed by the player and displaying an increase in number of second value of chips on the touch screen monitor corresponding in value to the exchanged first value of chip(s).

A single processor or multiple processors may be used and are included in the term "a processor" and "at least one processor," unless a specific number of processors is noted. The method may either have the player exchanging a larger denomination chip for a greater number of smaller denomination chips or the player exchanging a first number of smaller denomination chips for a second but smaller number of larger denomination chips. The player may initiate the exchange by touching on the touch screen a virtual image of the larger denomination chip and dragging the contact to a position on the touch screen where smaller denomination chips are to be positioned in a chip tray. Or, the exchange can be made by touching on the touch screen a virtual image of the smaller denomination chip and dragging the contact to a position on the touch screen where larger denomination chips are to be positioned in a chip tray. The processor determines if sufficient value is present within an image of the smaller denomination of chips, and if sufficient value is determined by the processor to be present, visual imagery on the touch screen of numbers of both the smaller denomination of chips and the larger denomination of chips are correspondingly altered in display of value. Predetermined tap patterns (by way of non-exclusive examples) may include requiring a single tap on each position, a double tap on an originating denomination and a single tap on the receiving denomination, or a single tap on the originating denomination and a double tap on the receiving denomination. The tap patterns may be the same or different for chip exchanges in color-up or color-down (breaking a chip) transactions.

A general description of a system for monitoring the play of a casino card game according to the method generically described herein may include, by way of non-limiting examples:

a gaming table;

a game controller programmed to administer a casino wagering game on the gaming table;

a plurality of player displays, each display having a first area with the player's touch screen interface for providing a player with game information, wherein each player display includes at least one user interface enabling credit wagering;

a card reading device for reading at least the rank of a card prior to delivery to a player; and a dealer interface for administering the game.

The system may include a second area on the display for displaying information to the dealer. A dealer touch screen interface is provided and performs multiple functions, non-limiting examples including: player buy in, player cash out, enabling a player interface, disabling a player interface, transfer credits, dealer log in, dealer log out, notification of a dealer blackjack, assignment of a dealt card to a hand, reconciliation of wagers and canceling a player election. The system may include a card handling function with an integrated card reading device, wherein the card handling device is selected from the group consisting of a shoe and a shuffler. The system may have at least some of the information displayed in the first area and the second area of the player display as alphanumeric information. The system may include a double-sided display in communication with the game controller, wherein the double-sided display displays first information to players and second information to pit personnel. The player displays may be flush-mounted into a top surface of the gaming table and the gaming table may have a fabric covered upper surface, wherein the upper surface preferably lacks game-specific markings.

In the content of the display noted above, the first information to players may be selected from the group consisting of: pay table, game name, casino name, game logo, casino logo and casino advertisement.

In providing a dual function programmable player display, the display may have:

a display screen comprising a first area for displaying player game play information and a second area for displaying player information in a first orientation and dealer information in a second orientation; and touch screen controls in at least the first area enabling players to place wagers, exchange value of displayed virtual chips and input play decisions; and displaying information in the second area for use by a dealer.

The card reading system may be selected from the group consisting of an overhead card imaging system, a tabletop card reading system, a card reading shuffler and a card reading shoe, and the display may be programmed to enable a dealer to view player cards and set a player hand. The display may also have touch screen controls in the second area and wherein the touch screen controls are used by the dealer to indicate a function selected from the group consisting of: a hand resolution, the identification of a winner, enabling wagering, disabling wagering and to set a hand.

In addition to the time element, there are the issues of accuracy. Sometimes players are paid on wagers that should go to the house, and there are times when players should be paid and their wagers are forfeited to the house. There are times players are given more chips than they paid for, and there are times when players and/or dealers cheat the house by capping and/or pinching wagers.

Therefore, it is desirable to provide a system that facilitates the speed and accuracy of a live card game without disturbing the unique environment a live card game offers players.

Chipless table games operate on credit instead of using traditional gaming chips. Therefore, the need for chips is eliminated, except optionally, for when cashing a customer in or out. The use of the credit based system speeds up game play by eliminating time the dealer would spend exchanging cash for gaming chips, calculating and paying wins, and increasing hands per hour. This also increases revenue for the casino by increasing play and eliminating dealer error in paying out wins to customers.

The use of a chipless gaming table eliminates the cost of purchasing chips. Wager amounts are electronically recorded, eliminating the need for more costly RFID chips and antennas.

Figure 12:
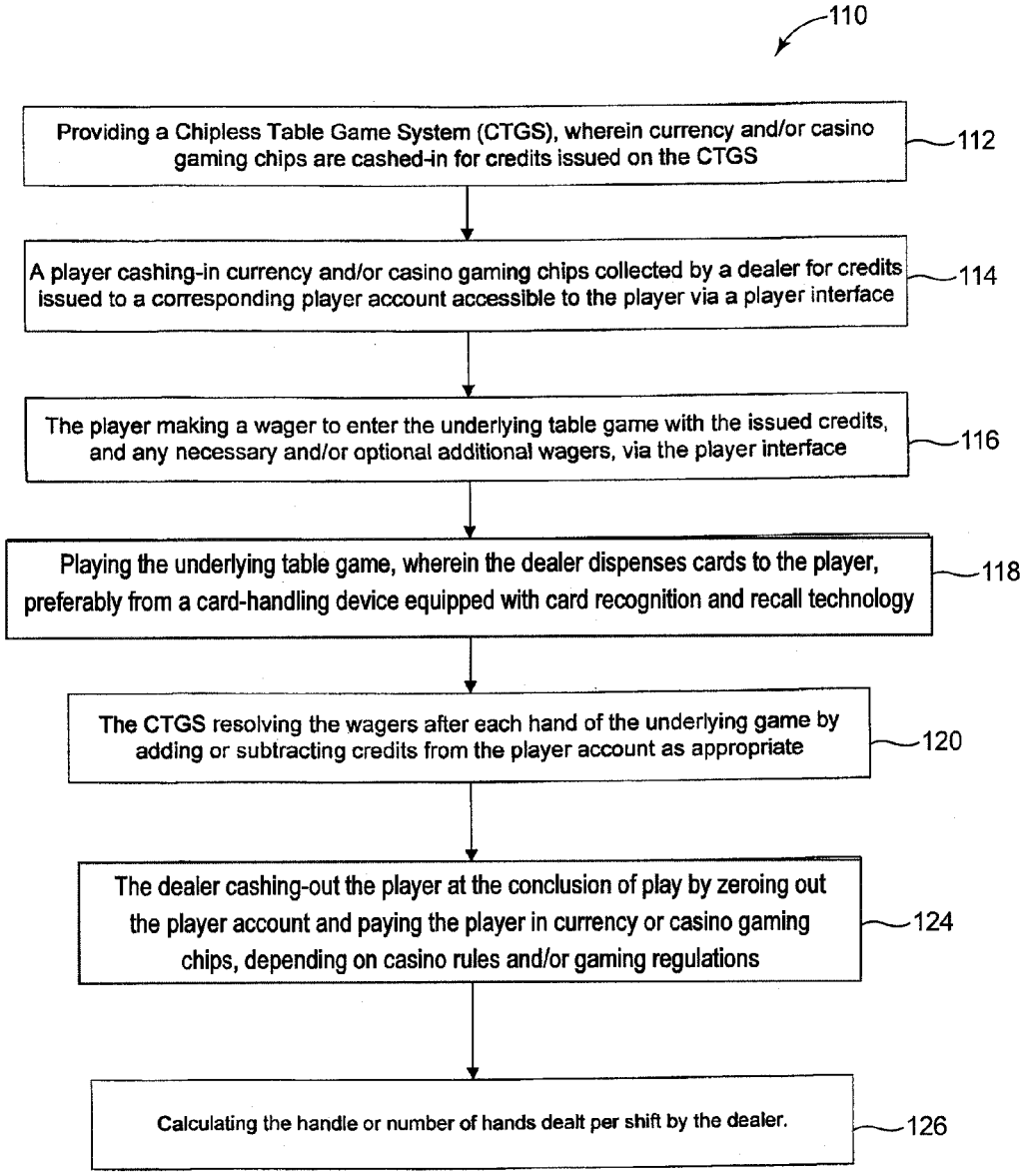
FIG. 12 is a flow diagram of an exemplary process of the present invention.

FIG. 12 is a flow diagram for the method of the present invention, generally referred to as numeral 110. A Chipless Table Game System (CTGS) is provided at step 112. The CTGS generally has a dealer station with a dealer interface and a plurality of player stations, each including a player interface, such as a touch screen or control buttons, and operates with purchased credits instead of casino gaming chips. At step 114, a dealer "cashes-in" a player wishing to join the underlying table game by accepting currency or casino gaming chips and issuing credits for a player to wager with to the corresponding player account accessible to the player via the player interface.

At step 116, the player makes a wager to enter the underlying table game using the credits and also makes any other necessary or optional additional wagers to continue play via the player interface. Then, at step 118, the underlying table game proceeds as usual. The dealer dispenses physical cards to the player, preferably from a card handling device equipped with card recognition and/or hand recall technology. Hand recall information is useful when the game requires a fixed number of cards dealt to each player, and the final hand is determined at the point that the hand is dealt and assigned to a player position.

Upon conclusion of a hand of play in the underlying game, at step 120, the CTGS automatically resolves the wagers by adding or subtracting credits to the corresponding player accounts as appropriate. The dealer then cashes-out the player at step 124, by zeroing out or resetting the player account and paying the player for any winnings or balance on the account in currency or casino gaming chips, depending on casino rules and/or gaming regulations.

At step 126, the CTGS calculates the handle or number of hands dealt (per shift or per play session, or per other unit of time) by the dealer. This information may be downloaded from the CTGS manually or networked with the house computer system to do this automatically.

As defined herein, a "Chipless Gaming Table" is a traditional live table game experience on a novel gaming platform that includes a casino game played according to predetermined set(s) of rules, at least one dealer, physical playing cards, and at least one player to place at least one electronic wager to participate in the game provided. The Chipless Gaming Table includes a plurality of electronic player displays and touch screen wagering interfaces, the displays flush-mounted into the gaming table surface, wherein players place wagers and execute game decisions electronically on displays equipped with touch screen controls (e.g., liquid crystal display (LCD) screens) and/or other touch screen forms of suitable user interface technology while playing a live table game.

In a preferred embodiment, the Chipless Gaming Table includes a dealer PC/game server, wherein the PC/game server is located where it is easily accessed by the dealer, for example, through a dealer input/output (I/O) system, which may be in front of the dealer, to the side of the dealer (on or associated with the table) and/or in a chip tray.

Preferably, the PC/game server is operatively associated with an intelligent card handling and/or card reading device located on the table. The device preferably has card reading capabilities. The intelligent card handling device (i.e., a card-reading shoe or shuffler) correlates read card rank and suit information with known stored card values and transmits said correlated card data to the dealer PC/game server for use in administering the game. Although card handling devices that read special card markings on cards can be used as a part of the disclosed systems, it is preferred that the intelligent card reading devices read the standard rank and/or suit markings on conventional playing cards, eliminating the need for the casino to use specially marked cards.

The dealer PC/game server has a main game controller programmed with the rules of the game (and, optionally, other games) being executed at a table, wherein the dealer PC/game server receives and correlates the card information received from the card handling device with known game outcomes and the dealer PC/game server determines a game outcome(s) based on the actual dealt card values. The dealer PC/game server is in communication with a plurality of electronic wagering interfaces, wherein each electronic wagering interface transmits, and receives, updated game and wagering information as each game progresses and as each game is eventually concluded.

Figure 11:
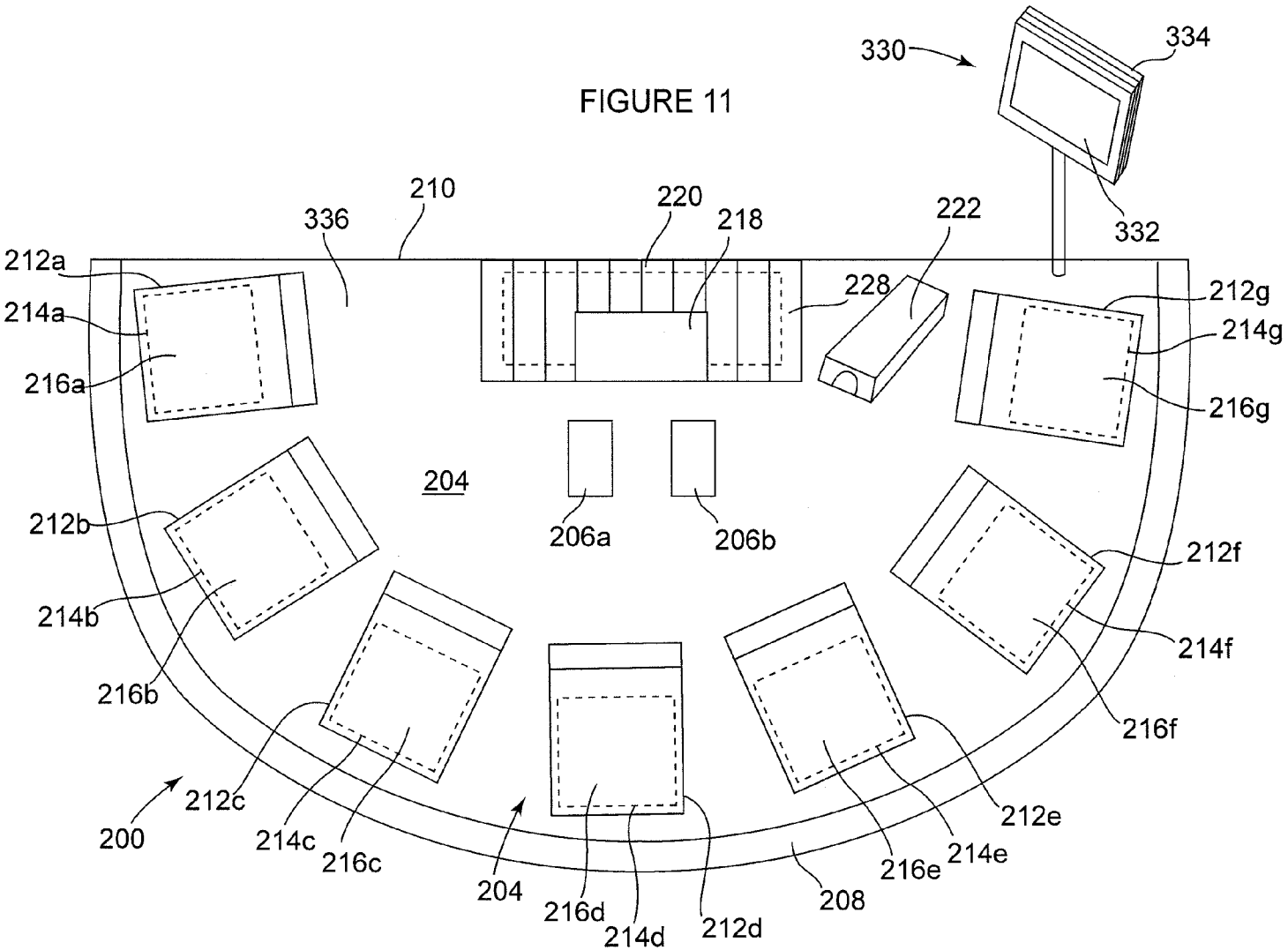
FIG. 11 shows an embodiment of a table system layout for chipless gaming tables described herein.

One preferred embodiment of a player display for the Chipless Gaming Table features LCD touch screen technology, but plasma and/or other suitable technology may be employed as desired. Preferably, a plurality of displays with touch screen controls are flush-mounted into a gaming table surface at each player position (as shown in FIG. 11, and as described in detail elsewhere). The controls in one embodiment are divided into two separate areas and the different areas serve a number of purposes, including functioning as a player wagering interface. It is preferred that each display has its own processor, wherein each processor controls its own display, and each display processor is in communication with a main game controller/game server. In a preferred form of the invention, the display processor administers graphics functions of the display. All other game events are administered by the central game controller.

Figure 2:
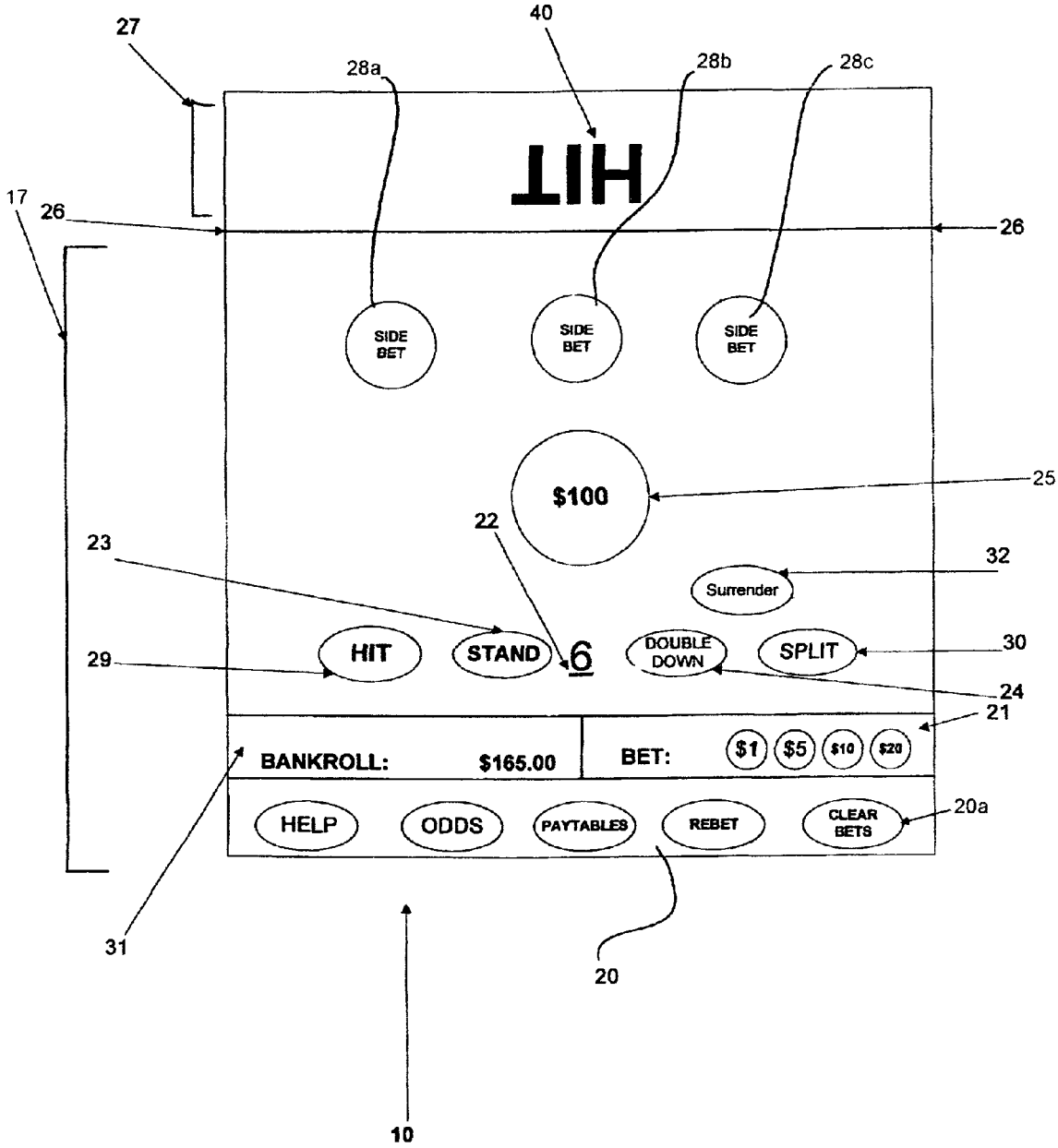
FIG. 2 shows the player display of FIG. 1 and a player play decision in the dealer area.

One preferred embodiment of a player display 10, as shown in FIG. 1, enables the player to input play decisions as well as wagering decisions. For example, a player area 17 of the player display 10 includes commands that are carried out by the dealer. In the game of blackjack, "stand" 23 and "hit" 29 instructions can be communicated via the touch screen controls to the game controller as well as providing a visual instruction to the dealer. When the dealer responds to a "hit" 29 command input by the player (the hit command displayed to the dealer in dealer area 27, as shown in FIG. 2), the controller receives a card rank and/or suit signal from the card handling device (preferably a card reading shoe), and the controller now knows that the dealt card should be associated with the hand dealt to the player position that requested the hit card. Enabling the calling of cards or commands to "split" 30, "double down" 24, "hit" 29, or "stand" 23 similarly enable the game controller to assemble hand information and associate that hand information with a particular player display 10. The player display 10 can be equipped with a separate or integrated player tracking system (not shown) of known configurations that enable the game processor to associate win/loss information with a particular player.

The player display 10 is advantageously divided into the first player area 17 and the dealer area 27. The dealer area 27 has multiple inventive functions as will be described in more detail below. In a first mode, the dealer area 27 displays a game outcome in a format that is oriented for view by the dealer. This information is used by the dealer to confirm that the player is entitled to a payout. Payouts are preferably made automatically. However, the information is useful for the dealer to react positively to the player win, and encourage the player to re-bet the winnings, maintaining the ambiance of a live table game experience. In a second mode, the dealer area 27 is used to instruct the dealer to take appropriate action.

Referring to FIG. 2, one possible dealer action is to deal the player a "hit" card, as shown by instruction 40. Other instructions 40 specific to blackjack might be to "stand," only deal "one more card" when the player doubles down, to "deal more cards" when a player has split a pair, etc. In a third mode, dealer area 27 is used to display game information or advertisements in an orientation viewable by the player. In this mode, the alphanumeric information or graphical information is oriented such that the player can readily read and/or understand the message conveyed. In a fourth mode, the dealer area 27 is touch screen enabled, providing the dealer with a means for inputting play information, such as concluding the play of a hand, activating a player display to request player commands, deactivating the player display 10 to indicate the close of wagering, or other activities such as setting and rearranging hands.

In the game of Pai Gow Poker, for example, it might be necessary to display player cards on the dealer or player areas 27, 17 of the display, although it is not necessary to display virtual cards in administering the game of blackjack. In the game of Pai Gow Poker, the player's seveb cards might be displayed in dealer area 27, and the dealer might be instructed to "set hands." The dealer would either touch the five cards that define the high hand or the two cards that define the low hand. In one embodiment, the dealer can touch and drag cards to group them in the desired manner. In other embodiments, touching the cards defining one hand rearranges the cards on the display into set hands. The player must then arrange the physical cards to match the dealer instructions.

The touch screen is further enabled to allow the dealer to touch and drag cards from hand to hand, in the event that the dealer determines that the dealer's setting of the hand does not comply with the "house way." When the dealer area 27 is being used to instruct the dealer, the text is preferably inverted such that the information can be understood by the dealer. When the dealer area 27 is used to provide information to the player, the information is preferably oriented so that the player can readily understand the information. In one exemplary form of the invention, a separation line 26 is provided to divide the two display areas 17 and 29.

An essential feature of the chipless gaming table is the player display 10 with at least one touch screen control panel overlay, or control panel. The overlay preferably extends over the entire surface of the player display 10. The player display 10 may be pressure sensitive, heat sensitive, moisture sensitive, conductive or use any other known technologies to input decisions. In other examples of the invention, the touch screen controls cover only a portion of the player display 10. The touch screen controls are configured to provide a player control area 20 for the player to make game decisions and to obtain information on how to play the game.

An exemplary player control area 20 includes a plurality of electronic buttons, for example, "help," "odds," "paytables," "re-bet" and "clear bet" buttons. The "help" button activates the display of a separate help screen that provides game rules and could offer strategic advice to the player on wagering and other game play decisions. The "odds" button displays the true odds payout for making a side bet on a particular combination of player and dealer initial cards. The true odds betting methods are disclosed in co-pending U.S. patent application Ser. No. 12/075,008 filed Mar. 7, 2008, entitled "Side Bet Odds Wagering System" and assigned to Shuffle Master, Inc. The content of this disclosure is herein incorporated by reference. The "pay tables" button activates a screen that displays the pay table or tables showing winning combinations and corresponding payout odds for the base game and/or a side bet wager or wagers. The "re-bet" button allows a player to make the same size wager as made in the previous hand. The "clear bets" button resets the display so that the player can make a new wager.

The control panel includes a bankroll indicator 31 showing the total number of credits the player has available for play, and a virtual chip area 21 that displays the various denominations of virtual chips that can be wagered in the game.

Various decision options relative to the game rules of blackjack are located above the bankroll indicator 31 and the virtual chip area 21, such as, but not limited to, a stand button 23, a hit button 29, double down button 24, a split button 30, and a surrender button 32, wherein players execute each desired game decision by using hand motions such as, but not limited to, touching and/or tapping the desired button. The player area 17 of the player display 10 in one embodiment is programmed to display the running count of the player's hand in card hand total area 22. In other embodiments, this information is not displayed.

Above the player instruction buttons (i.e. hit 29, stand 23, double down 24, split 30, surrender 32, and insurance (not shown)), a primary wager area 25 is provided to indicate the amount of the wager. The player makes this wager by touching the $20 chip (five times) in the virtual chip area 21. The player can optionally make a number of side bets in one or more areas 28*a*, 28*b* and 28*c*. In one exemplary form of the invention, the player can change his or her bet before the close of betting by depressing the "clear bets" button 20*a* on player control area 20. At the conclusion of play, payouts may be displayed by showing virtual chips "paid out" next to the betting areas 25, 28*a*, 28*b*, and 28*c*, and the bankroll indicator 31 is incremented with the appropriate credits. An alphanumeric "WIN" indication (not shown) may also pop up on the player display 10.

As noted, a preferred method of practice of the present technology is for the dealer area 27 or the player area 17 of the player display 10, or both segments 27, 17 to be provided by picture-in-picture technology, whether in analog or digital format. Circuitry and processing support systems enabling this picture-in-picture format and picture-on-picture format are known in the video monitor and electronic imaging art, such as in U.S. Pat. No. 7,573,938, issued Aug. 11, 2009, to Boyce et al.; and in Published U.S. Patent Application Nos. 2007/0275762 to Aaltone et al., 2007/0256111 to Medford et al., and 2004/0003395 to Srinivas et al.

The dealer area 27 may display a dealer instruction 40 such as a "HIT." The player decision to hit in blackjack is input by pressing the "hit" button 29. The decision was executed after evaluating a dealt two-card blackjack hand (not shown) totaling 6 (six), the total displayed in card hand total area 22 (FIG. 1). Displaying the card count is possible when a chipless table is used in connection with a card-reading shoe, card-reading shuffler or other card reading device, such as an overhead camera imaging system, as disclosed in U.S. Patent Publication 2005/0272501, the content of which is incorporated herein by reference. The card information is sent to the game processor. The game processor calculates the hand count and transmits the count to the player display 10. The game processor further instructs the player display 10 to display the count in card hand total area 22.

The card hand total area 22 may optionally be presented on a communal player display 332 facing the players (and, optionally, on a pit display 334 facing the pit), illustrated in FIG. 11. It is important to note that the player decision/action 40 is displayed in the dealer area 27 and presented in the form of an instruction 40 readable by the dealer (inverted, rather than in an orientation readable by the player). Since the dealer is standing and facing the players, the text of instruction 40 is inverted (upside down) with respect to the player's view and is easily read and/or interpreted by the dealer. The inverted text 40 showing in the dealer area 27 provides the dealer with player game information as well as informs the dealer that a player decision "HIT" has been acknowledged by the system. The dealer must then respond by taking action. The dealer area 27 clearly informs the dealer a player is requesting an additional card/"HIT" in a text and manner readable by the dealer. The dealer, in response, then removes the next card from the shoe and delivers the card to the player that requested the "HIT."

As a game progresses to a conclusion, a player's final game outcome 41 (FIG. 1) shows in the dealer area 27, wherein the dealer can take appropriate action. Other information that can be shown in the dealer area 27 includes "blackjack," "bust," "jackpot win," etc.

Figure 3:
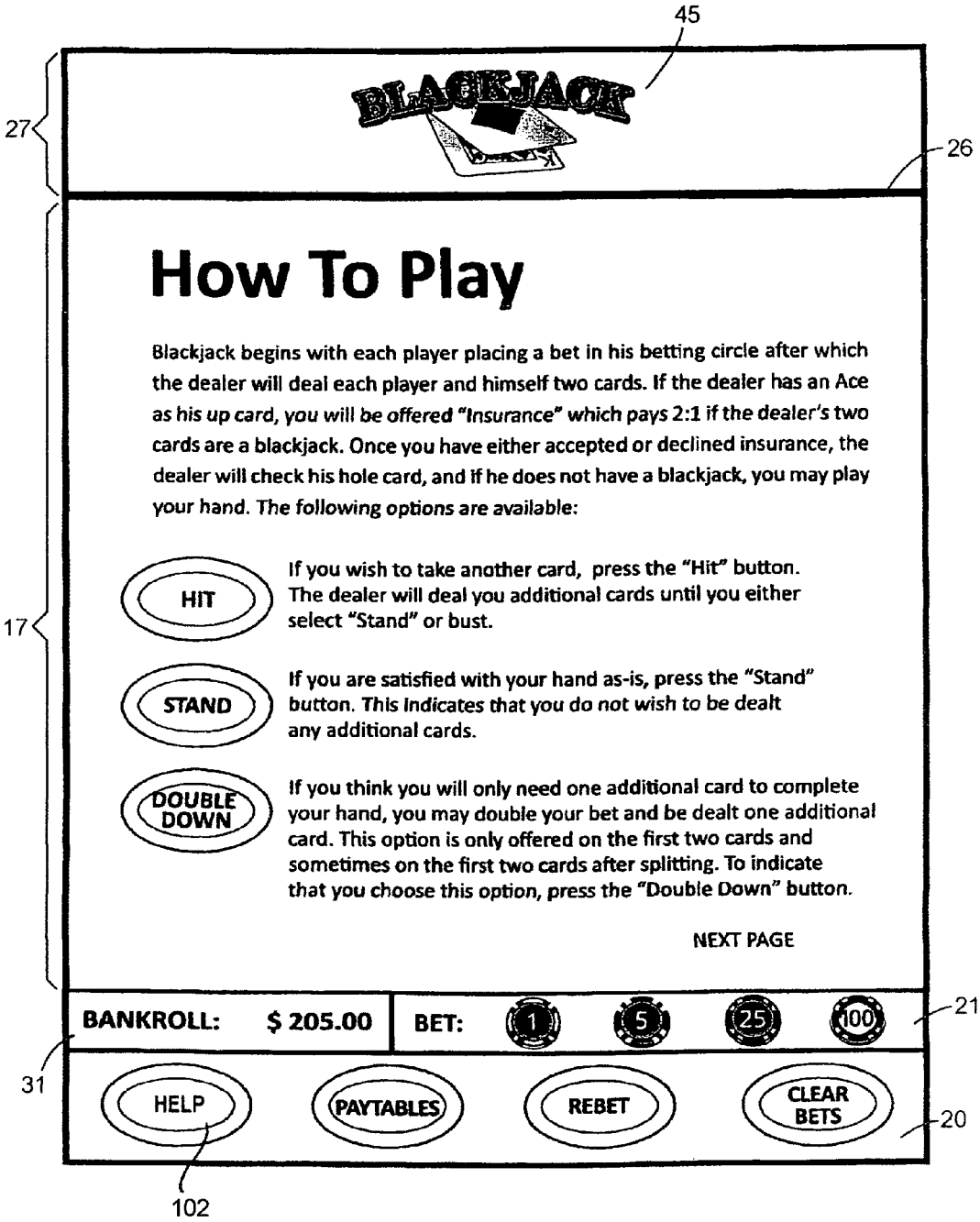
FIG. 3 shows the player display of FIG. 1 displaying available blackjack side bets in a player screen area, and an indication of game identity in the dealer area.

FIG. 3 shows an embodiment of a "How to Play" player game information screen design, wherein a player views game information in the player screen 17 by pressing a "help" button 102 in the player control area 20. In this mode, it should be noted that the separation line 26 remains displayed, and the dealer area 27 is displaying a game title/logo 45 in a text and manner readable by the player.

Figure 3A:
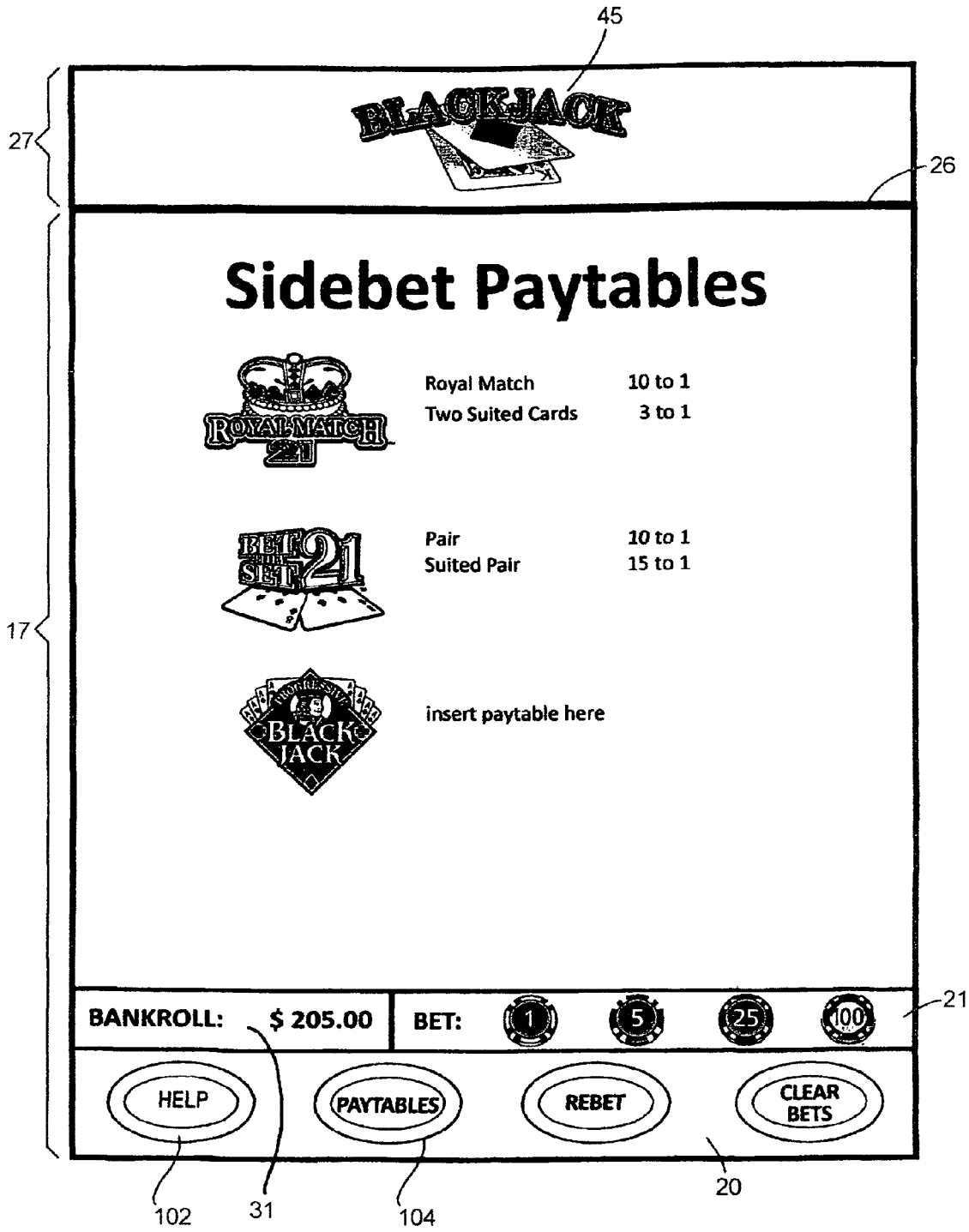
FIG. 3A shows the player display of FIG. 1 displaying pay tables for available blackjack side bets in the player display area.
Figure 4:
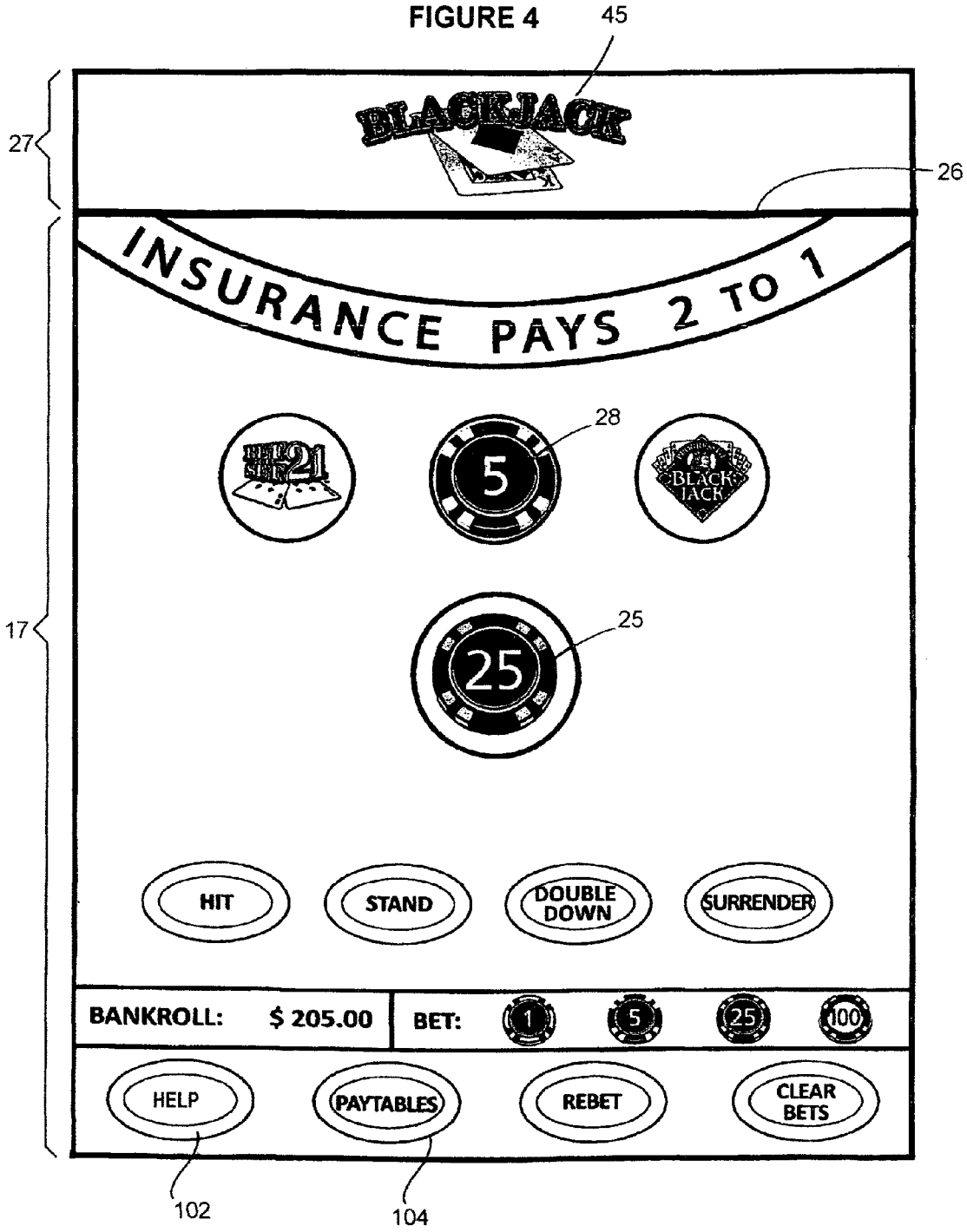
FIG. 4 shows the player display of FIG. 1 in a blackjack game after a player has placed a game wager and a side bet wager, and before the player has executed a card play decision.

FIG. 3A shows a preferred embodiment of"Sidebet Pay Tables" screen format, wherein the game title/logo 45 is displayed in a text and/or manner readable by a player. It is preferable that the dealer area 27 of the player display 10 be capable of displaying information readable by the player as well as readable by the dealer in different stages of use. The side bet pay table information is accessed by a player when the pay table button 104 is touched in the player control area 20 located below bankroll indicator 31 and virtual chip area 21. FIG. 4 shows an embodiment of a split screen after a player has placed initial base game wager 25, and side bet wager 28 and before the cards are dealt. Again, it should be noted that the dealer area 27 displays the game title/logo 45 in a manner readable by the player at this stage of play.

Figure 5:
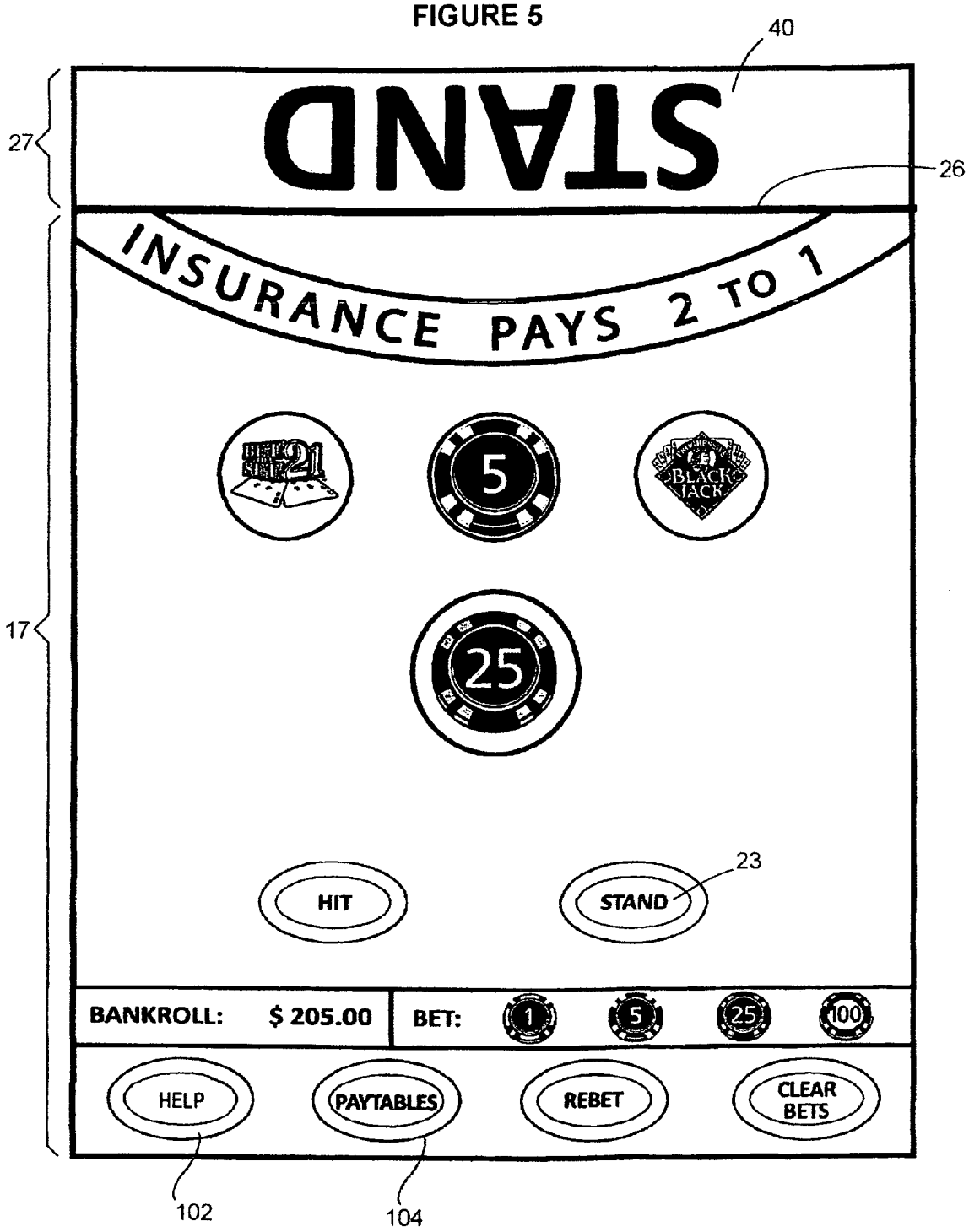
FIG. 5 shows the player display of FIG. 1, wherein an executed player decision to "stand" is displayed in the dealer display area.

FIG. 5 shows an embodiment of the player display 10, wherein a player has input a "STAND" decision by depressing stand button 23 based on dealt card information. It should be noted the separation line 26 continues to separate the player area 17 from the dealer area 27. The dealer area 27 is showing the player decision to stand as instruction 40 in substantially inverted text (upside down for the player) and in a manner easily read by the dealer.

Figure 6:
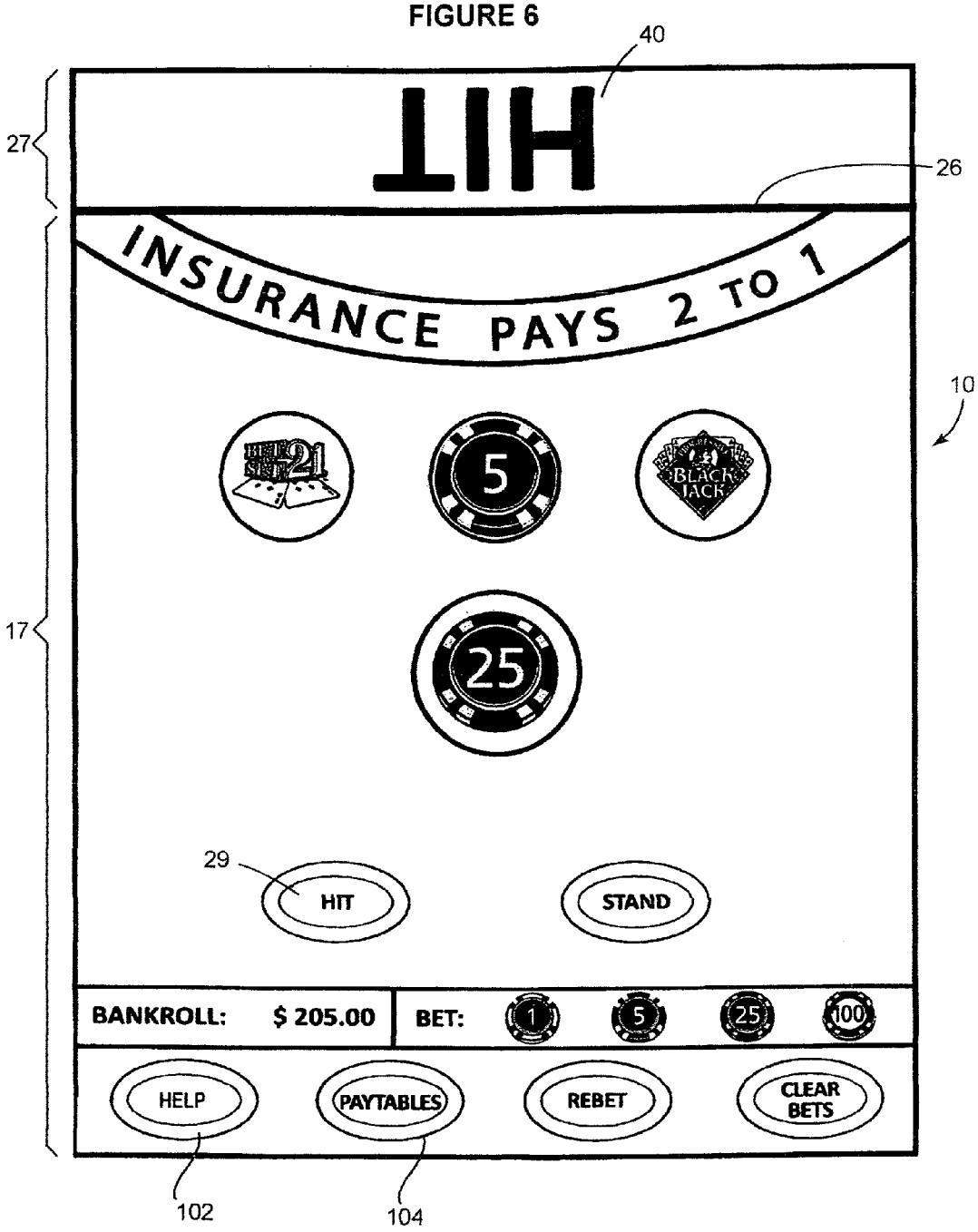
FIG. 6 shows the player display of FIG. 1, wherein an executed player decision to "hit" is displayed in the dealer display area.

FIG. 6 shows another embodiment of the player display 10, wherein a player has inputt a "hit" decision by depressing hit button 29 based on dealt card information. The screen display shows the dealer area 27 is displaying the player "HIT" decision as instruction 40 in text substantially inverted in a manner easily read by the dealer. The displayed information not only indicates the player decision to the processor, but it provides an instruction 40 for the dealer to take appropriate action. In the case of seeing the "HIT" command, the dealer dispenses the next card to the player.

Figure 7:
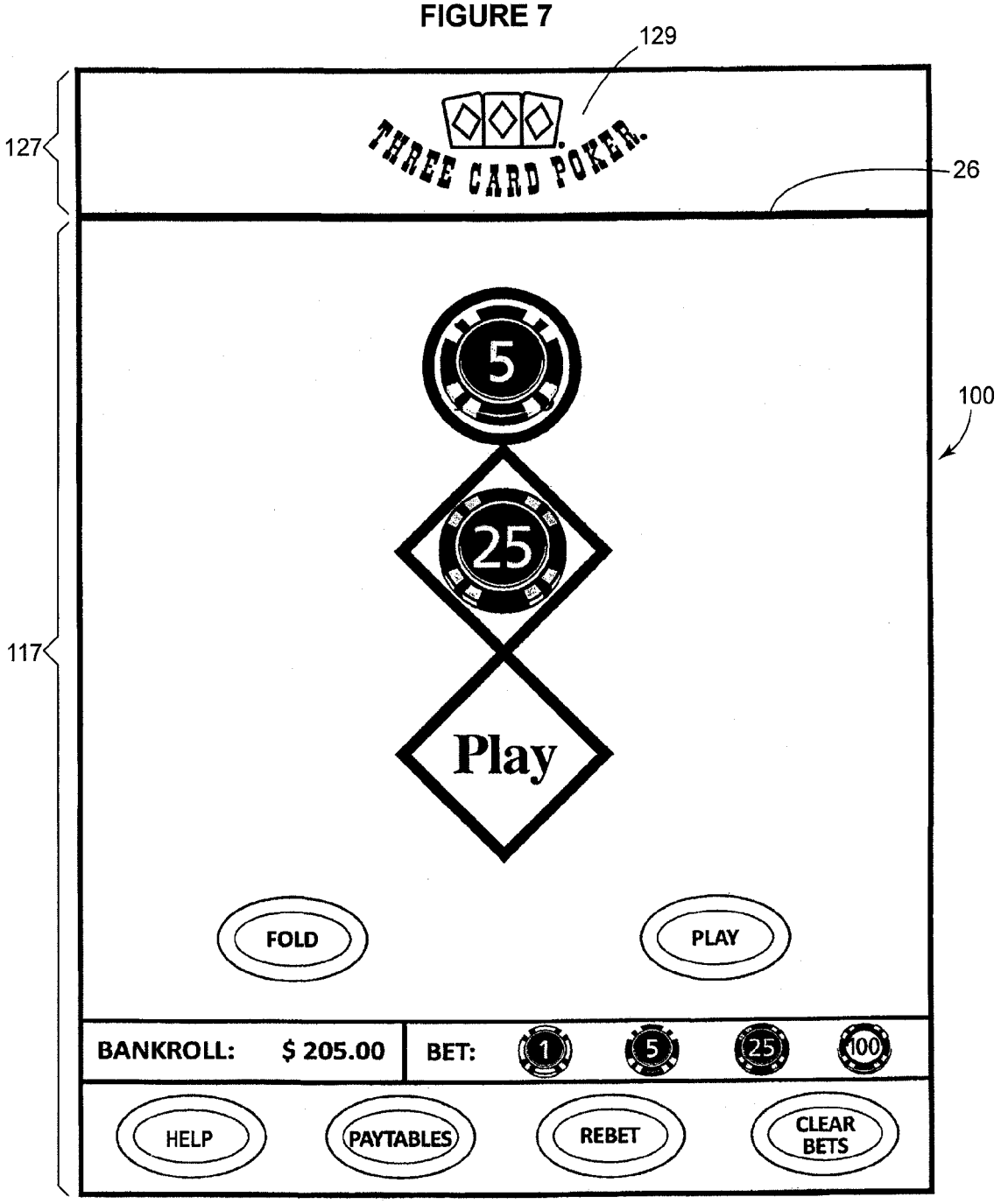
FIG. 7 shows a THREE CARD POKER® game player display, wherein a player's initial wagers prior to the execution of a player card game decision are displayed in a player screen area, and game name and logo are displayed in a dealer area.
Figure 8:
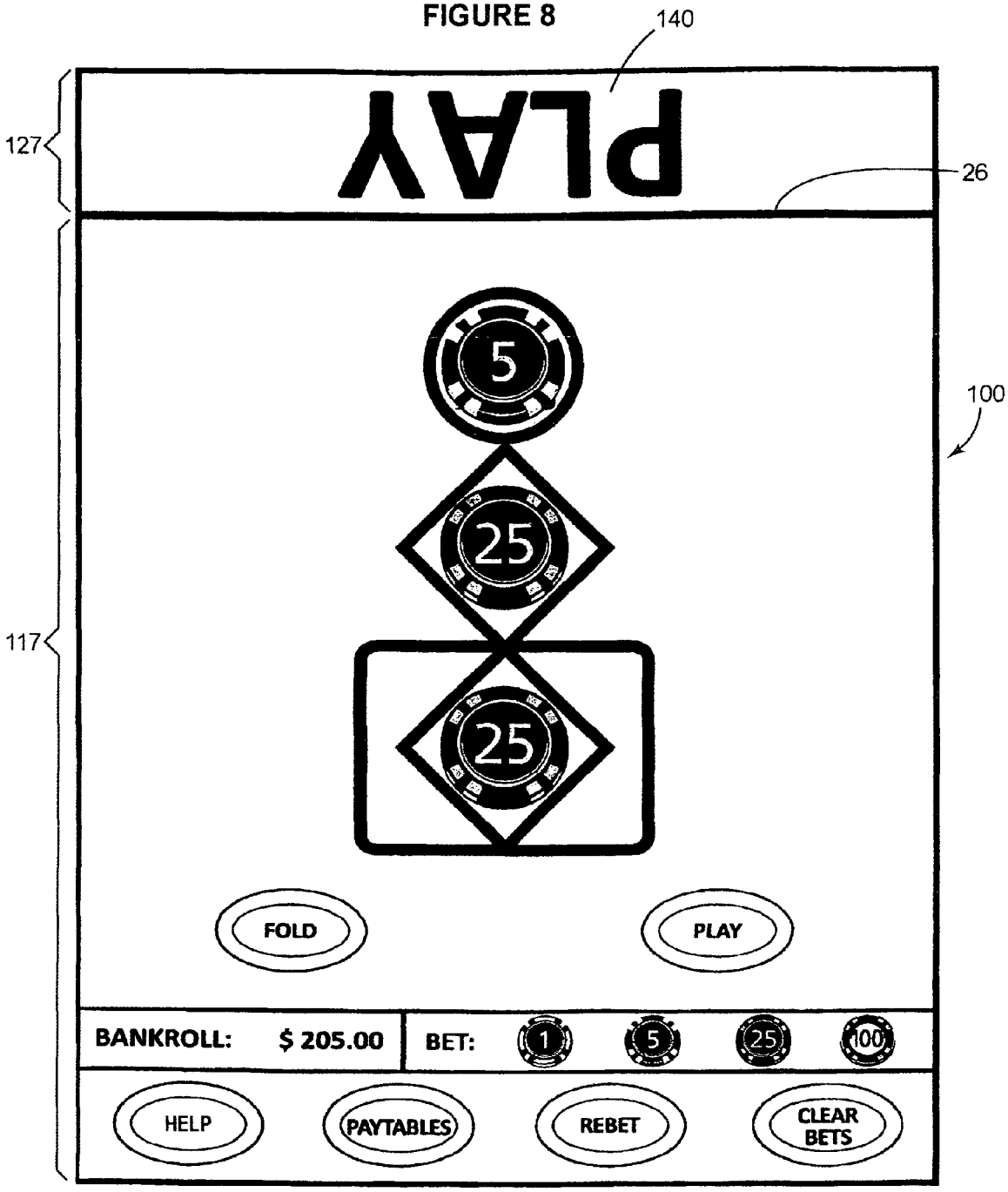
FIG. 8 shows the THREE CARD POKER® game player display of FIG. 7 after a player has executed a card play decision, wherein the card play decision is showing in the dealer area.
Figure 9:
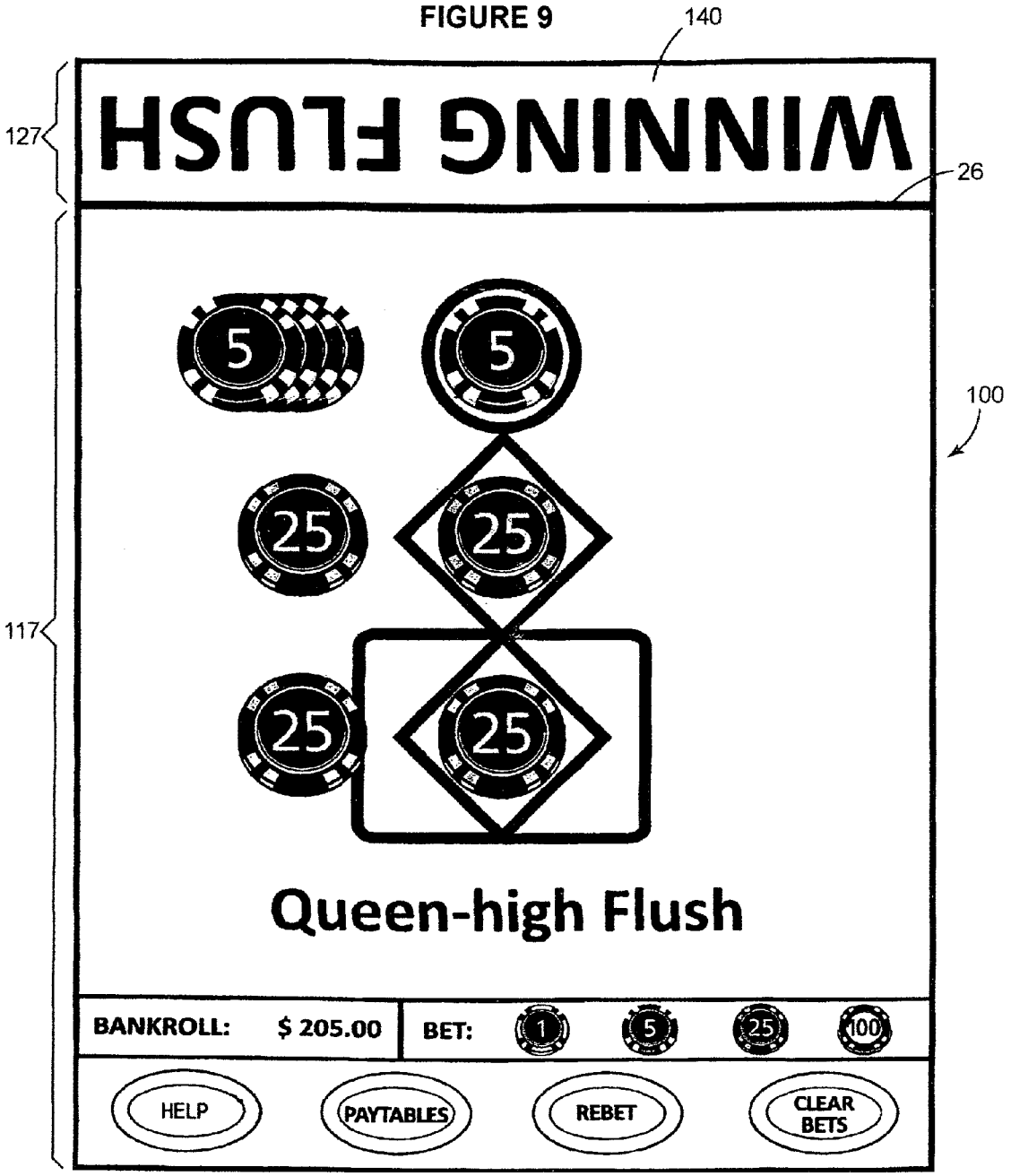
FIG. 9 shows the THREE CARD POKER® game player display of FIG. 7 showing a player's game outcome, wherein the player's game outcome is also showing in the dealer area.
Figure 10:
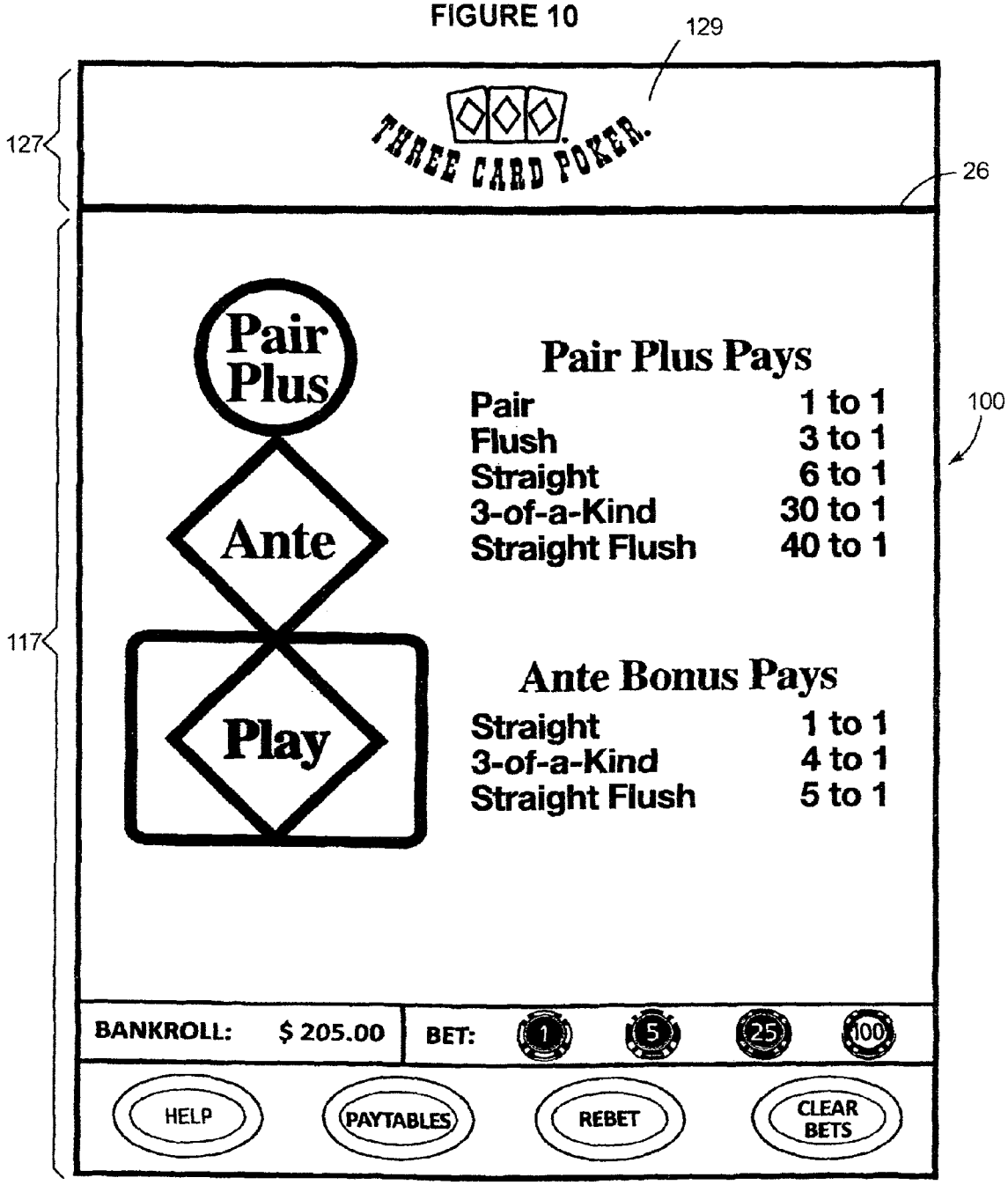
FIG. 10 shows the THREE CARD POKER® game player display of FIG. 7 showing the THREE CARD POKER® "pair plus" and "ante bonus" pay-tables wherein the pay tables are showing in the player screen area, and the game name and logo are displayed in the dealer area.

FIGS. 7, 8, 9, and 10 show exemplary split screen displays for the THREE CARD POKER® game, wherein the game display, game options and betting areas differ according to the rules of THREE CARD POKER® game. A player display 100 includes a player play area 117 as well as a dealer display area 127. As shown in FIGS. 7 and 10, the dealer display area 127 is displaying a game logo 129, arranged to be viewed by the player. As in the previous embodiments, as shown in FIGS. 8 and 9, instruction text 140 in the dealer area 127, when intended to provide the dealer with instructions to facilitate play, is displayed in a manner easily interpreted by the dealer. Prior to a player game decision and/or the start of a game, the dealer display area 127 displays the game logo 129 and/or game name in a manner readable by the player.

The preferred system comprises a gaming table having at least:

a. a player station having a data entry (e.g., touch screen) capability and preferably an independent graphics processor;
b. a central CPU controlled by the dealer or house;
c. a communication link between each player station and the central CPU;
d. a card delivery system (e.g., delivery shoe with card reader, a card shuffler with card reader, or a manual shoe with overhead camera imaging) that provides rank/count/suit-type information on cards delivered; and
e. an optional dealer input, preferably in the form of a dealer display with touch screen controls.

Although it is not necessary to provide touch screen controls at the player or dealer stations, this type of user input is desirable because it can be reconfigured through reprogramming and no hardware components must be changed out to reprogram the system to administer different games.

After all bets are placed, the dealer may touch a "deal" field on the dealer's screen. This prevents all entered bets from being changed, and locks out all new bets. The dealer may then begin to deal (by either removing the first card from the dealing shoe or by pressing a switch on a shuffler for dispensing a hand of cards). In one embodiment, once the first card is dealt, a plurality of new fields appears on each player's touch screen.

Different communication and control relationships can exist between player input systems, game controllers, casino computers, databases, and data storage media within a single casino or multiple casinos. The relationships are known within the Communication-Information Technologies field as master-slave systems, thin client systems, client server systems and blended systems. The blended system is understood to be a system that is not fully master-slave , where a single dominant computer gives orders/commands to a subordinate slave computer or processor, or purely an input system (e.g., buttons only, cash input, and information signals only, without substantive commands being sent, and the like), nor is it a completely or substantially coequal system (peer-to-peer), where data processing and commands may be performed by multiple systems (multiple computers) with defined regions of control and authority. These differing relationships are contemplated by the present invention. In one exemplary form, the graphics functions are managed by the player processor, and all other functions are managed by the game CPU.

Underlying Architecture for Chipless Gaming Tables

FIG. 11 shows an exemplary chipless gaming table 200 system for playing live card games with physical playing cards (e.g., 206*a* and 206*b*) according to technologies enabled and disclosed herein. Chipless gaming table 200 can be of a variety of common constructions or configurations as are typically used as the structural components of gaming tables in the industry. The typical gaming table has a tabletop or playing surface 204 and a perimeter pad or armrest 208 which extends at least about the portion of the table periphery facing players. The relatively straight, back portion of the periphery 210 is used by the dealer (not shown) and can be partly or wholly padded as may vary with the particular table chosen. Seven player display/input systems 212*a*-212*g* are shown. Each of the player input systems 212*a*-212*g* has a processor 214*a*-214*g* (shown in phantom) and a touch screen entry surface 216*a*-216*g*. There may be an optional dealer chip tray 220. There is also a game controller, CPU or casino computer 228 (shown in phantom) whose location at the chipless gaming table 200 system is relatively unimportant, but which must be in direct (hardwired, through wireless or networked) communication with each individual player processor 214*a*-214*g* and a card reading and/or delivery system 222 from which playing cards are supplied, with at least the rank/count (and preferably also suit) of individual cards known as the cards are removed (for example, one-at-a-time) and delivered to player positions and/or the dealer position. The card delivery system 222 is in communication with game controller 228 by wired or wireless communication methods. The individual processors 214*a*-214*g* could also be in communication link with the game controller 228 by wireless or hardwired connections. Communication is not limited to electronic or electrical signals, but may include optical signals, audio signals, magnetic transmission or the like.

The playing surface 204 is provided on the chipless gaming table 200 where participants of the card game(s) play. One or a plurality of players (not shown) sit or stand along the semicircular portion and play a desired card game, such as the popular casino card games of blackjack, baccarat, poker and poker variants. Other card games are alternatively possible, although the system described will be discussed with respect to the play of blackjack.

The chipless gaming table 200 also advantageously includes the betting chip tray 220, which allows the dealer to conveniently store betting chips used by the dealer in cashing players in and out of the game. The chip tray 220 also helps to maintain the appearance of a conventional gaming table. A money drop slot (not shown) is further included to allow the dealer to easily deposit paper money bills thereinto when players purchase credits.

The chipless gaming table 200 can support a system, or form a part of a system, for playing live card games, which is constructed according to the present invention. The card game system 200 described herein in one example of the invention is a retrofit system that has been added to a standard gaming table support frame. Such a retrofit system includes an upright communal table display 330 that displays images that depict game information, such as pay tables, hand counts, win/loss information, historical win/loss information by player, and a wide variety of other information considered useful to the players. The table display 330 is a two-sided display that will be explained more fully below.

The system also preferably includes a dealer console 218, which is preferably provided in the form of a display with touch screen controls positioned within the chip tray 220. In an alternate embodiment, the dealer control resides on the card delivery system 222 or as a separate keypad (not shown). The individual player position processors are preferably graphics processors 214*a*-214*g* and not full content CPUs, as a cost saving, space saving, and efficiency benefit. With the reduced capacity in the processor, as compared to a CPU, there is actually reduced likelihood of tampering and fraudulent input.

The individual components provided for functionality at each position (e.g., the slave, servant, coequal, or master functionality) are not limited to specific manufacturers of formats, but may be used according to general performance requirements. It is not even necessary that identical computing formats (MAC®, PC, LINUX®, etc.) be used throughout the system, as long as there is an appropriate I/O communication link and language/format conversion between components. Further discussion of the nature of the various components, including definitions therefor, will be helpful.

Flash memory (sometimes called "Flash RAM") is a type of constantly powered nonvolatile memory that can be erased and reprogrammed in units of memory called blocks. It is a variation of erasable programmable read-only memory (EPROM) that, unlike Flash memory, is erased and rewritten at the byte level, which is slower than Flash memory updating. Flash memory is often used to hold control code, such as the basic input/output system (BIOS) in a personal computer. When BIOS needs to be changed (rewritten), the Flash memory can be written to in block (rather than byte) sizes, making it easy to update. On the other hand, Flash memory is not useful as random access memory (RAM), because RAM needs to be addressable at the byte (not the block) level. Flash memory gets its name because each microchip is organized so that a section of memory cells are erased in a single action, or "flash." The erasure is caused by Fowler-Nordheim tunneling, in which electrons pierce through a thin dielectric material to remove an electronic charge from a floating gate associated with each memory cell. The Intel Corporation (Santa Clara, Calif.) offers a form of Flash memory that holds two bits (rather than one) in each memory cell, thus doubling the capacity of memory without a corresponding increase in price. Flash memory is a non-volatile computer memory that can be electrically erased and reprogrammed. It is a technology that is primarily used in memory cards and USB Flash drives (thumb drives, handy drives, memory sticks, Flash sticks, jump drives, currency sensors, optical sensors, credit entries, and other signal generators) for general storage and transfer of data between computers and other digital products. It is often considered a specific type of EEPROM (Electrically Erasable Programmable Read-Only Memory) that is erased and programmed in large blocks; in early Flash, the entire chip had to be erased at once. Flash memory has also gained popularity in the game console market, where it is often used instead of EEPROMs or battery-powered SRAM for game save data.

The phrase "non-volatile" means that it does not need power to maintain the information stored in the chip. In addition, Flash memory offers fast read access times (although not as fast as volatile DRAM memory used for main memory in PCs) and better kinetic shock resistance than hard disks. These characteristics explain the popularity of flash memory in portable devices. Another feature of Flash memory is that when packaged in a "memory card," it is enormously durable, being able to withstand intense pressure, extremes of temperature, and immersion in water. Although technically a type of EEPROM, the term "EEPROM" is generally used to refer specifically to non-flash EEPROM, which is erasable in small blocks, typically bytes. Because erase cycles are slow, the large block sizes used in Flash memory erasing give it a significant speed advantage over old-style EEPROM when writing large amounts of data. Non-volatile memory (NVM), or non-volatile storage, is computer memory that can retain the stored information even when not powered. Examples of non-volatile memory include read-only memory (ROMP, Flash memory, most types of magnetic computer storage devices (e.g., hard disks, floppy disk drives, and magnetic tape), and optical disc drives. Non-volatile memory is typically used for the task of secondary storage, or long-term persistent storage. The most widely used form of primary storage today is a volatile form of random access memory (RAM), meaning that when the computer is shut down, anything contained in RAM is lost. Flash memory may also be provided in chips, field-programmable gate arrays (FPGAs), ASICs and Magnetic RAM (MRAM). The latter would allow for computers that could be turned on and off almost instantly, bypassing the slow start-up and shutdown sequence.

The "Chipless Gaming Table" format and architecture described herein comprises generic concepts and specific disclosures of components and subcomponents useful in the practice of the present technology. It should be appreciated at all times that equivalents, alternatives and additional components, functions and processes may be used within the system without deviating from the enabled and claimed technology of this invention.

One preferred construction of a Chipless Gaming Table 200 has from three to eight players (shown in FIG. 11 as seven player positions) with five, six or seven player display positions 212*a*-212*g* (with independent processors 214*a*-214*g*) being preferred, a dealer console 218, a double-sided table display (shown in FIG. 11 as 330, with a front player exposed communal player display 332 and a casino pit-directed pit display 334), a card delivery system 222 (or card reading shuffler or overhead camera imaging system or table-mounted card reader (not shown)), a chip tray 220, playing cards 206, 206*a*, 206*b*, a generic felt 336, and a game controller 228 using the AQUARIUS CONTROLLER™ protocol (unter-the-table game controller manufactured by Progressive Games, Inc. of Las Vegas, Nev.), for example.

The game information (which is preferably for multiple games) is configurable and will be set up during the initial installation of the chipless gaming table 200 and may be switched from game to game on-the-fly at each chipless gaming table 200. It is from this set up that the game information is selected so that the graphics on the Player Touch screens 216*a*-216*g*, Dealer Console 218, Pit Display 334 and Communal Player Display 332 provide the correct information regarding the game in play. It is the capability of changing individual types of game events (e.g., from Blackjack to Baccarat) at a chipless gaming table 200 that enables, or even requires, that the generic felt 336 is free of any permanent printing that identifies only a specific game at a chipless gaming table 200. There may be separate monitors (not shown) that enable display of game names, game rules and pay tables for individual games, or under table back-lighting that may project such information display on the chipless gaming table 200. It is important to note that the dealer display area 127 (shown in FIG. 7) of each player display 212*a* through 212*g* is capable of displaying the game name and logo when the area is not being used to provide game information. By displaying the game name and logo information in dealer display area 127, it is not necessary to print the same information on the generic felt 336.

Using the Pit Display 334, the game is selected by casino personnel and communicated to the game controller 228 via a touch screen control on the pit display 334. The game controller 228 (and/or a central pit controller) sends out the appropriate graphics to each of the player displays 212*a* through 212*g* and table signs to begin game play.

One example for the basic procedure for game play is:

1. A Player buys in with either cash, chips, tickets, electronic access to an account, credit card, marker, or the like.
2. The Dealer adds credits to a player position using the Dealer console.
3. Wagers are made electronically using the touch screen controls at each individual player position. Touch screens may be of any convenient size considering ease of viewability by players, space limitations on the table and ergonomics, and, for example, may be between about 4 inches and 15 inches at each player position (diagonal measurement).
4. All initial wagering (e.g., antes, initial bonus wagers, initial jackpot wagers, initial mandatory wagers) is stopped when the first card or hand is delivered. Delivery may be from the shoe or shuffler. This stopping may be effected by a signal from the shoe or shuffler (to the game processor/table computer) that actual play of a round of the underlying game has been made. Subsequent wagers (such as splitting events, double downs, secondary wagers, play wagers, etc.) may be subsequently made in a controlled manner by the system. Player decisions are input by players using the player input areas and instructions are provided in alphanumeric or graphical form to the dealer on the dealer display area 127 of the player display.
5. The underlying game is played as normal, with physical cards being provided and all wagers and resolutions of wagers being made on the electronic wagering system (Note: The touch screen procedures and graphics for each game usually will be different, and table play for each game will be provided, controlled, enabled and directed by the game processor/table computer).
6. Upon hand or game completion, wager reconciliation is initiated either by the Dealer (e.g., specifically inputting a signal or command by button or dealer area of the player display using touch screen or other input) or automatically by the system (which has determined by card reading events that a round or game has ended) and is reflected as an increase, no change (push) or decrease in the bankroll on the Player's screen.
7. When a Player leaves the table, Credits are removed from the Player position through the Dealer console and the credits are paid out with chips, tickets, cash or credits, which are transferred to a player account from the dealer console 218.

In one embodiment, the table has reporting functionality, such as reports that are specific to the table and recorded by Pit personnel on a regular basis. This data can be accessed on the Pit Display touch screen on a (for example, 15-inch) Pit Display 334. The raw data from the chipless gaming table 200 can be packaged and sent to a central Pit or house computer for analysis (Player ratings, Dealer efficiency, Table handle, etc.).

Dealer Console 218

Examples of properties that would be available in a touch screen of a Dealer Console 218 include:

Buy-in and cash-out of players on the table;

Notifies the Dealer if a Player chooses to Cash out;

Enables and disables Player touch screens;

Move credits if a Player chooses to change seats;

Allows Dealer Log-in/Log-out on the table;

Informs the dealer (initially only is desirable, although the alert may be triggered and waited for until after player's further wagering) if the dealer has a Blackjack (i.e., "no peek" function); and Reconciles the wagers when the hand is complete when the Dealer presses the "Reconcile" button on the touch screen.

The CPU/Game Controller/Table Computer 228

Preferred functions of the game controller 228 are as follows:

Stores Game information;

Manages the Player Terminals;

Controls the one-way or two-way (e.g., 10 inch to 20 inch) Table sign with pay tables, game information, progressive amount, etc.;

Controls the Pit sign with game setup options, table statistics, etc.;

Controls the player Buy-in process through communication with the player input system;

Controls player Cash out process through communication with the player input system;

Records wagers made at start of a game;

Prevents betting after the first card is dealt (except as additional wagers are allowed during play of various games, but then only limited wagers and specific wagers);

Receives card and/or hand information from the shoe, shuffler, overhead camera imaging system or table-mounted card reader;

Evaluates player bets;

Automatically pays the wins and collects losing bets;

Enables specifically identified betting after the hand for the Player terminal has been resolved;

Interfaces to the optional jackpot system; and

Provides touch screen resolution of events and games.

Player Displays 212

The player touch screen (or PTS) is, for example, a 10.5-inch touch screen with an attached processor board. The Player uses the PTS to make wagers and to communicate game actions to the Dealer and to record game play events. The top section of the touch screen (relative to the player) is split and graphics are reversed at certain stages of use for the Dealer to know what action the player is taking, and to receive instructions to take action requested by the player. Certain considerations should be made on the design to include the following:

Placement of the displays in the table should be flush with the surface (or very close) and the touch screen bezel should be minimal. This will minimize card edges snagging and getting stuck when dealt and pulled towards the player. It is actually better to have the screen slightly elevated above the plane of the table top (e.g., the felt cover or other surface), as it is easier to slide cards along a raised edge than to lift the cards out of a depression.

Other desirable features are listed below:

Easy replacement of player terminals when broken;

Graphics must be easy to understand for the patrons;

Help screens should be available and accessible on demand;

The functions of the Player Touch screen include:

Provide the Player with their Bankroll amount;

Allow the Player to wager, increase or decrease a wager;

Allow a Player to repeat the previous wager with a single button press;

Notify the Dealer if the Player would like to cash out;

Record Player actions during the game (for example—Hit, Stand, Double Down, etc.);

Report Player actions to the Dealer via the split screen; and

Touch screen resolution—All alphanumerics should be easily readable by players and dealers at a distance of 3 meters or more.

Table Display 330

Description:

The table display 330 is a two-part system comprising the Communal Player Display 332 and the Pit Display 334. These parts are combined in one embodiment into a double-sided display, vertically mounted above the surface of the table. That is, two screens are placed back-to-back, one facing the pit and one facing the player. The LCD screen (or other display screen) facing the table is used for Player information. It may or may not be a touch screen. The Pit Display, in one example of the invention, is a touch screen that allows for Pit interaction with the table to include game selection and pit reports. In other embodiments, the pit can input information via a keyboard that communicates with the game controller or directly with the pit display 334.

Communal Player Display 332

As an example, a fifteen-inch communal player display 332 is mounted facing the Players on the Table in the manner shown in FIG. 11. This display is used to provide information that normally would have been printed on the felt (Game, table rules, pay tables, game name, casino logo, legal markings, etc.). It also can include information on a Progressive Jackpot, casino advertising, or any information that the Casino may want to provide to a Player.

The Table Display functionality shall include, for example:

Providing Game name and applicable rules;

Display Game Pay Tables;

Provide Progressive Jackpot information;

Identify winning players;

Allow Casino advertising; and/or

LCD (or other display) resolution should be easily readable by players and dealers at a distance of 3 meters or more.

Pit Display 334

Description:

The (for example) 15-inch Pit Display 334, with a touch screen , is mounted facing the Pit. The Pit Display 334 is used to provide information to a Pit Supervisor regarding the table. The touch screen of Pit Display 334 allows for initial set up, game selection and pit reports. Alternatively, data is input through a keyboard in the pit and is displayed on the Pit Display 334. The Pit Display 334 functionality includes, for example:

Initial game set up and game options;

Select games;

Open and Close the table;

Set table minimum and maximum bet limits; and/or

Interface to the optional jackpot system.

Card Delivery System 222

Description:

The shoe/shuffler or card delivery system 222 must be able to provide the function of electronically identifying the cards that are delivered. Examples of suitable card delivery systems are described in U.S. Pat. No. 7,593,544, issued Sep. 22, 2009, entitled "Manual Dealing Shoe with Card Feed Limiter"; U.S. patent application Ser. No. 11/810,864, filed Jun. 6, 2007, now U.S. Pat. No. 8,070,574, issued Dec. 6, 2011, entitled "Apparatus, System, Method, and Computer-Readable Medium for Casino Card Handling with Multiple Hand Recall Feature"; and U.S. Pat. No. 7,374,170, issued May 30, 2008, for "Playing Card Dealing Shoe with Automated Internal Card Feeding and Card Reading." The disclosures of these publications are incorporated herein by reference in their entireties. The card delivery device may read cards internally and then deliver cards one at a time or in sets of cards, with the identity of the individual cards (and all cards in sets), or read cards one-by-one as they are removed from the delivery system and forward that information to the table game controller. With card reading technology on the table combined with the wagers and player actions, the game can be re-created for player analysis and game tracking.

The card delivery system selected in some embodiments has a "chipless" mode in which the unit accepts commands from the Game Controller through an I/O port, such as a USB port or cable entry or pinned connection or, preferably, a wireless network access.

The card delivery system functionality for the Chipless Table may include:

Communicate to the Game Controller when the first hand or card is pulled for the Game Controller to lock out the bets on the Player Touch screens;

Accurately recognize the rank and suit for each card; and/or

Report the card information to the Game controller.

Other systems, such as the overhead card imaging systems described above or table-mounted card readers, are other exemplary sources of card rank and/or suit information.

Gaming Table Requirements

When installing the product, the system preferably provides a tabletop structure with all electronics embedded within a layered tabletop. This layered tabletop can be built in a factory and installed on a preexisting support surface, such as conventional "H" legs or a crescent shaped cabinet. The system preferably includes instructions for mounting the tabletop onto the support structure. There may be instances when the player display is mounted closer to the dealer. In this embodiment, all system components are essentially the same as described above, except for the placement of the player displays on the table. Moving the displays closer to the dealer is desirable when the dealer must input information into the dealer portion of the screen, such as when the dealer sets a Pai Gow Poker hand, or indicates the conclusion of play for a particular player, for example.

The tabletop should be covered with plain felt (no printing indicative of only a single game). Printing may be present identifying the casino, sponsors, events, system supplier and other information that is not specific to a single game or multiple games. This will allow the Operator to change the game in play quickly without changing the table felt.

Allowances should be made for drinks at the table. The components should require a high degree of water resistance against spilled drink penetration around the edges of the monitor. This may be done by sealant and/or tight mounting that does not allow liquid penetration. Grooves receiving the screen and overlapping, tight fitting elements will reduce liquid penetration to enable wiping to prevent rapid significant penetration and damage. It would also be desirable to use player screen/processor units that are liquid tight.

Consideration should be given to how quickly a Player Touch screen can be replaced in the event that one is damaged. The use of modular screens, with modular processors can assist in effecting this benefit.

Optional Multi-Table Pit Computer

Description:

The Pit Computer gathers the data from multiple tables and stores the information in a database for use by the Casino for Player analysis, Table Accounting, etc.

The functionality might include, for example:

Hosting the database for the table; and

Optionally used to host the Jackpot system.

Player/Dealer ID Card Reading System

Description:

The card reader is an add-on that may be used by the dealer, the pit and/or players. Dealers and pit personnel may use cards to authorize play at the table. The card reader can also be used to accept Player tracking cards.

Felt Backlight Display (Optional)

Description:

Backlighting under the felt used to define the areas of the table where cards should be placed by the dealer.

User Interface Graphics

Standards may be summarized at least as follows:

Game-Specific Graphics

The graphics that are specific to a game shall be selected by the game designer.

Dealer Console-Dealer

The general user interface screens for the Dealer console shall include:

Player Buy-in using cash, chips or a marker;

Issue a marker;

Player cash out;

Player seat change;

Game screens;

Game Controller—Pit Display:

Game selection;

Pit reports; and

Table handle.

Player Touch Screen

Player terminal inactive; and

Wagering screen.

Hardware Interface

The hardware interface used in communication linkage of the components may be any architecture used to interconnect two pieces of equipment. It includes the design of the plug and socket, the type, number and purpose of the wires and the electrical signals that are passed across them. USB, FIRE WIRE®, ETHERNET®, parallel and serial ports, as well as COMPACTFLASH™ cards, PCI cards and PC cards are all examples of hardware interfaces (devices connecting to other devices). As noted, wireless communication between elements is generally preferred.

Software Interfaces

Any functional and established software interface may be used, such as selecting those from amongst the ANSI Standard, ISO/IEC Standards, and IEEE Standards. There are well published lists of these standards and include at least:

IEEE Standards

IEEE 694-1994: Microprocessor Assembly Language.

Defines a common assembly language intended to be used for a variety of microprocessor architectures.

IEEE 695-1990: Microprocessor Relocatable Software Formats.

Defines a common format for object files in a small computer environment. The purpose is to enable program construction from modules written in different languages and processed by different compilers.

IEEE 754-1990: Binary Floating-Point Arithmetic.

Defines binary formats and basic operations for floating-point arithmetic. This is commonly referred to as "IEEE floating point" and has become widely adopted in new system implementations.

IEEE 770-1983 (ANSI X3.97): Pascal Computer Programming Language.

Provides a formal specification for Pascal, the first language standardized by IEEE.

IEEE 854-1987: Radix- and Format-Independent Floating-Point Arithmetic.

Specifies alternate floating-point arithmetic formats and operations for implementations which do not necessarily use base 2.

IEEE 855-1990: Microprocessor Operating System Interfaces (MOSI).

Defines a standard OS/program interface (API) for small computers, commonly known as MOSI. Compared to the better known POSIX® (1003), MOSI is less detailed but spans a broader range of target systems. Includes language bindings for FORTRAN, C, Ada, Pascal, and others as appendices. Also, ISO DIS 11685.2.

IEEE 1003.1-1990: POSIX Part 1: System API (Language Independent).

Definition of a standard OS/program interface, commonly known as POSIX®, for UNIX®-like systems. Includes language bindings for C, only, and also ISO 9945-1.

IEEE 1003.1b-1993: Real-Time and Related System API.

Specifies additions to the POSIX® API to support real-time requirements.

IEEE 1003.2-1992: Shell and Utility Application Interface.

Defines functionality for a UNIX®-like shell (command handler) and associated tools.

IEEE 1003.9-1992: Fortran 77 Language Bindings to POSIX®.

Specifies the syntax for accessing the functionality of a POSIX® interface using the FORTRAN language.

IEEE 1224-1993: OSI Abstract Data Manipulation API.

Specifies an API for Abstract Data Manipulation using the OSI (7-layer) Communication Systems model.

IEEE 1224.1: OSI X.400-Based Electronic Messaging API.

Specifies an API for electronic messaging services using the OSI model.

IEEE 1224.2-1993: Information Technology: Directory Services API.

Specifies an API for Directory Services using the OSI model.

IEEE 1275-1994: Boot Firmware.

Defines elements of program functionality to be used in boot (startup) programs in read-only memory.

IEEE 1327-1993: OSI Abstract Data Manipulation C Language Binding.

Specifies a C Language Binding for IEEE 1224.

IEEE 1328.1-1993: Information Technology: X.400-Based Electronic Messaging C Language Binding.

Specifies a C Language Binding for IEEE 1224.1.

IEEE 1328.2-1993: Directory Services C Language Binding.

Specifies a C Language Binding for IEEE 1224.2.

IEEE 1596-1992: Scalable Coherent Interface.

Specifies a physical interconnection scheme for multiprocessors, including aspects which affect their programming. Computer-related (Information Processing) standards sponsored by the American National Standards Institute are developed primarily by the Accredited Standards Committee X3. These standards are designated X3.nnn.

ANSI Standards

ANSI X3.4-1986: 7-bit American National Standard Code for Information Interchange Base definition for the widely used character code known as ASCII.

ANSI X3.9-1978(R1989): Programming Language FORTRAN

Third revision of the first and most venerable programming language standard.

The 1978 version, called FORTRAN-77, is widely implemented. The 1989 version, called FORTRAN-90, is not yet as popular.

ANSI X3.23-1985: Programming Language COBOL

The widely used business-oriented language.

ANSI X3.23a-1989: Programming Languages—Intrinsic Function Module for COBOL.

Extensions to the COBOL standard.

ANSI X3.28-1976(R1986): Procedures for the Use of the Communications Control Characters of American National Standards Code for Information Interchange in Specified Data Communication Links.

Provides interpretations for the ASCII communication control characters.

ANSI X3.30-1985(R1991): Representation for Calendar Date and Ordinal Date for Information Interchange.

Specifies how date information should be represented for data exchange.

ANSI X3.41-1990: Code Extension Techniques for Use with the 7-byte Coded Character Set of ASCII.

Specifies how the ASCII code may be extended.

ANSI X3.43-1986: Representations of Local Time of Day for Information Interchange Specifies how time information should be represented for information interchange.

ANSI X3.51-1986: Representations of Universal Time, Local Time Differentials, and United States Time Zone References for Information Interchange.

Specifies additional time-related information representations.

ANSI X3.53-1976(R1987): Programming Language PL/I.

Specification for the PL/I language, used primarily on IBM systems.

ANSI X3.64-1979(R1990): Additional Controls for Use with the American National Standard Code for Information Interchange.

Specifies a large collection of ASCII extensions to control display and printer functionality. In practice, a small set of screen editing and cursor positioning codes have been widely adapted; these are supported by so-called ANSI terminals.

ANSI X3.74-1987: Programming Language PL/I, General Purpose Subset.

A stripped-down version of the big language.

ANSI X3.113-1987: Programming Language Full BASIC.

Specification for the BASIC programming language, which has existed in a vast range of different versions.

ANSI X3.113a-1989: Modules and Individual Character Input for Full Basic.

Some extensions to X3.113.

ANSI X3.124-1985: Graphical Kernel System (GKS) Functional Description.

Specifications for a hardware-independent method for specifying graphic elements.

ANSI X3.124.1-1985: Graphical Kernel System (GKS) FORTRAN Binding

How to use GKS with the FORTRAN language.

ANSI X3.124.2-1988: Graphical Kernel System (GKS) Pascal Binding.

How to use GKS with the Pascal language.

ANSI X3.124.3-1989: Graphical Kernel System (GKS) Ada Binding.

How to use GKS with the Ada language.

ANSI X3.159-1989: Programming Language C.

Formal Specifications for the C Language (ANSI C).

ISO/IEC Standards

These are information processing standards under the sponsorship of the International Organization for Standardization (ISO) and have generally been developed by the Technical Committee TC97. Standards related to microprocessors under the sponsorship of IEC have been developed by the Technical subcommittee SC47B. Since about 1990 information processing standards for both organizations have been managed by the joint technical committee JTC1.

ISO 646-1983: ISO 7-bit coded character set for information interchange

ISO version of the ASCII character set with minor differences.

ISO 1538-1984: Programming Language ALGOL 60.

One language that was never standardized in the U.S.

ISO 2022-1982: ISO 7-bit and 8-bit coded character sets—Code extension techniques.

Techniques for extending the codes of ISO 646 and ISO 4873.

ISO 4873-1979: 8-bit coded character set for information interchange.

An extended version of ISO 646 which encodes 8 bits to provide an additional 128 codes.

ISO 6429-1983: ISO 7-bit and 8-bit coded character sets—additional control functions for character-imaging devices.

Extended display and printer controls for ISO 646 and ISO 4873.

ISO 7498-1984: Open Systems Interconnection—Basic Reference Model.

Communication Interfaces

As noted earlier, the communication interfaces may be client-server, master-slave, peer-to-peer and blended systems, with different relationships among the various processors and CPUs as designed into the system.

Any allowable standards (jurisdictionally, by state, county and/or Federal laws and regulations) may be used as the communication standards, with FTP or HTTP standards being the most common and acceptable, but not exclusive, formats used. Each of the computers and processors used may include a display and a number of input buttons, or touch screen functions, and combinations of these, with wired or wireless communication links to enable the player to initiate actions or make responses as required during the game. In a game where the player is playing against the house, the player's hand is displayed face up on the screen as it is dealt and the house hand may be shown face down on the screen. Touch "buttons" can be provided on the screen in addition to or instead of physical buttons. In a further non-limiting configuration, one or more of the players can be located in separate locations, and the player terminals or hand-held devices or player screens in the separate locations can be connected to the controller via communication links (e.g., hardwired or wireless). Standard protocols, software, hardware and processor languages may be used in these communication links, without any known limitation. There are hundreds of available computer languages that may be used, among the more common being Ada, ALGOL, APL, Awk, BASIC, C, C++, COBOL, DELPHI®, EIFFEL®, Euphoria, Forth, Fortran, HTML, Icon, JAVA®, JAVASCRIPT®, Lisp, Logo, MATHEMATICA®, MATLAB®, Miranda, Modula-2, Oberon, Pascal, PERL®, PL/I, Prolog, PYTHON®, REXX, SAS, Scheme, sed, Simula, Smalltalk, SNOBOL, SQL, VISUAL BASIC®, VISUAL C++®, and XML.

Any commercial processor may be used, either as a single processor, serial or parallel set of processors in the system. Examples of commercial processors include, but are not limited to, MERCED™, PENTIUM®, PENTIUM II XEON™, CELERON®, PENTIUM PRO™, EFFICEON®, ATHLON®, AMD ®, and the like.

Display screens may be segment display screens, analog display screens, digital display screens, CRTs, LED screens, Plasma screens, liquid crystal display screens, and the like.

The initial expectation is that the Chipless Table will be considered a Table Game and regulated as such. All of the hardware and software must therefore comply with the regulatory requirements for a Table Game. The table with all of the components must comply with UL® and CUL requirements. Compiled computer code, when available for display, has a statement on the first page that "the code is confidential and is the proprietary property of Shuffle Master, Inc." per NRS 603.010 et seq. and NRS 600A et. seq.

a. Creative organization and sequencing should be unnecessary to the lock and key function.

b. Arbitrary programming instructions may be used and they may be arranged in a unique sequence to create a purely arbitrary data stream to create a level of security in the system.

c. All computer code on the system should be ciphered.

Terminology for on screen display items may include at least some or all of:

Player Balance
Amount Bet
Win Amount
Recall previous bets
Cash out
Clear all bets
Bankroll
Wager—value only near chips
Value only near chips
Re-bet Special requirements that may be on the card delivery systems (or other delivery system) include:

Report button presses to game controller.
Use lamps and LCD display for results (Dealer information).

Special requirements that may be on the I-DEAL® shuffler system (or other shuffler system):

Accepting configuration from the game controller.
Report button presses to game controller.

The game controller in one embodiment is programmed with a rule that a game cannot commence until at least one player has a non zero balance and preferably that no games are allowed to be played when no bets have been placed. The system is configurable to account for varying independent casino rules and various gaming regulations. Embodiments of the system include error recovery procedures. Specifications of popular side bets are incorporated into the coding to allow implementation. Multi-game functionality is provided. Embodiments of the proposed system allow for progressive jackpots.

Exemplary player displays are 15 inch 1024×768 pixels or dots. The touch screen overlay in one example is preferably about 15-inch 1024×768 pixels or dots. The size and resolution of a preferred dealer display and touch screen is 6.5 inches and from 512 to 1024 pixels per line (or higher definition). The screen resolution is a matter of cost and image quality resolution.

Figure 13:
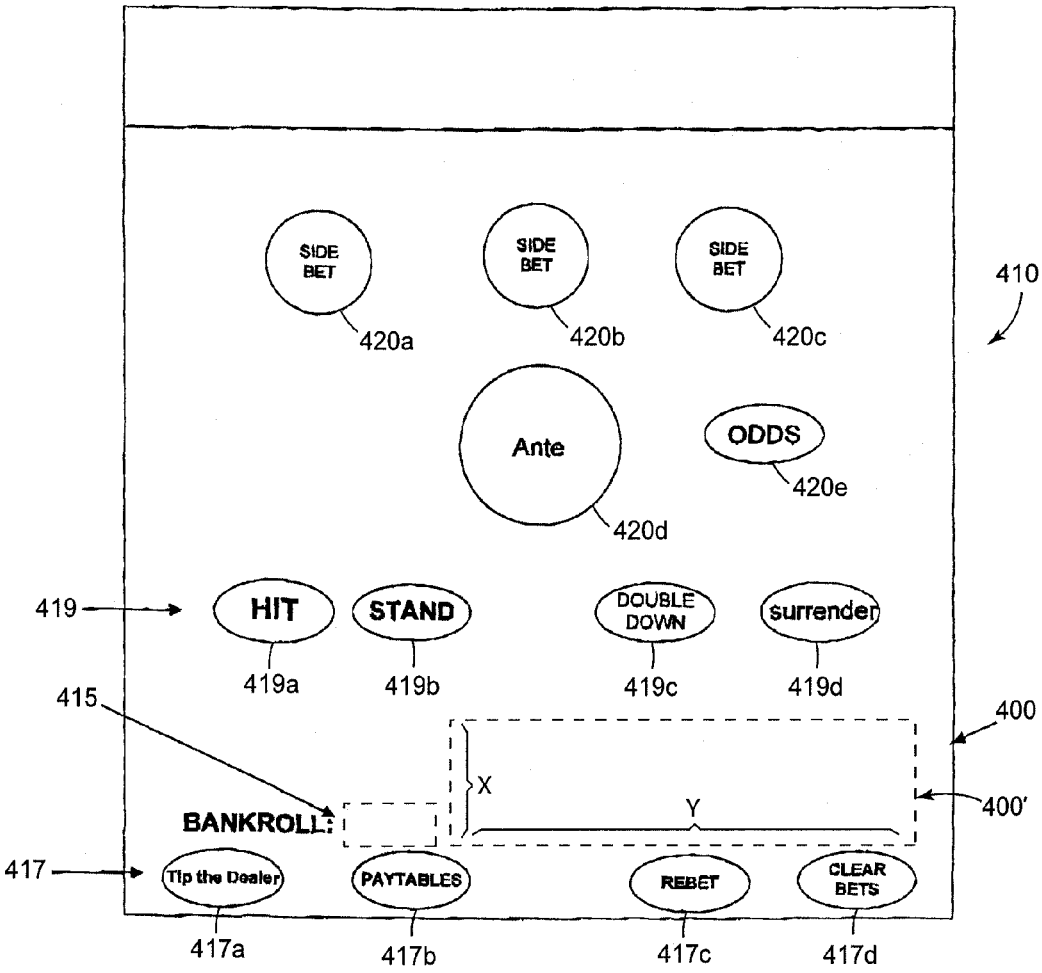
FIG. 13 shows a touch screen layout for player controls and inputs, without stacks of chips or chip value locations being specifically shown.

FIG. 13 depicts an example of an enabled touch screen interface 410 with associated chip tray field 400' prior to a buy-in and the allocation of relative credits in a bankroll field 415. In the preferred embodiment, it is important to note the chip tray field 400' is depicted without a physical/visible line of separation from other relative fields on the screen such as, but not limited to, a player decision field 419 including options **419*a*-419*d* and a player control field 417. However, the chip tray field 400' has predetermined non-visible dimensions that limit players from stacking chips outside of the predetermined field, and, therefore, interfering with other relative fields on the screen. In other words, players cannot stack one hundred $1 chips past the predetermined dimensions X, Y of the chip tray field 400' and into other function fields. The one hundred chips in the $1 virtual chip stack are available for play, but the $1 virtual chip stack does not exceed a predetermined height and/or number of chips within the chip tray field 400'**.

When a chip stack exceeds a predetermined height and/or number of chips within a value chip stack, the chips default to the next highest and/or lowest value chip stack, depending on the credit amount displayed in the bankroll field 415, wherein the chip stacks automatically balance relative to said credit. In other embodiments, the value of the displayed chips may be less than the bankroll amount and the player decides what portion of the bankroll is shown as chips. If the system exceeds a limit for displayable chips, higher value chips will automatically be displayed or an overage amount will be transferred to the BANKROLL field 415 and special highlighting can be provided to show that the overage (above the amount displayed) is present in the BANKROLL field 415.

An alternative miscellaneous chip stack (not shown) may be provided for odd chip amounts and/or chip amounts exceeding the available chip value field limits. For example, the system can be configured to color-up chips to the highest available chip value field. Chips that exceed the available space in the default chip value fields will be stacked in a miscellaneous/mixed stack in colors relative to their value but not relative to a value field, wherein a $500 chip, a $100 chip, and a $50 chip might appear in the one miscellaneous/mixed chip value field as a credit overflow.

Odd credit valued without a relative chip value is not necessarily depicted in the chip value fields. However, the odd credit values are displayed as available credit in the bankroll field 415. For example, an odd credit value may be of a lower value than the lowest available chip value field, such as 0.50¢, etc.

An alternative embodiment of a buy-in default chip display includes a base default chip value, wherein a buy-in is displayed in the default chip value field first. However, if the default chip value field is filled to a maximum level, the system automatically defaults to the second highest and/or lowest chip value field (depending on the amount of the buy-in), wherein, as the second highest and/or lowest chip value field is filled to a maximum level, the system defaults to the third highest and/or lowest chip value field, etc., until the chip value fields are filled and/or reflect the bankroll field 415 amount relative a player's buy-in. Overflow bankroll field 415 amounts are displayed in the mixed chip value field as required, and odd credit values are displayed in the bankroll field 415. It should be noted that base default chip settings are left to the discretion of the casino customer, and may vary according to game type, casino customer preference, and/or table limits.

Another embodiment of the virtual chip fields discloses a "halo," such as, but not limited to, an ellipse displayed at and/or around the perimeter surface and/or perimeter of the lower surface of a base default chip value stack and/or field. The "halo" feature highlights the base default chip value stack currently enabled by the system.

Yet another embodiment discloses a "shadow" in a disabled chip value field prior to a chip fill, a buy-in, coloring up and/or down, etc., with the relative value of the chip value field displayed within the "shadow," wherein the shadow is a predetermined shape such as, but not limited to, an ellipse, box, and/or circle. The "shadow" feature provides players with value chip information relative to each available chip value field prior to a chip fill.

Another embodiment discloses a player's option to change a base default chip value to a preferred base default chip value after a first buy-in is displayed in the initial default chip setting. It is preferred the player only "color-up" or exchange chips to a higher chip value field, when changing the base default chip value. Once a player colors-up a default chip value to a higher base chip value field, it is preferred the "halo" will appear on said higher base chip value field. The feature allows players to play with preferred higher value chips as a base chip value throughout their gaming experience. Therefore, any subsequent buy-ins will appear in the player's "new" highlighted base chip value rather than the default base chip value as long as the player's base chip value is a higher value than the default base chip value. This provides each player with a customizing feature that allows them to wager with preferred denominations.

A player is allowed to default down to the programmed chip default value if desired. For example, if the programmed default chip value is $5 and a player decides to default up to a higher default chip value, such as $25, the player is allowed to default back down to the programmed default value of $5 at any time during play.

Another embodiment would provide the chip fields devoid of chip value information prior to buy-ins and enablement and the chip value would automatically be selected based on an initial amount of credit, or could be selected by either player input or dealer input. An alternative embodiment is a virtual chip tray field with visible chip tray field borders (not shown).

Figure 14:
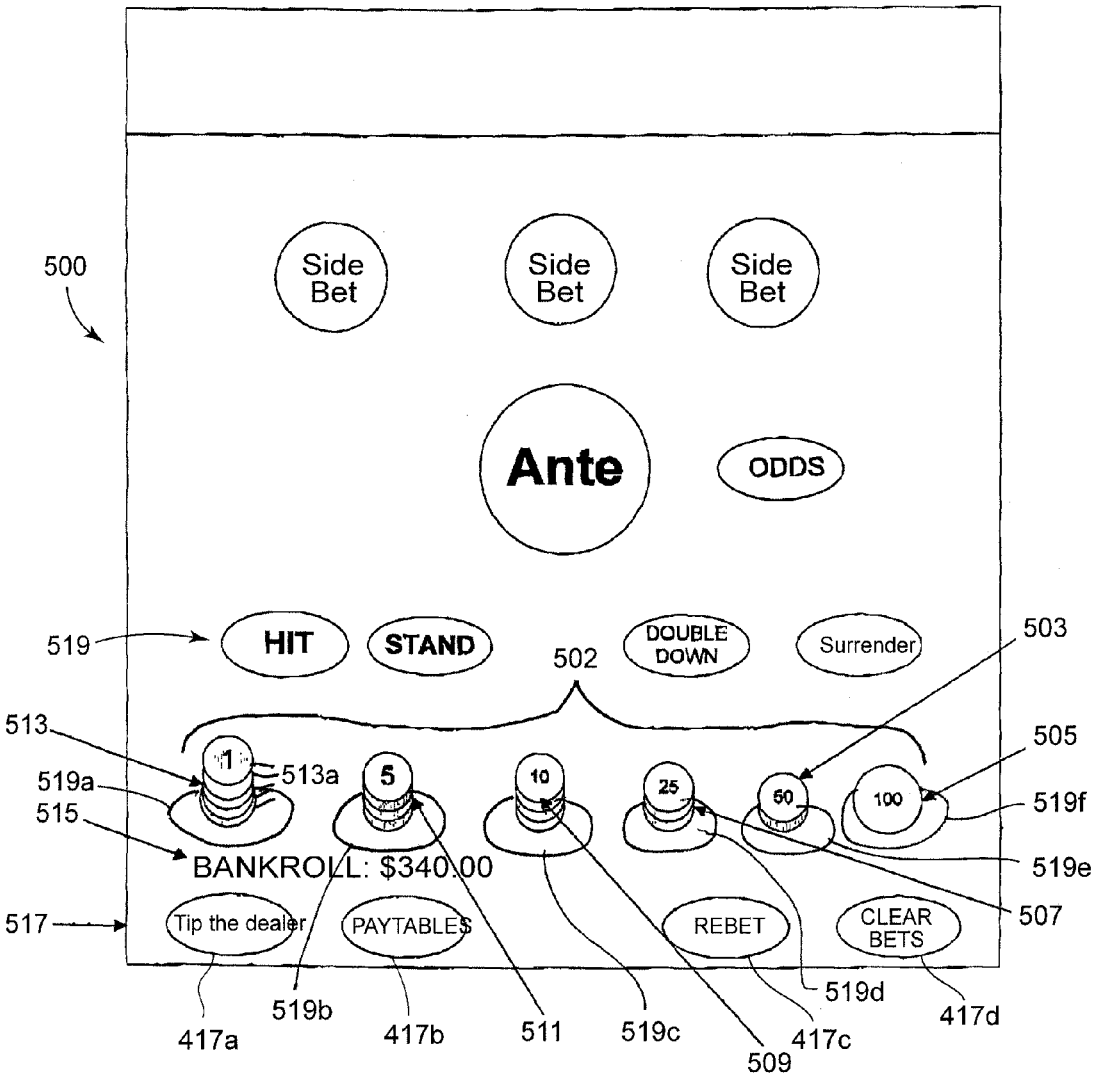
FIG. 14 shows the touch screen layout for player controls and inputs of FIG. 13, with individual stacks of chips or chip value locations being specifically shown on the touch screen layout.

FIG. 14 depicts an example of an enabled touch screen interface 500. The enabled touch screen interface 500 has the associated buy-in credits showing in a bankroll field 515 along with a plurality of value chip fields 503, 505, 507, 509, 511 and 513 showing in a chip tray field 502. It should be noted that this active touch screen is showing all value chip fields as enabled for the purposes of example.

Figure 15:
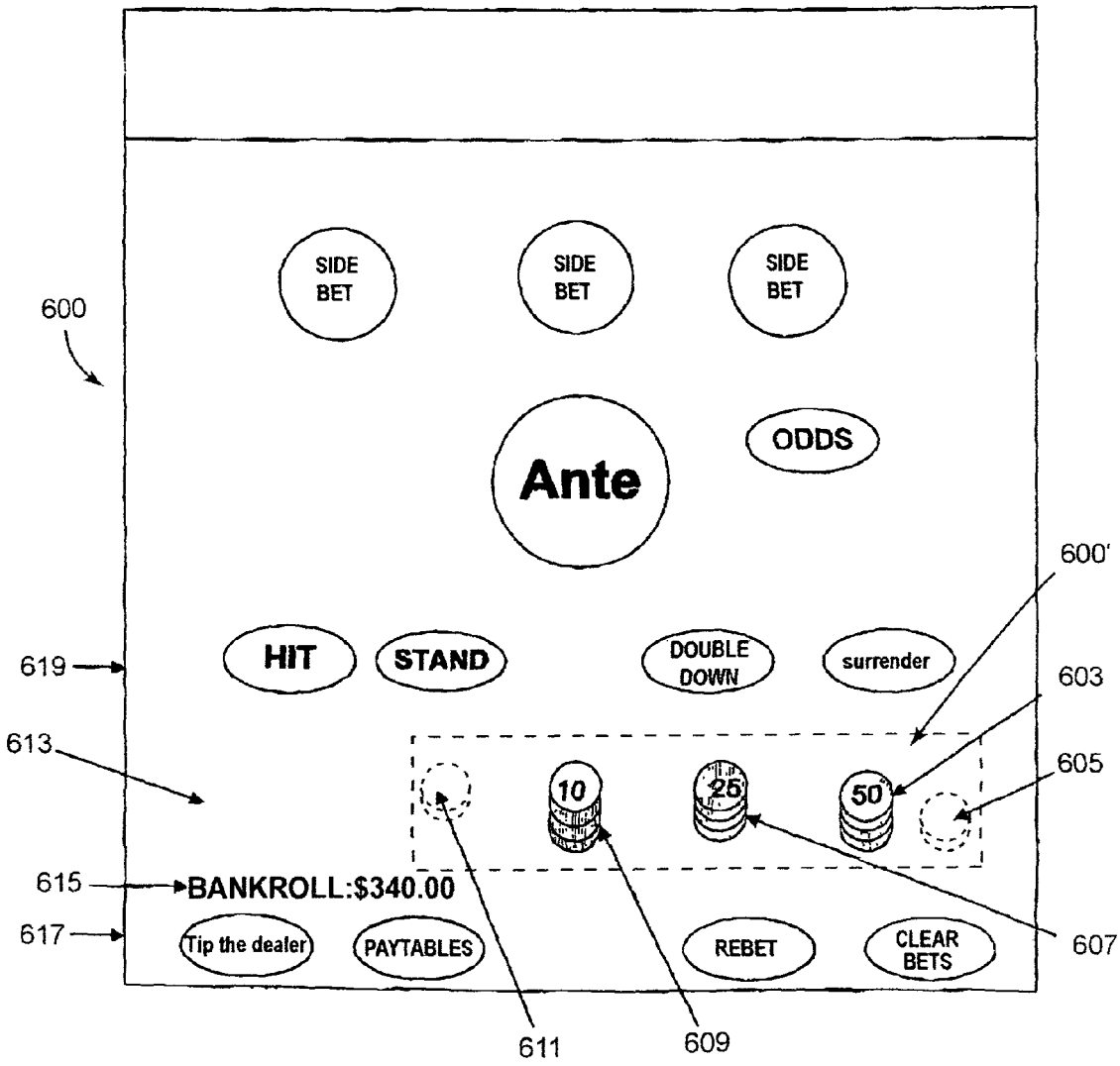
FIG. 15 shows the touch screen layout for player controls and inputs of FIG. 13, with individual stacks of chips and less than all available chip value locations being specifically shown on the touch screen layout.

FIG. 15 depicts an example of an enabled touch screen interface 600, wherein only three value chip fields 603, 607 and 609 of six available chip field segments are enabled. It is preferred the chip field segments are enabled when a player relocates at least one virtual chip into an alternate value chip field of equal, greater, and/or lesser value. Preferably, players use hand motions such as tapping and/or dragging a virtual chip left and/or right into a preferred value chip field. Please note the virtual chip denominations and default chip values may vary and are relative to table limits and/or the type of game currently implemented, player preferences and even dealer/house control. The virtual chip denominations and/or default chip values featured in this document are for the purpose of example only.

A chip tray field 600' of a buy-in screen initially exhibits a bankroll field 615 credit amount ($340.00) in a selected group of high-value default chip field segments, wherein the highest value default chip fields in the present example are a first default value of $50, a second default value of $25 and a third default value of $10. For the purpose of example, a first buy-in of $340.00 shows four chips in the $50 chip value field segment 603, four chips in the $25 chip value field segment 607 and four $10 chips in chip field segment 609. A preferred alternative example of a buy-in screen (not shown) might show three chips in a $100 chip value field 605, one chip in the $25 chip value field 607, one chip in the $10 chip value field 609, and one chip in a $5 chip value field 611. The preferred embodiment and the preferred alternative embodiment provide a player with discernible default chip information relative to a first buy-in and/or an additional buy-in(s) that is simple to evaluate, and therefore less confusing for the player. A more detailed description of a buy-in default chip process is explained later in more detail.

Once the player's buy-in is allocated to the player's touch screen interface 600, the buy-ins show in the bankroll field 615 as well as in the preferred value chip field segments 603, 605, 607, 609, and 611. Subsequently, the player is able to manipulate the value chips into a desired denomination, plurality of said denominations, and/or combinations thereof, relative to said player's available credit.

An additional alternative embodiment of buy-in chip fields is depicted in FIG. 14. Preferably, the touch screen interfaces 500 and 600 depict enabled fields and relative field data in color pixels. Therefore, virtual chips are depicted in colors specific to each chip stack's denomination. However, color preferences do vary and are relative to a casino's chip color preferences. Therefore, value chips do have a color relative to denomination, but the color of choice is discretionary.

The Embodiment of Chip Value Exchanges

Figure 15A:
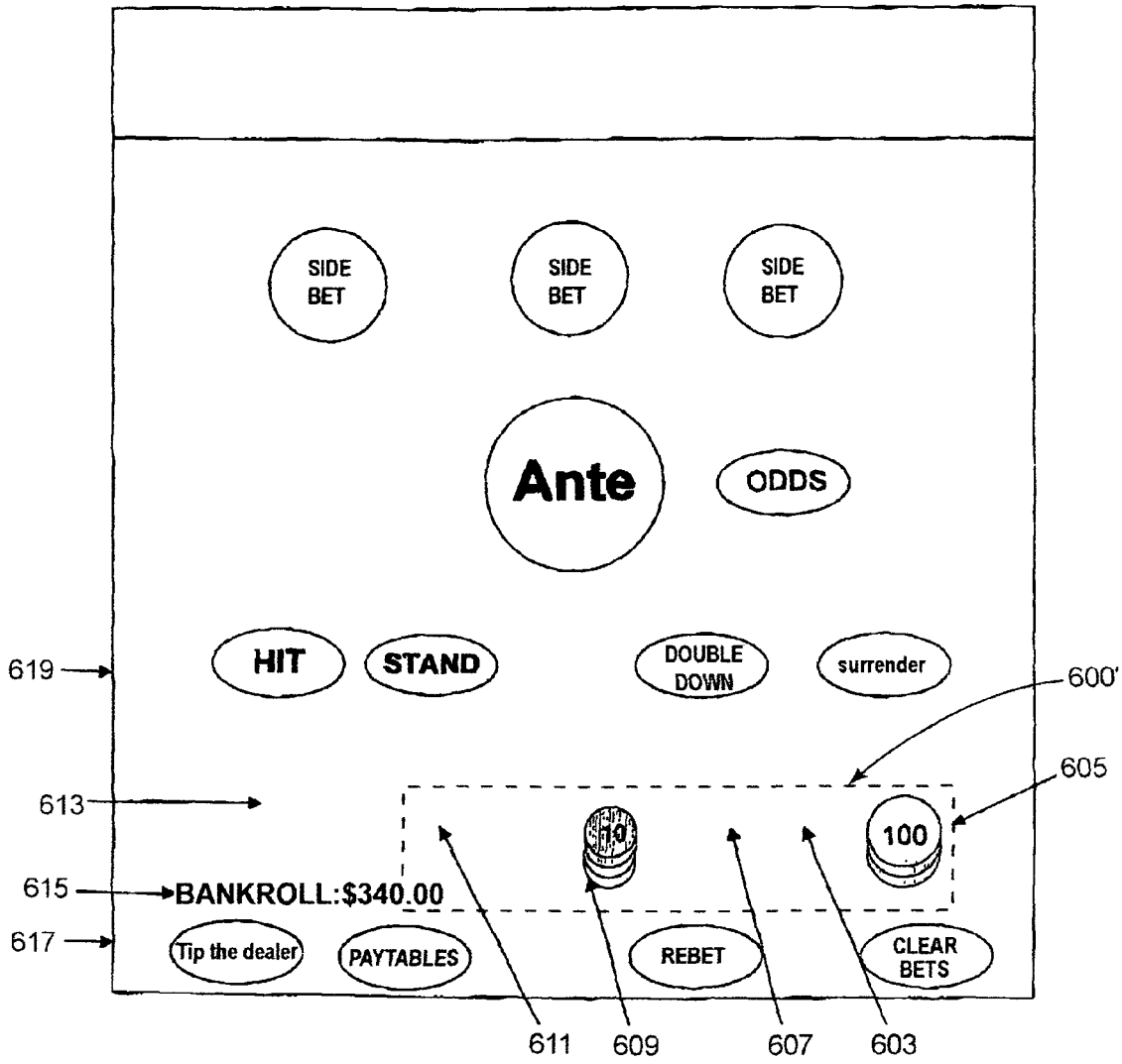
FIG. 15A shows the touch screen layout for player controls and inputs of FIG. 13, with individual stacks of chips and less than all available chip value locations being specifically shown on the touch screen layout.

Referring to FIG. 15A, the bankroll field 615 exhibits $340.00 in credit. The chip tray field 600' is exhibiting $300 in the $100 chip value field segment 605 and $40 in the $10 chip value field 609. It should be noted that the remaining available chip fields 603, 607, 611 and 613 are not necessarily enabled in the figure. A player enables chip fields by using hand motions such as, but not limited to, tapping and/or dragging a chip value left and/or right of an enabled chip field.

The Process of Value Chip Conversion/Swapping

Referring to FIG. 15A, the chip tray field 600' is presently showing three $100 virtual chips in the $100 chip field segment 605 and four $10 virtual chips in the $10 chip field segment 609. The total value of the virtual chips is equal to $340 and the amount of player credit is shown in the bankroll field 615.

1) A player enabled the $100 chip field segment 605 by tapping and exchanged for $50 chips by tapping and/or dragging a one $100 value chip left into the $50 chip value field 603. The enabled $100 virtual chip is automatically converted into two $50 virtual chips, wherein the two $50 virtual chips subsequently appear in the enabled $50 chip field 603 (not shown) and one fewer $100 chip is displayed in $100 chip field segment 605. Two $50 virtual chips in the $50 chip field segment 603, and four $10 virtual chips are displayed in the $10 chip field segment 609.
2) The player taps and/or drags a second $100 virtual chip into the $50 value chip field segment 603, wherein the process of conversion is repeated. The chip tray field 600' now has one $100 virtual chip in the $100 chip field segment 605, four $50 virtual chips in the $50 chip field segment 603, and four $10 virtual chips in the $10 chip field segment 609.
3) The player taps and/or drags the third remaining $100 virtual chip into a $25 value chip field segment 607. The $25 chip field segment 607 is enabled and the last $100 virtual chip is subsequently converted into four $25 virtual chips.

FIG. 15 shows the final chip field configuration for the present conversion, wherein the chip tray field 600' is presently showing four virtual $50 chips in the $50 chip field segment 603, four $25 virtual chips in the $25 chip field 607, and four $10 virtual chips in the $10 chip field 609. The remaining chip fields 605 and 611 remain dormant until enabled.

A plurality of lesser first chip values is converted into a higher second chip value(s) in a substantially identical process, with one exception. The sum of the lesser first chip values contained within the first chip value field must be equal to and/or greater than the higher second chip value(s) contained within the second chip value field. If the sum of the plurality of the first chip values is less than the desired second chip value field, the system aborts the exchange attempt and the plurality of lower first value chips remain within their present first chip value field. In other words, a player is unable to convert two $1 chips into one $100 chip.

The total in the bankroll field 615 remains constant during the conversion activity unless the player places a wager with a virtual value chip, or requests an additional buy-in during the progress of a game, wherein the data displayed in the bankroll field 615 and the chip tray field 600' automatically adjusts to reflect bankroll field 615 credit updates on the system.

FIG. 14 displays an alternative chip conversion activity, wherein all value chip fields 503, 505, 507, 509, 511, and 513 are presently enabled. Players may participate in the chip conversion activity as desired. The number of chip stack configurations is relatively limitless and is left to the discretion of the player. Value chips are converted from lower chip values to higher chip values, and visa versa, with no present restrictions.

Figure 15B:
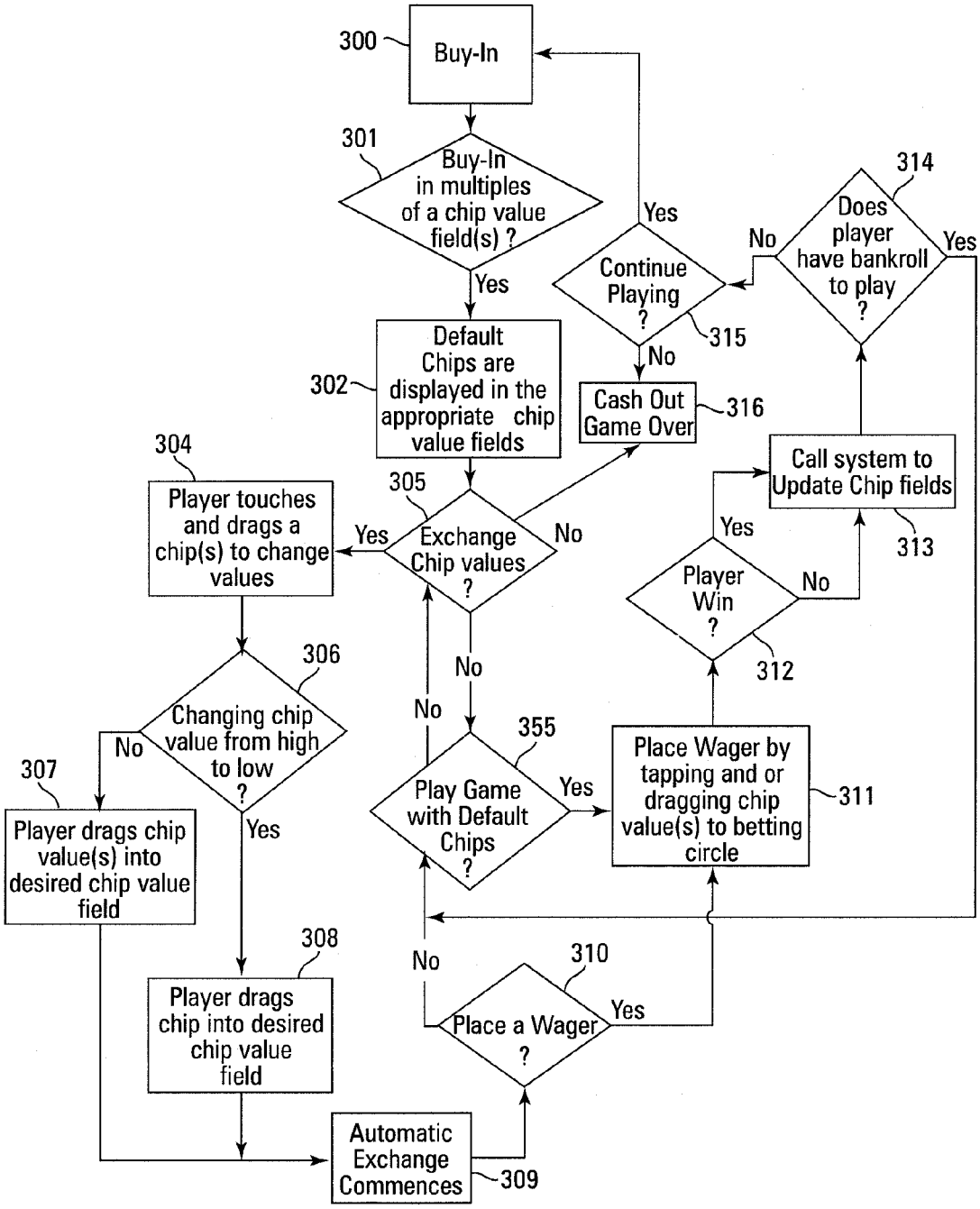
FIG. 15B shows a flow diagram for an exemplary multi-step, multiple option play of the system and process of the technology described herein.

FIG. 15B shows a flow diagram for an exemplary multi-step, multiple option play of the system and process of the technology described herein. A flow diagram of the process action steps is depicted in the figure.

1) The first action is a player buy-in 300.
2) The next action is a system analysis of chip field multiples 301 relative to the buy-in amount.
3) The system updates the chip fields and the default chips are displayed in the appropriate chip value fields 302.
4) The system awaits a player decision to Exchange or not to exchange chip values 305.
5) If the answer is yes, the player touches and drags a chip(s) to another chip field segment to exchange virtual chips 304. If the answer is no, the player cashes out 316 or plays 355.
6) Are chips exchanged from high to low 306?
   a. If the answer is yes, the player drags chip(s) into the desired chip value field 308 and automatic exchange commences 309.
   b. If the answer is no, the player drags chip(s) into the desired chip value field 307 and automatic exchange commences 309 if credit is sufficient.
7) The player's turn arrives in the game and the player must decide 310 to place a wager 311 or cash out and/or end his/her game 316.
8) If the player chooses to place a wager 311, the outcome of the game 312 is automatically calculated. The player touch screen PC calls the system to update the chip fields 313.
9) If the player has a sufficient bankroll to place a minimum wager 314 and wants to continue playing, the process continues at step 355.
10) If the player needs to buy in to continue playing 315, the process continues after buy-in at step 300.

FIG. 13 shows a touch screen layout 400 for player control field 417 and player decision field 419, without stacks of chips or chip value field segment locations being specifically shown in chip tray field 400'. The vacant BANKROLL field 415 is also shown. The amount in the BANKROLL field 415 is input either by direct player credit, account debit, currency, ticket, coin or token input into a receiver system (not shown) as is often used in other casino table systems. With respect to player input of wagers or accessing wager information, the particular touch screen layout 400 shown has three separate side bet option positions 420*a*, 420*b* and 420*c*, as well as an Ante bet position 420*d* and an odds bet position 420*e*. Other player bet options or functions that are not shown, but are within the skill of the artisan based on the enabling description and disclosure herein, include progressive wagers, Play wagers, bad beat wagers, pot wagers, and any other wagering function or type known in the art. Also shown on the player control field 417 are Tip the Dealer contact area 417*a*, available pay table activation/call-up contact area 417*b*, re-bet action or game contact area 417*c* and Clear Bets contact area 417*d*. Other specific player functions that are not shown may be provided, such as "hepl" buttons, strategy call-up, game rules call-up, and other features known to be useful in the art.

FIG. 14 shows a touch screen interface 500 for player controls 517 and player inputs 519, with individual stacks of chips 513 or chip value locations 519*a*-519*f* being specifically shown on the touch screen interface 500. Each of the individual virtual stacks of chips (e.g., 513) shows a virtual perspective view of the individual stack (e.g., 513) so that the appearance of the number of chips in the stack can be viewed by seeing the sides 513*a* of the individual chips in the virtual stack 513. Separate stacks for $1.00 virtual chips 513, $5.00 virtual chips 511, $10.00 virtual chips 509, $25.00 virtual chips 507, $50.00 virtual chips 503 and $100.00 virtual chips 505 are shown. As can be seen, at least two of these denominations ($10.00 and $50.00) are unusual denominations for U.S. casino chips. Because of the electronic nature of the system, any value of chip, in addition to or instead of the standard U.S. chip denominations of $1.00, $5.00, $25.00, $100.00, $1,000.00 and $10,000.00,may be used. At certain gaming tables, $2.00 and $3.00 MAXIMUM wagers are used, and the use of such unusual denominations is facilitated by this virtual system and the provision of denominations of such unusual values (e.g., $3.00 virtual chips) can be provided for and exchanged according to the technology described herein. It is also possible for player inputs 519 and player controls 517 to designate the denominations of individual stacks. This can be done by touch screen contact of a site (with a single, continuous or multiple contacts) and activating a separate player control, such as an up-down arrow, touching both the re-bet action contact area 417*c* and clear bets contact area 417*d* at the same time, and the like, to change the denomination of a stack. In this way, the denominations of the stacks can be controlled by the player, as well as controlling the number of chips in each stack by the change value step later described in greater detail.

FIG. 15 shows a touch screen layout 600 for player controls and inputs, with individual stacks of chips 603, 607 and 609 in chip tray field 600' and less than all available chip value locations 605 and 611 being specifically shown on the touch screen interface 600. Player functions 617 and wager controls 619 are also shown, as well as the BANKROLL field 615.

Figure 16:
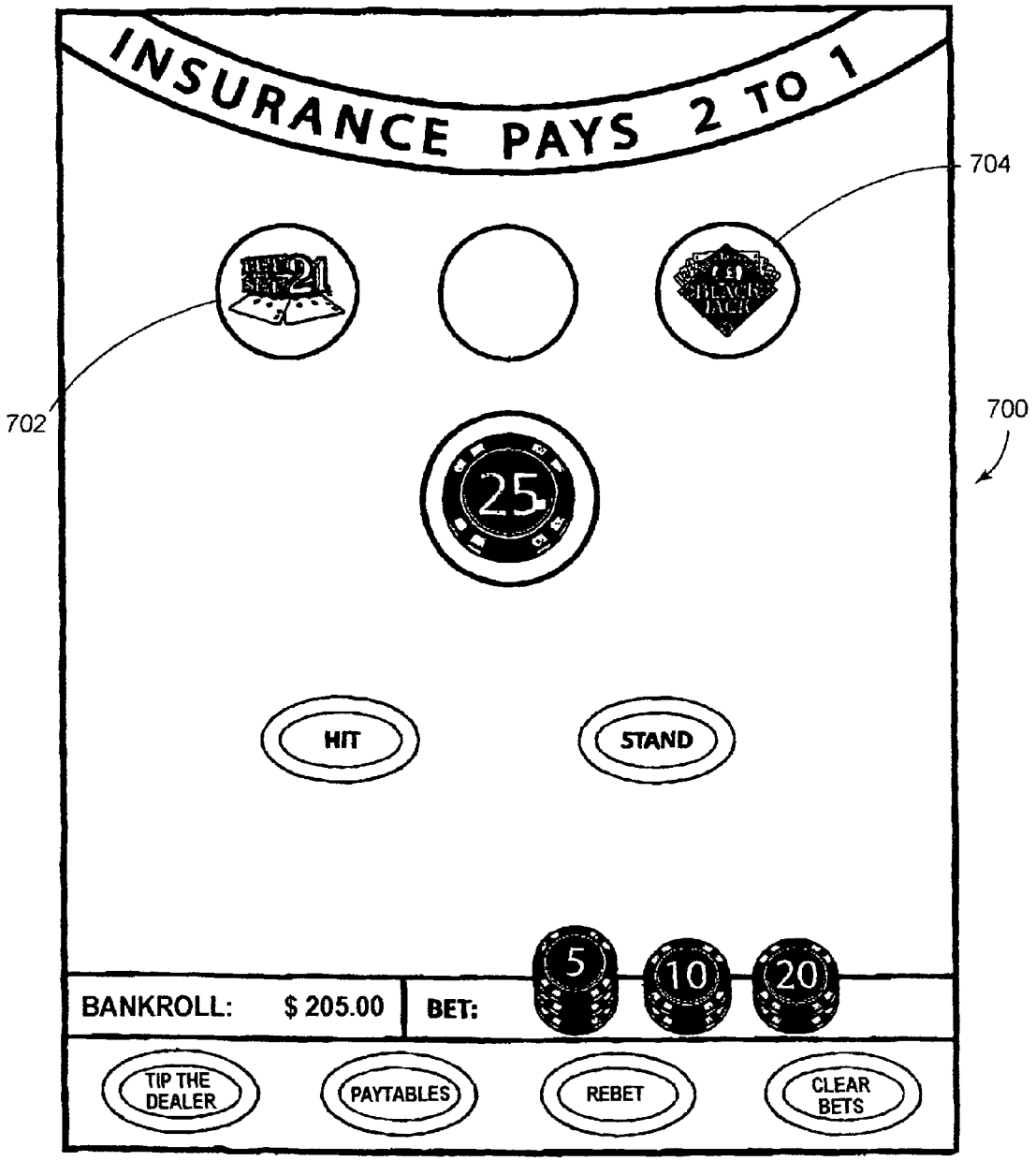
FIG. 16 shows a touch screen layout for a blackjack variant with optional side bet wager areas.

FIG. 16 shows a touch screen layout 700 for a Blackjack variant game with optional side bet wager areas 702, 704 provided for player controls and inputs, with individual stacks of $5.00, $10.00 and $20.00 chips and less than all available chip value locations being specifically activated and shown on the touch screen layout 700.

Figure 17:
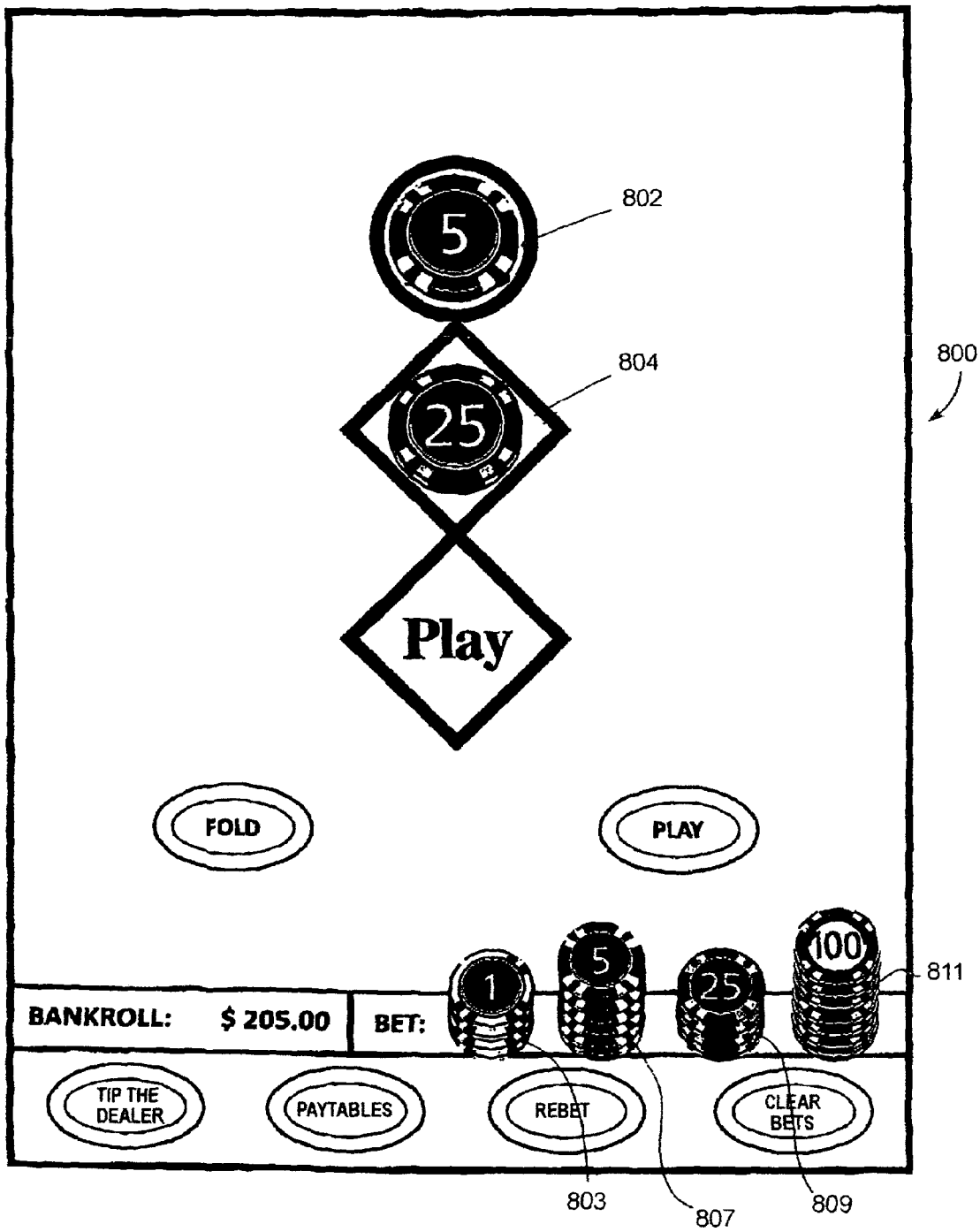
FIGS. 17, 18, and 19 show a sequence of events at a single player position based on wagers in a THREE CARD POKER® game.

FIG. 17 shows a touch screen layout 800 for a THREE CARD POKER® game with player controls and inputs, and with individual stacks of chips 803, 807, 809, and 811 on the touch screen layout 800. In order to place the $25.00 wager in ante area 804, the player touches the stack of $25.00 denomination chips 809 and then touches ante bet area 804 once. In alternative designs, the stack of chips 809 is touched and then dragged to ante area 804. The "pair plus" wager in the amount of $5.00 is made in wager area 802.

Figure 18:
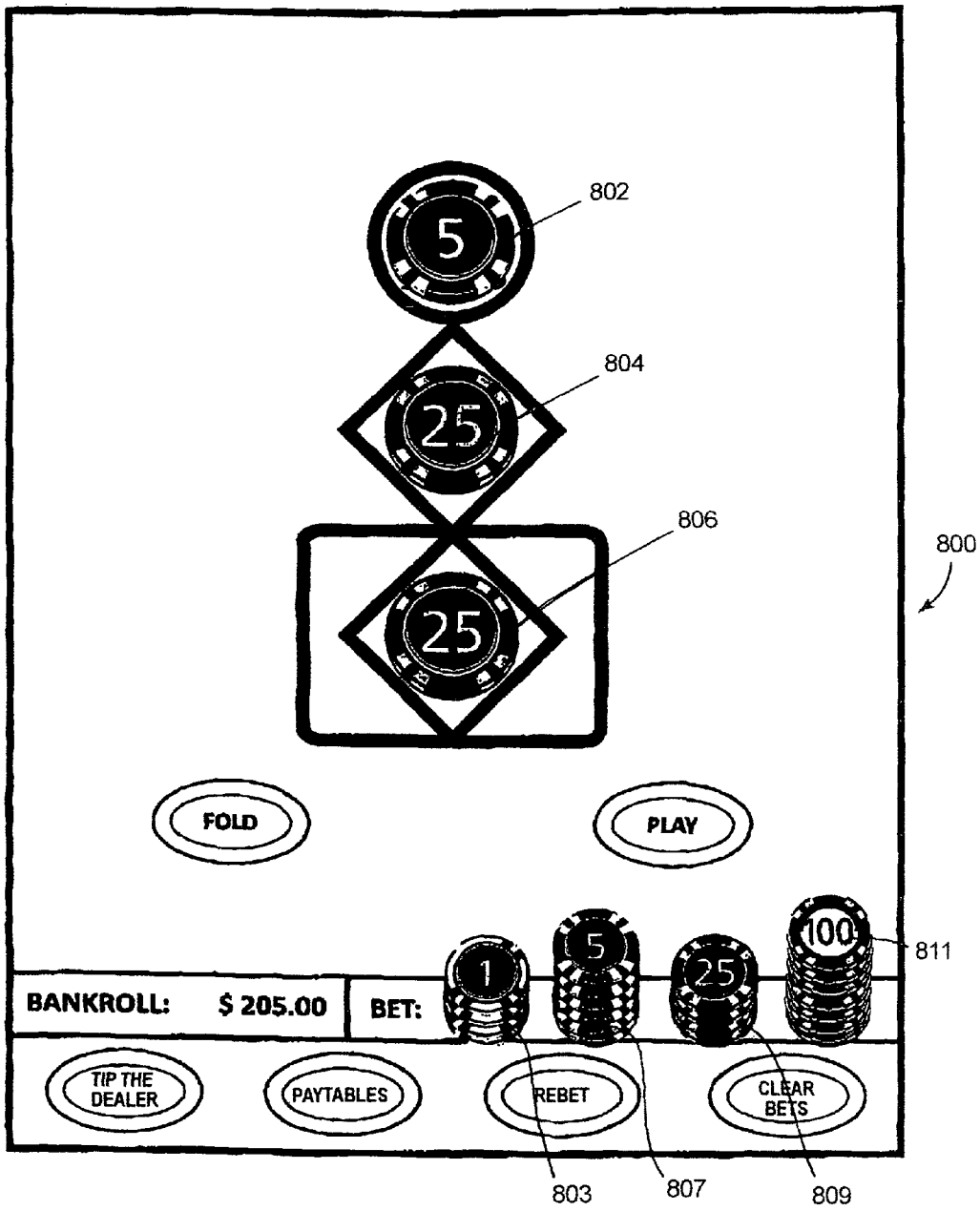
Figure 19:
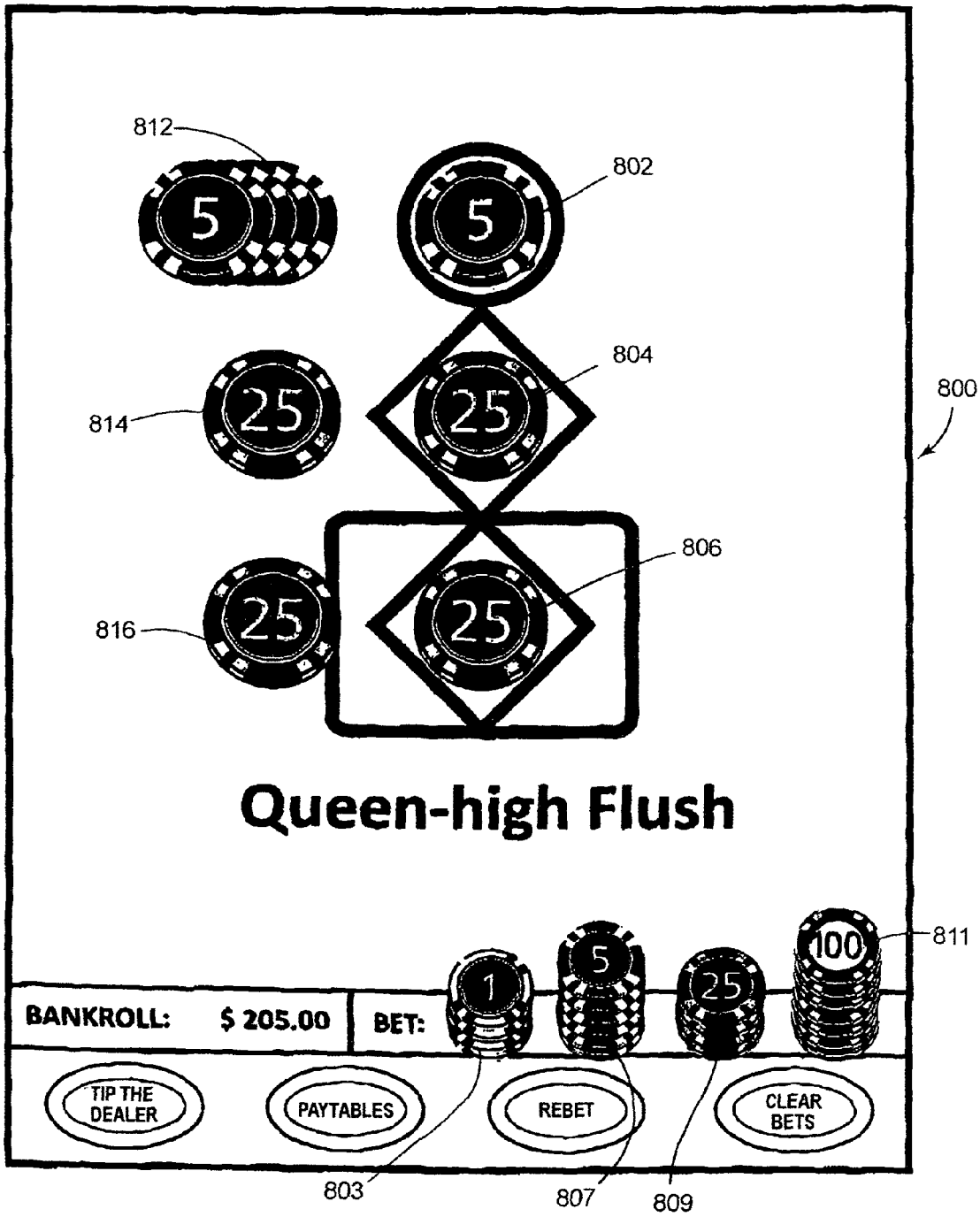

FIGS. 17, 18, and 19 show a sequence of events at a single player position based on wagers in the THREE CARD POKER® game. In FIG. 17, the initial wagers of $5.00 on the "Pair Plus" or better wager is shown in wager area 802 and a $25.00 ante wager is shown in the ante area 804. The Play wager is not placed (usually) until after the player views his cards. In FIG. 18, after the player has received his three cards (not shown), the required matching play wager of $25.00 is made in area 806 and is shown. In FIG. 19, after the dealer's cards (not shown) have been revealed and the player's cards (not shown) have been ranked (as a Queen high flush), the wagers are shown as resolved, with the Queen high flush on the pair or better wager paid at 5:1 in area 812, and the Ante and Play wagers paid at 1:1 in areas 814 and 816, respectively (as the dealer hand rank was beaten).

Figure 20A:
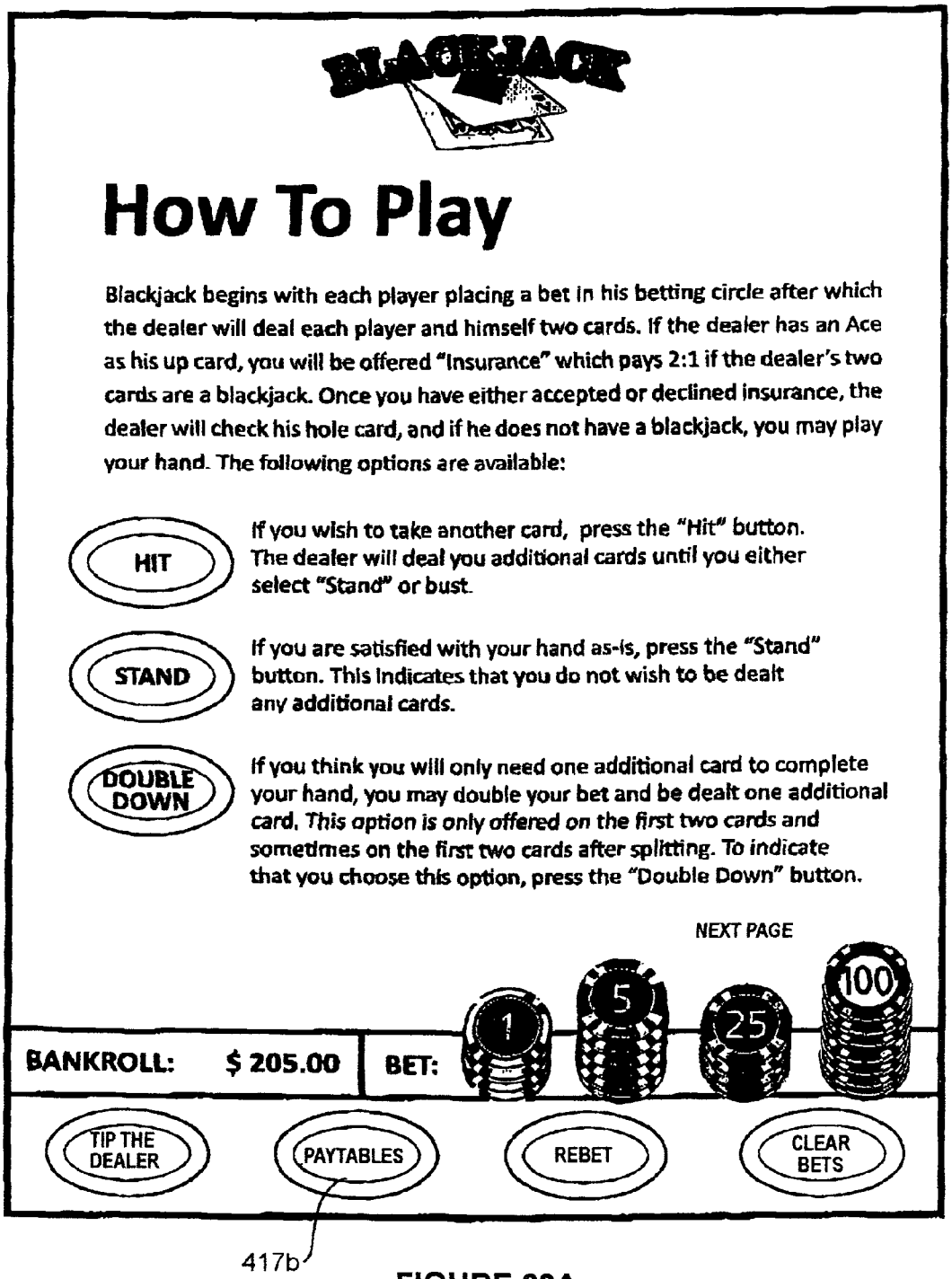
FIGS. 20A, 20B and 20C show different screens that can be called up by a player touching and activating a"pay tables" function.
Figure 20B:
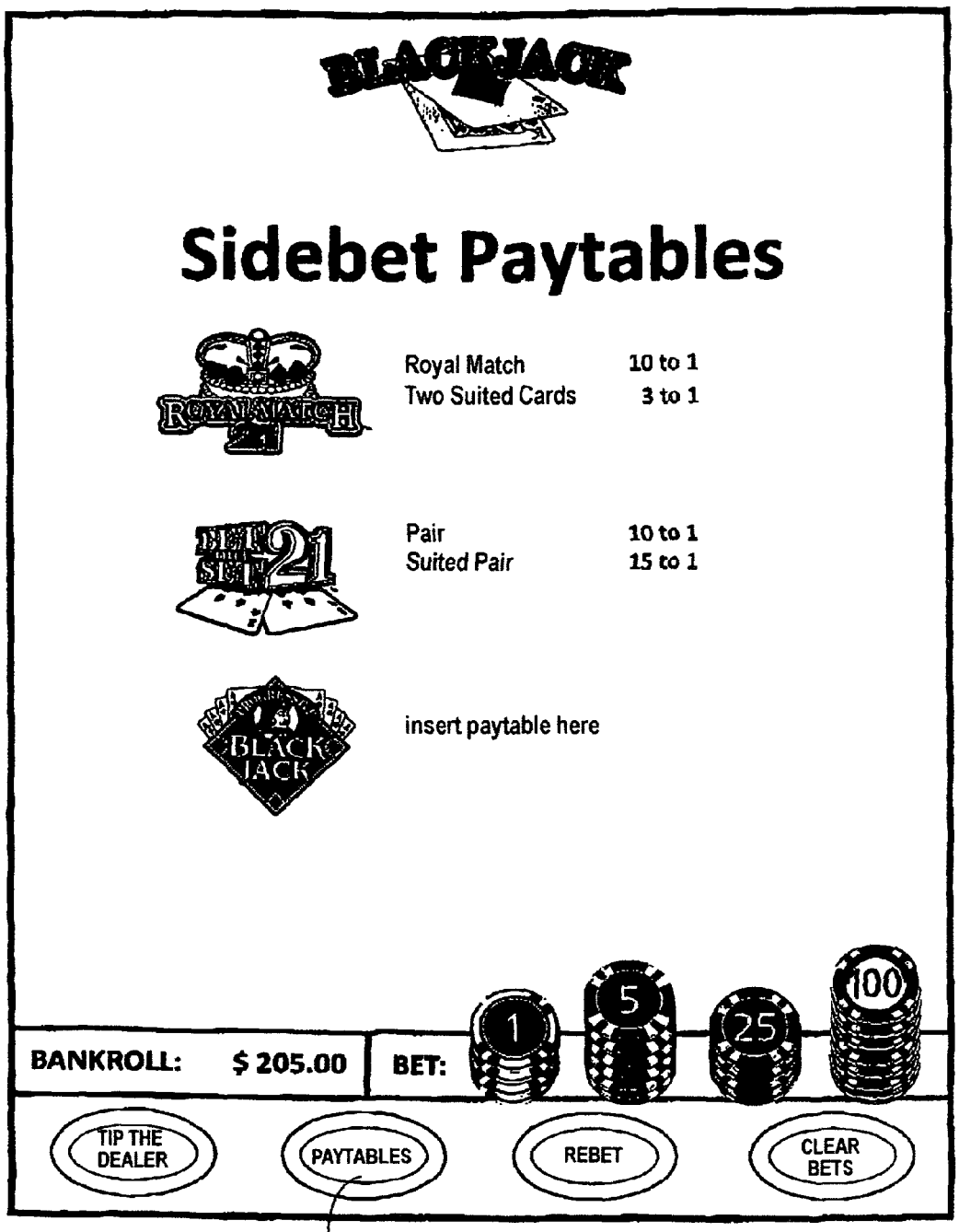
Figure 20C:
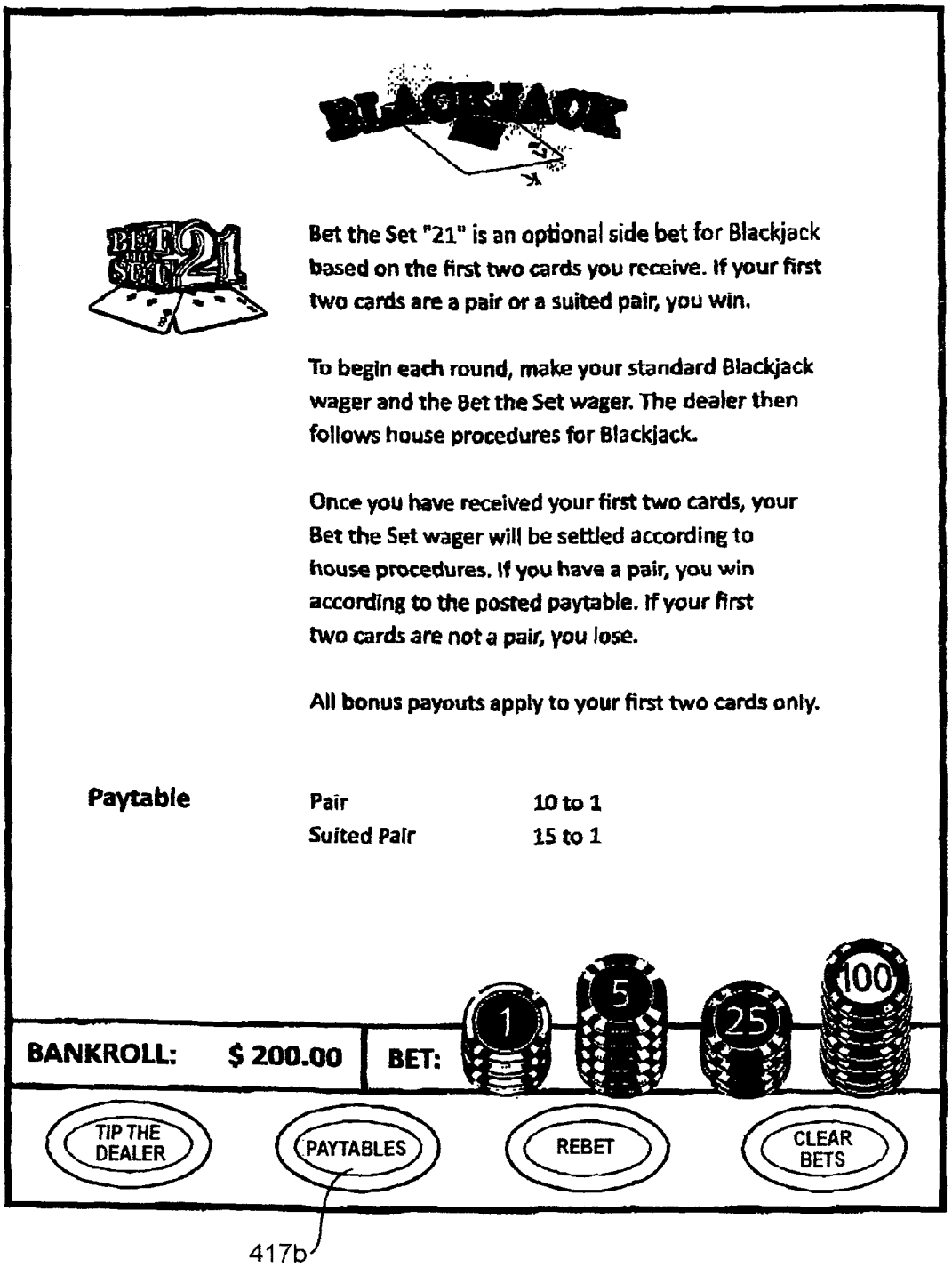

FIGS. 20A, 20B and 20C show different screens that can be called up by a player touching and activating the available pay table activation/call-up contact area 417*b*.

Figure 21A:
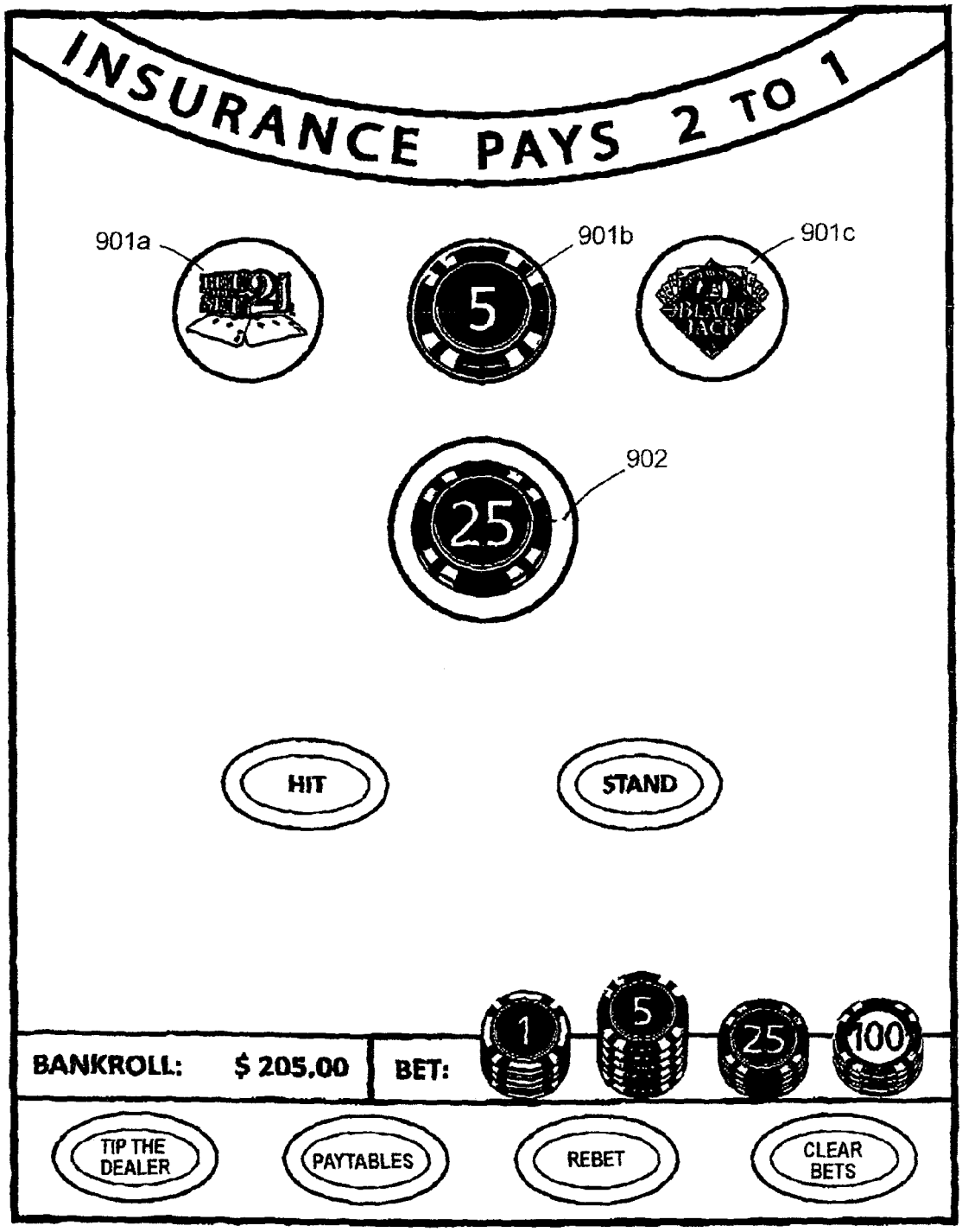
FIGS. 21A and 21B show screen shots for a blackjack variant game with special wagers being made.
Figure 21B:
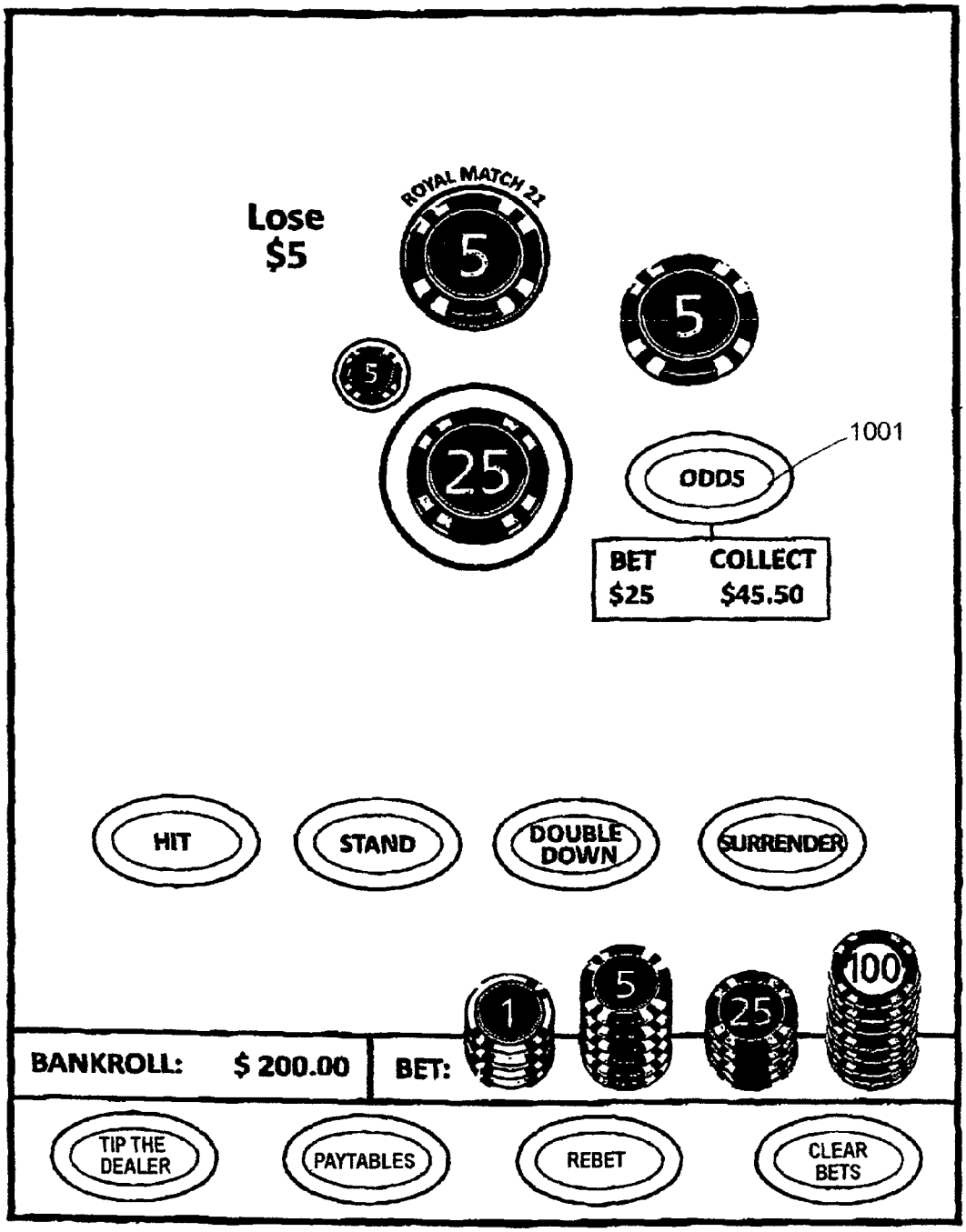

FIG. 21A shows a screen shot for a Blackjack variant game with one or more special optional wagers being made in areas 901*a*, 901*b*, 901*c* available in addition to the normal player versus dealer wager made in betting area 902 (here shown as $25.00). The wager shown as $5.00 is a special side bet wager. FIG. 21B shows that an "odds" bet can be made in area 1001 when the system prompts the player to do so.

Figure 21C:
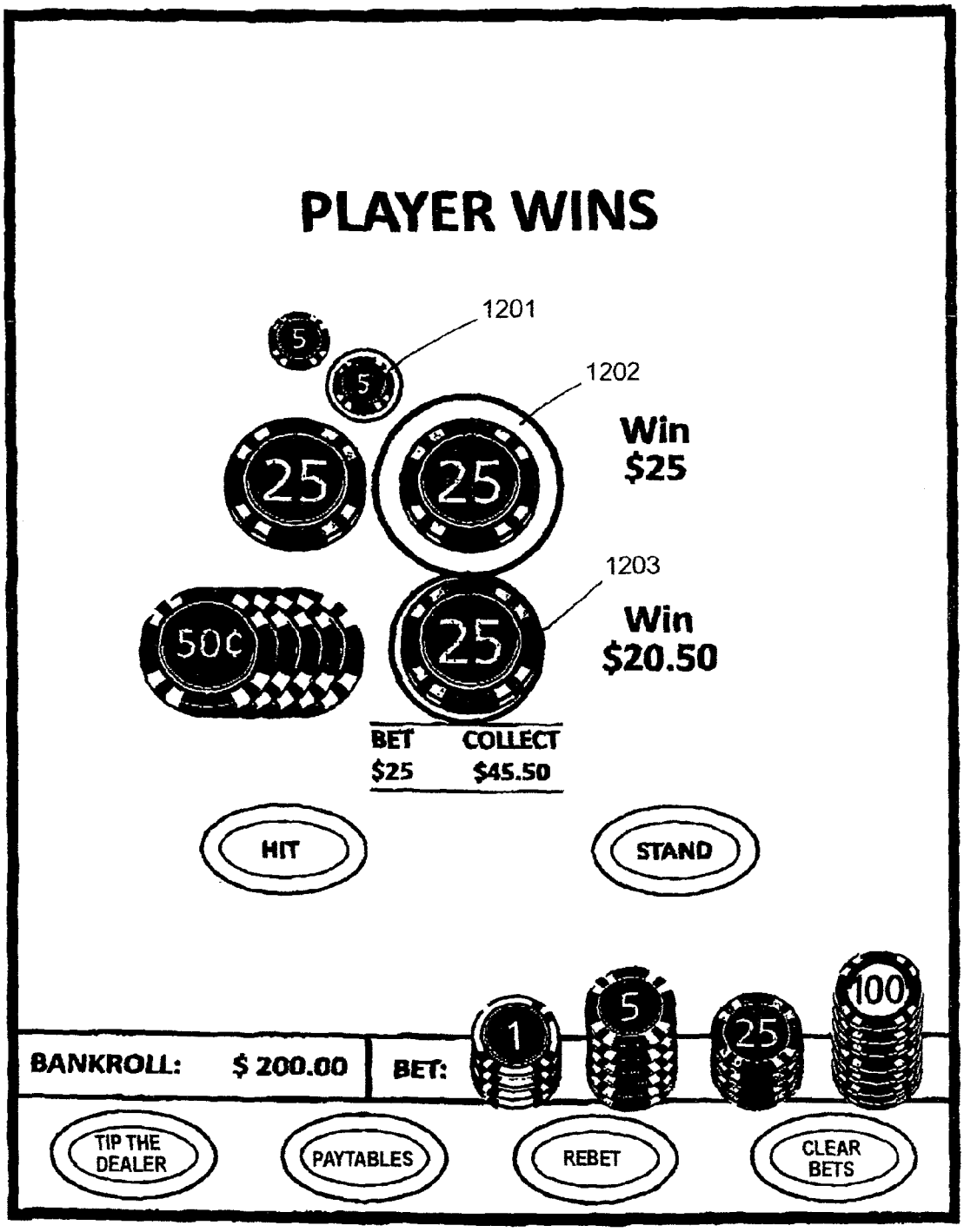
FIG. 21C shows final results of play of a game based on wagers similar to those of FIG. 21B.

FIG. 21C shows the final results of play of a game based on wagers similar to those of FIG. 21B. In FIG. 21C it is shown that the first $5.00 side bet wager 1201 is paid at 1:1 odds, the Play wager of $25.00 made in area 1202 is paid at 1:1 odds, and a unique side bet wager made by a player in area 1203 after a partial view of a player's hand is paid at statistical odds marginally different from 1:1, even with partial value virtual chips ($0.50) not necessarily provided with individual stacking areas, but which will eventually be credited to the BANKROLL balance.

Figure 22A:
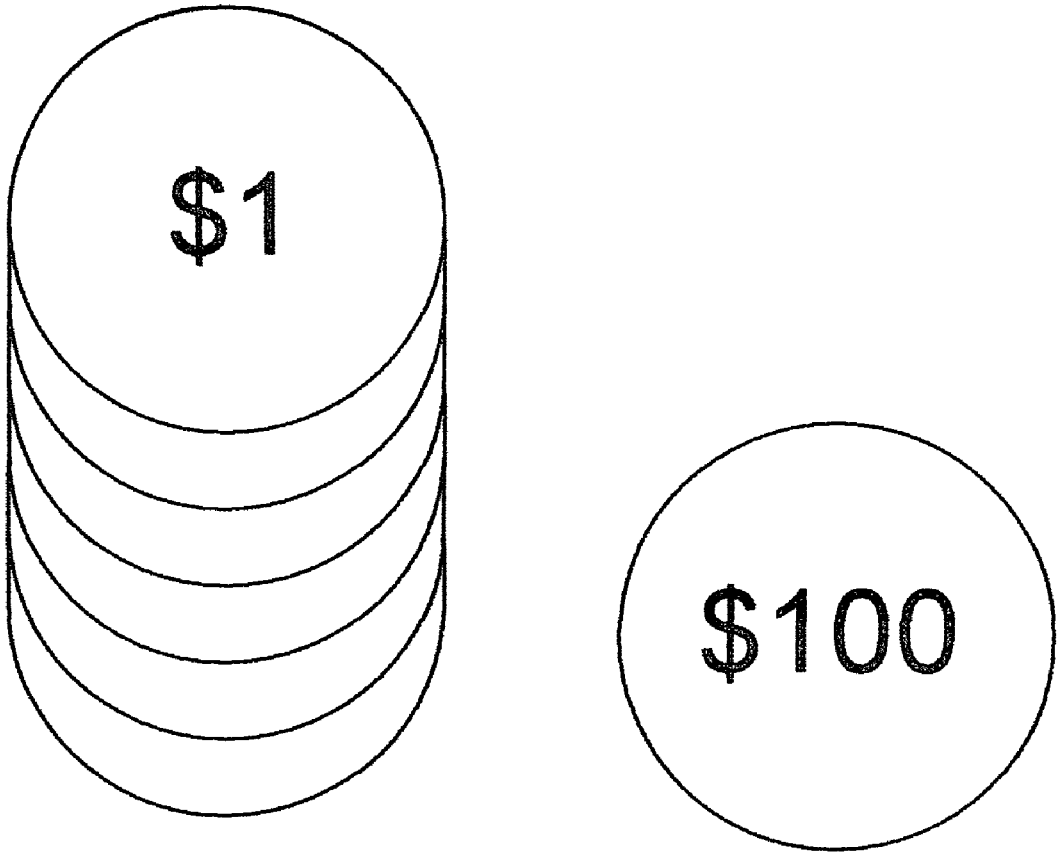
FIGS. 22A, 22B and 22C show a sequence of screen images in which denominations of chips are changed from a higher denomination to a lower denomination by player action.
Figure 22B:
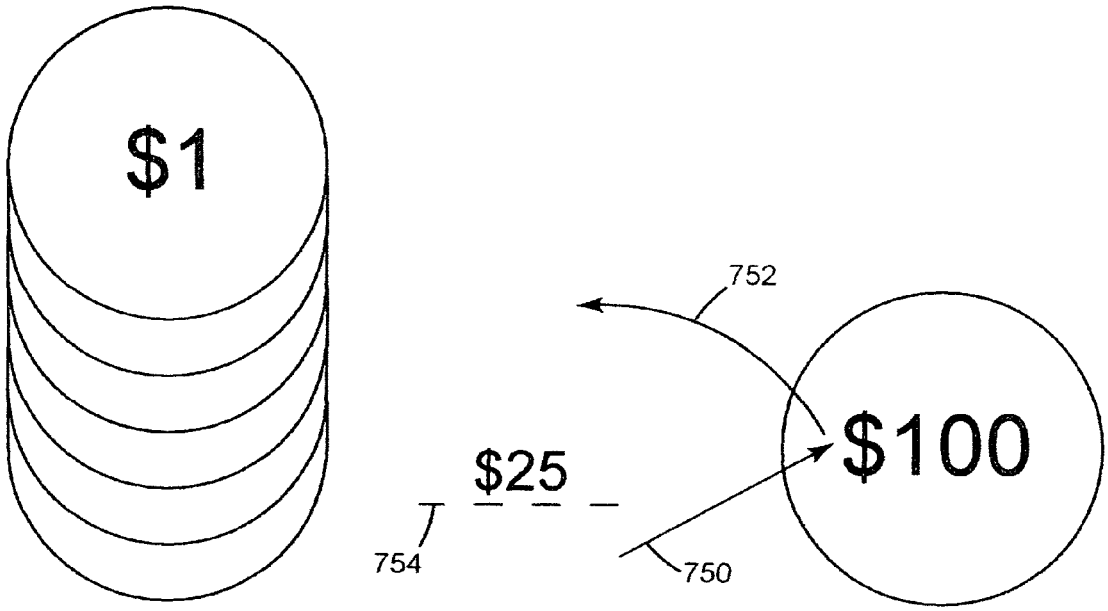
Figure 22C:
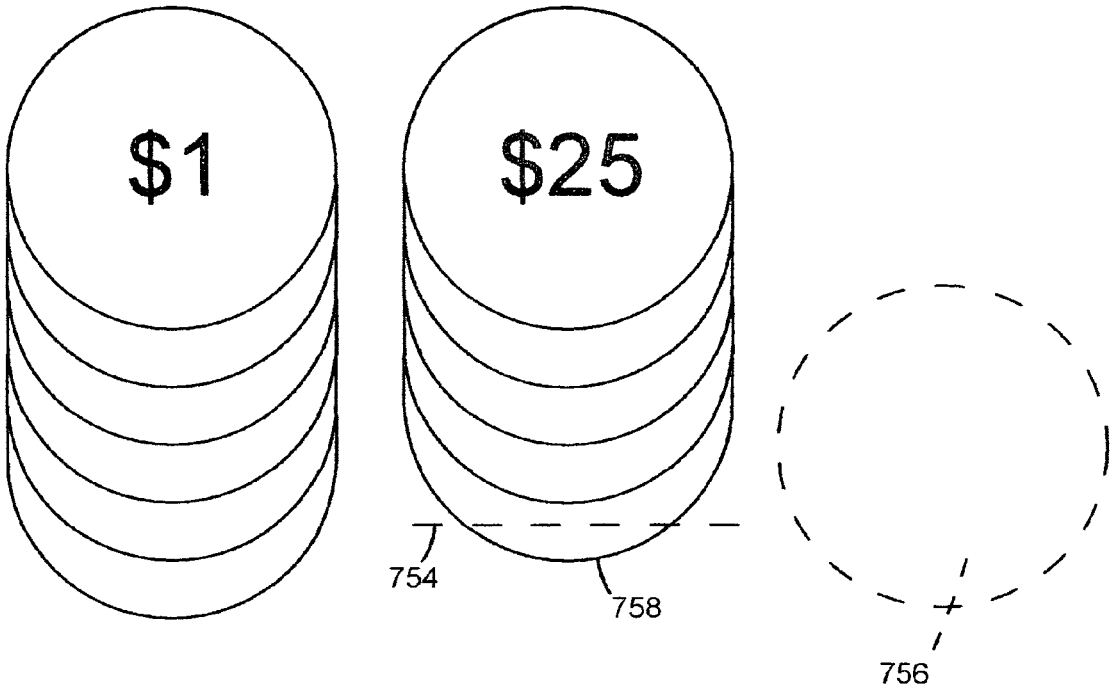

FIGS. 22A, 22B and 22C show a sequence of screen images in which denominations of chips are changed from a higher denomination to a lower denomination by player action. In FIG. 22A, two initial stacks of 5×$1.00 chips and 1×$100.00 chips are shown. In FIG. 22B, the same set of chips are shown, with the $100.00 chip displaced and a location 754 created for stacking of $25.00 chips. A schematic player finger 750 contacts the single $100.00 virtual chip and drags it to the location 754 for the $25.00 chips along path 752. In FIG. 22C, the $100.00 chip space 756 is shown vacant of any $100.00 chips and the previously vacant $25.00 chip position 754 now has 4×$25.00 chips 758, equivalent in value to the changed single $100.00 chip moved in FIG. 22B. The process may be repeated for converting one or more $25.00 chips to multiple $5.00 chips or combinations of $10.00, $5.00 and $1.00 chips (or odd value chips, such as $3.00 chips).

Rather than touching and dragging, as in FIG. 22B, the player's finger may tap the $100.00 chip and then tap the $25.00 location 754 and the same transaction and result will occur. This step can be repeated multiple times. For example, if there were four $100.00 virtual chips and the player wanted eight $25.00 virtual chips, he or she would tap the $100.00 stack, then the $25.00 stack, two times. This player controlled operation can be significantly advantageous as compared to repeated interruptions of the dealer's play of the game to exchange denominations of chips.

Increases in the denominations of chips may be similarly effected. If a player were to touch the $1.00 stack of chips in FIG. 22B and drag it to the right (or to any area designated as a $5.00 value area (not shown), the processor would read the movement of contact (by touch and drag or tap-tap method) from the $1.00 stack to a $5.00 chip position. In the event that there were sufficient chips to color up (increase the value of collections of chips), the processor would make the change in valuation and display the change on the screen.

The time savings in this system and methodology must be appreciated in light of the complexity and level of security that is imposed and performed on physical chip transactions. In a physical casino table game with physical chips, denominations of chips are moved by the player into an acceptable position. The dealer then collects the chips and places them in a first position, ordering the chips in specifically sized stacks (e.g., 20×$5.00 chips and 4×$25.00 chips and partial values of chips are spread out, for example). The dealer then moves a corresponding value of chips adjacent to the player's moved chip collection, but in a separate position from which amounts may be compared. The dealer then calls over a pit boss (higher ranking supervisory personnel) to witness and valuate the transaction. The supervisor then approves the transaction and the physical exchange of differing denominations of physical chips, and then the chips are exchanged. This is time consuming enough for single players, but with multiple players involved, this transaction can take five to ten minutes per table, which can cause a significant delay in game play, irritate fellow players, and decrease casino revenue. The use of the automated color-up system described herein can significantly reduce down time and delays.

There may also be provided an automatic maximum chip value function added, where a player activates this function and the highest value chips are displayed. For example, if the display showed 43×$25.00 virtual chips and 17×$5.00 virtual chips and 23×$1.00 chips, the automatic maximum color-up function would show 1×$1,000.00 chip, 1×$100.00 chip, 3×$25.00 chips, 1×$5.00 chips and 3×$1.00 chips. When the system is equipped with a ticket printer, these images can be printed on the ticket for additional visual confirmation of ticket value.

The term "virtual chip tray," as used herein, may refer to a physical image of adjacent troughs with chips of similar value lined up within the troughs, or adjacent stacks of chips of similar value aligned on a player's virtual play or area of control surface.

There are a number of reasons why a player may want to play on a game play platform that provides the player an opportunity to reconsider certain game play decisions. There are a number of reasons why it is advantageous to the casino to allow the player an opportunity to change the play decision before the play moves to the next player position. One reason is that it makes an initial exposure to an unfamiliar game more pleasant to the player. By providing the player with opportunities to reverse obvious errors, the player has the opportunity to learn the correct play strategy. Another reason is that it gives the player the feeling that the dealer is looking out for the best interests of the player. Another reason is that it gives the player the impression that the house wants to provide a game that is more fair to the player, and that the casino is not earning more off of a game at the expense of its newer players.

It is in the best interest of the casinos to provide a positive gaming experience for new players, to keep those players coming back.

Players make erroneous play decisions for many reasons. One reason is lack of experience. A player may be new to gaming, new to a game, and lack knowledge of the game rules. They may have studied the game rules, but lack the experience or confidence to make quick play decisions. This can lead to player disappointment when the player runs out of money before he or she fully grasps the rules and appreciates that there is a strategy to improving player outcomes.

Players can be distracted by fellow players, by noises, and bright colors, and they may also be inattentive from drinking alcohol. Players who are distracted are less likely to make favorable play decisions than a more focused player.

Players may also input a play decision and, while doing so, may inadvertently touch the wrong play control, sending the wrong instruction to the processor. Systems of the present invention preferably provide a prompt to allow a player to undo any one of a number of play decisions that are clearly erroneous as compared to a set of rules that represents theoretical play.

The house may not wish to prompt the player of an erroneous play decision in all instances. The further the player's decisions are away from theoretical, the more the house will earn on the play. However, there are distinct advantages to the house in giving the player a second chance to undo an error that is more objectively erroneous. By giving players a second chance to undo the more objective play errors, goodwill develops between the player and the dealer, giving the player the feeling that the dealer is watching out for the player's best interests. Another distinct advantage to the casino is that giving players a chance to undo obvious errors as the errors are being made speeds game play. In conventional table gaming, players who wish to change a play decision must get the dealer involved and the dealer must stop the play to get the player back on track with a more advantageous play decision.

According to the invention, players are prompted to confirm play decisions immediately after a play decision is made, and most likely before the dealer or other players even notice that an obvious error was made. The player can rapidly change his/her decision and the game play can continue without an interruption in the game. Since casinos make money by keeping game play moving, providing immediate feedback and a chance for the player to make a correction without the help of the dealer keeps the table more productive.

In a preferred form of the invention, the player receives a prompt on a player screen to reconsider a play decision. The player then inputs a confirmation or a changed play decision. In alternate embodiments, the prompt appears on a dealer screen and the dealer is required to input the play confirmation or changed play decision. This is a less preferable way to provide the opportunity to correct an error, but this embodiment is nevertheless contemplated by the present invention.

Unlike hint features that are known in the art that provide play advice prior to a player decision, according to the present invention, players are only provided with the opportunity to change a play decision after that play decision is made. Although it would be possible for systems of the present invention to provide the player with this opportunity to reverse a decision for all game play that does not amount to theoretical play, in some embodiments, only the more objectively erroneous play decisions receive prompts. The more subjective decisions would not receive a prompt. Preferably, a predetermined set of criteria (such as a table showing hitting rules for each combination of two-card player hands and dealer up cards) is used to determine whether the play decision is of the type that triggers a prompt.

Each casino game has its own game play strategy. Some games, such as baccarat, don't require the player to decide whether or not to take a hit card. The only game decisions in baccarat are whether to play the banker hand, the player hand or the tie hand, and how much to wager. Other games ,such as blackjack and draw poker, require the player to make many strategic decisions throughout the game.

When the game is blackjack, for example, players make multiple strategic decisions, including, but not limited to, whether or not to take a hit card, whether to double down, whether to split hands, and whether or not to place an insurance wager. During the phase of the game where the player is asked to take hit cards or stand, the player may make multiple hit decisions within the same hand.

Using blackjack as an example, there are a number of player errors that can be characterized as objective errors of the type that would trigger a prompt to have the player reconsider the play decision. For example, if the player holds a two-card hand with a hard point total of 17-20, the player should always stand, according to published theoretical play guidelines. Statistically, the player has a much better chance of beating the dealer's hand without taking a hit card, than he does by taking an additional card.

If the player holds a blackjack, the player should never take a hit card, because he has already won or tied. If the player inputs a "hit" decision holding a two-card 21, a prompt to change the decision is provided.

Another example of an objective error is standing on a soft 16 or less (i.e. a hand including an Ace that can count as an eleven or one). In this instance, a prompt to reconsider the play decision will be provided.

Another obvious error that results in a prompt to reconsider a play decision is when a player holds a hand with a point count of eleven and inputs a "stand" decision. Since the object of the game is to achieve a point count of twenty-one, and since there are twelve times more cards that will improve the hand than bust the hand, the odds greatly favor the player in taking a hit card. In the example of a hand containing a point count of eleven or less, taking only one additional hit card will never bust the hand.

Another example of an obvious error is when a player doubles down on a hard hand count of twelve or more. When a player doubles down, he doubles his initial wager and must take only one additional hit card. The likelihood that a player holding such a hand will bust is greater than the likelihood they will not bust. Doubling down on a twelve-point hand may be intentional and can indicate that a player is card counting. Providing a prompt in response to this decision, and accumulating data by player as to the frequency of confirming this particular "erroneous" play decision, can be used as a method of identifying and expelling card counters from a casino.

In some embodiments of the invention, the dealer is provided with a dealer screen and if the dealer does not play his hand the house way, the dealer receives a prompt to correct the error. In a preferred form of the invention, this prompt is a notice of a dealer error, and not an election. When the dealer receives the prompt, the necessary correction is made and game play resumes.

The following exemplary description of an example of a system and methods of the present invention describes a blackjack game in which the player calls for a hit card on a hard seventeen hand.

Figure 23:
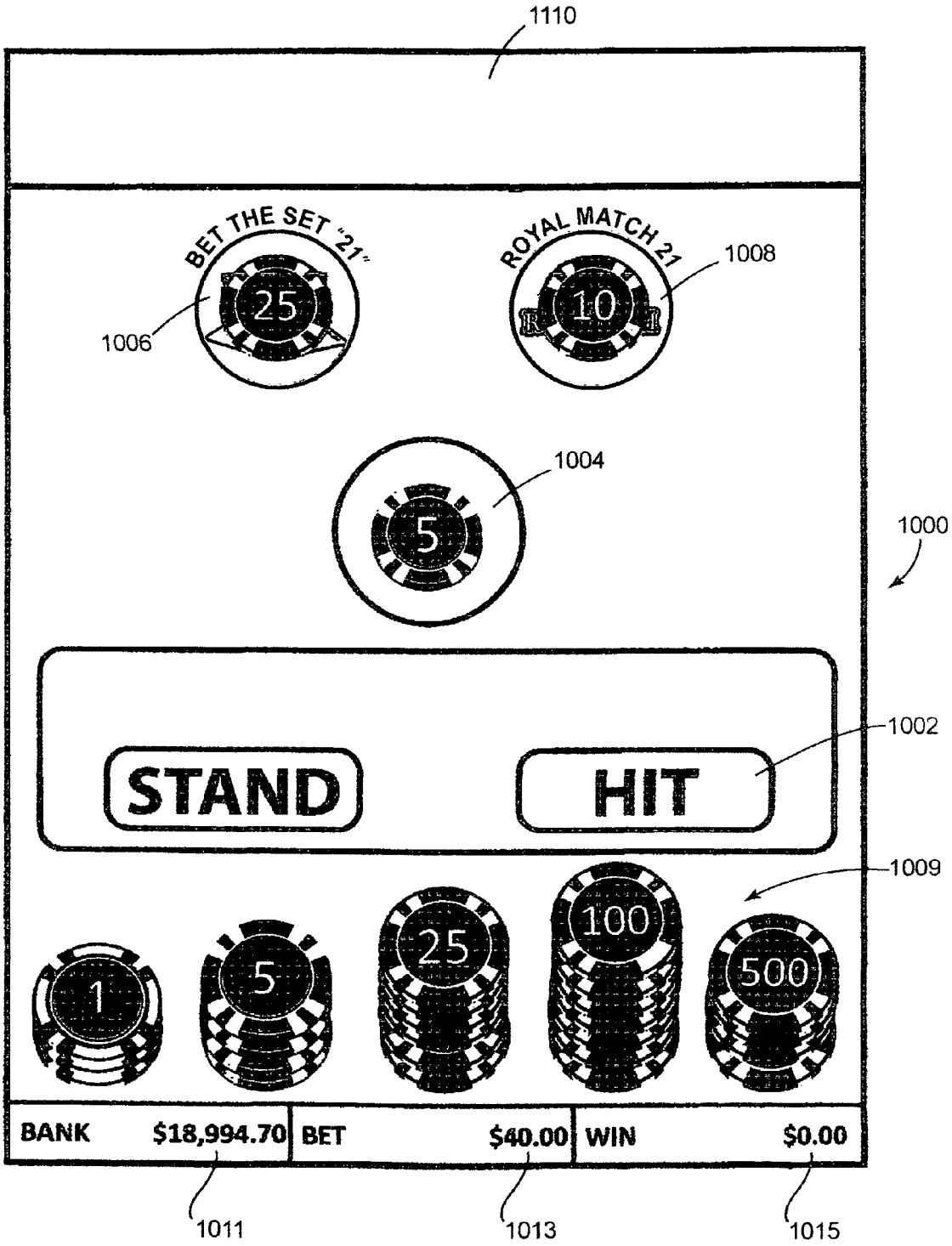
FIG. 23 shows a player interface in a game of blackjack in which a player's cards are shown with a total of a hard 17 and the player has an option to stand or hit in that round of play.

The following Figures assist in an appreciation of the error-notification process for players according to the present teachings. FIG. 23 shows a player interface 1000 in the game of blackjack in which the player has made a blackjack wager 1004, a BET THE SET "21"® wager 1006 and a ROYAL MATCH 21® wager 1008. The player is dealt physical cards (not shown) having a total count of a hard seventeen (not shown) and the player has an option to stand or hit in that round of play. No other options (surrender or double down or insurance) are offered in this example. The player erroneously elects to hit 1002.

Figure 24:
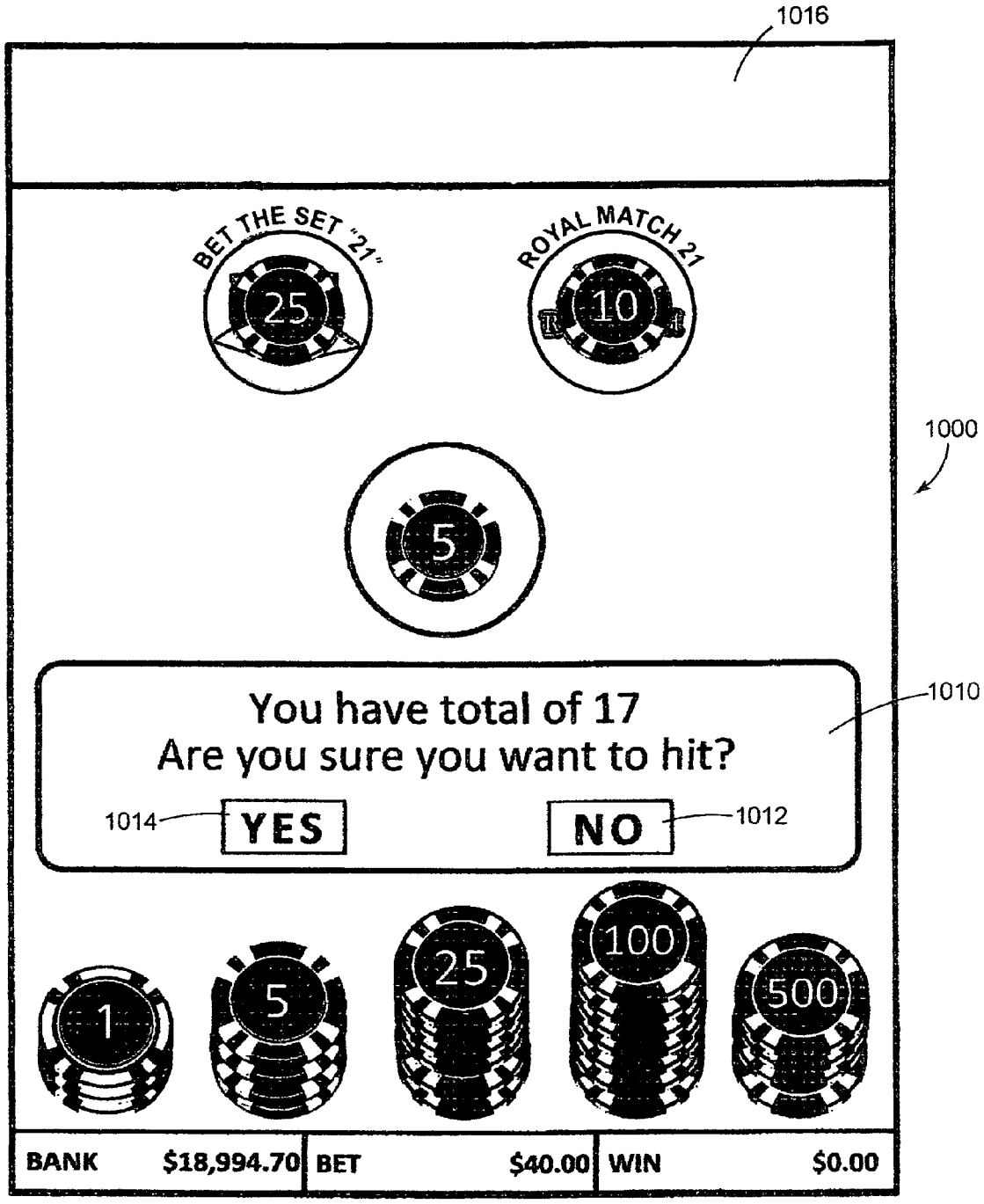
FIG. 24 shows the player interface after a player has made an election following FIG. 23, with a prompt questioning the player's election and offering an "undo" of the player's election.

FIG. 24 shows the player interface 1000 after a player has made the election to hit 1002 (FIG. 23) on a hard 17, followed by a prompt 1010 questioning the player's election. The prompt 1010 offers an "undo" the player's election ("NO") 1012 and an option to maintain that selection ("YES") 1014. In this embodiment, no dealer instructions are provided in dealer area 1016.

Figure 25:
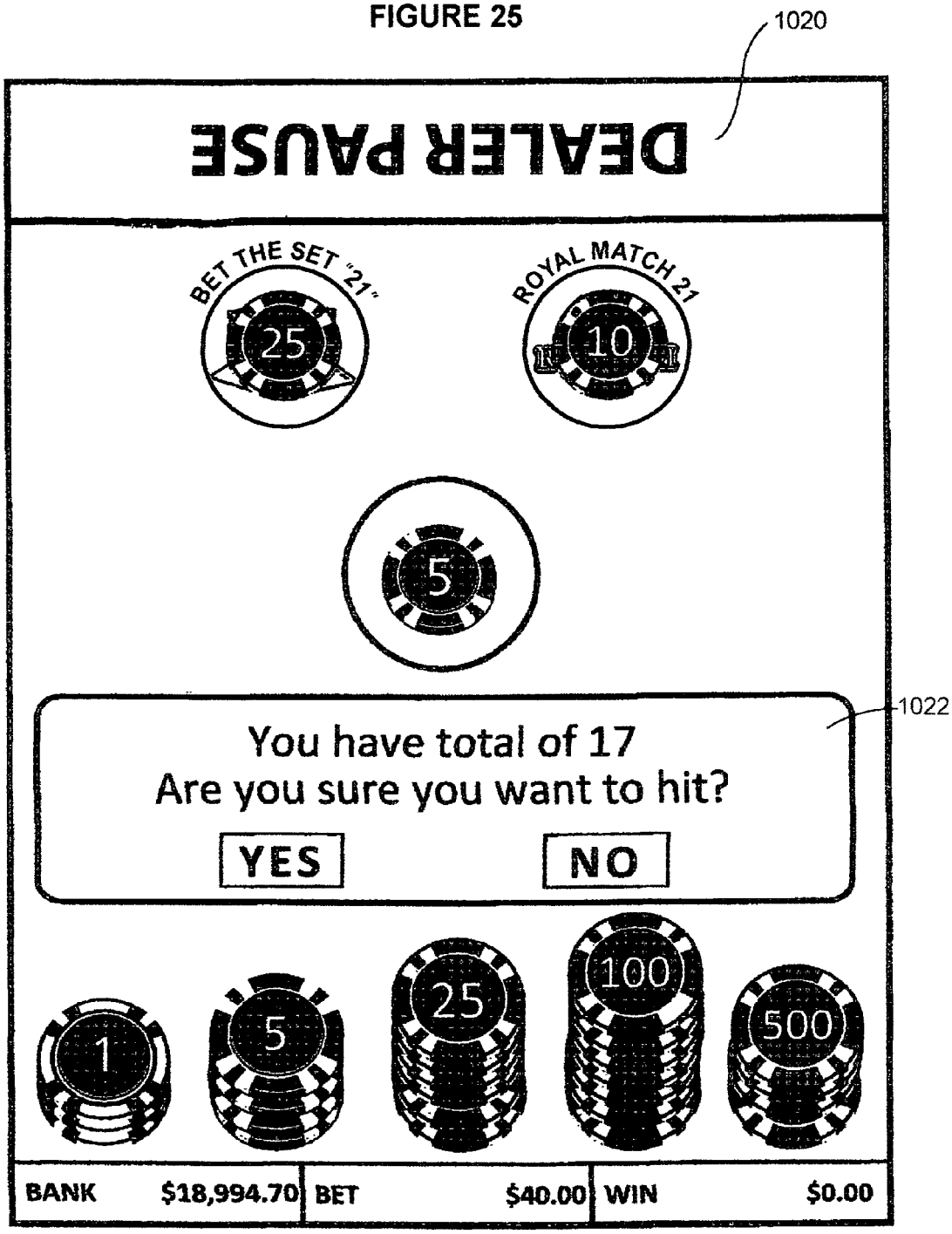
FIG. 25 is an alternative screen shot of an embodiment of an "undo" notification and option with a visual indication for a dealer in a dealer-viewable screen component to pause a game.

FIG. 25 is an alternative screen shot of an embodiment of an undo notification and option with a visual indication for a dealer ("DEALER PAUSE") in a dealer viewable screen component 1020. In addition to player prompt 1022, the dealer receives viewable instructions 1020 to take no action (i.e., by not removing another card from the card handling device with card recognition technology) until the play decision is confirmed or changed.

Figure 26:
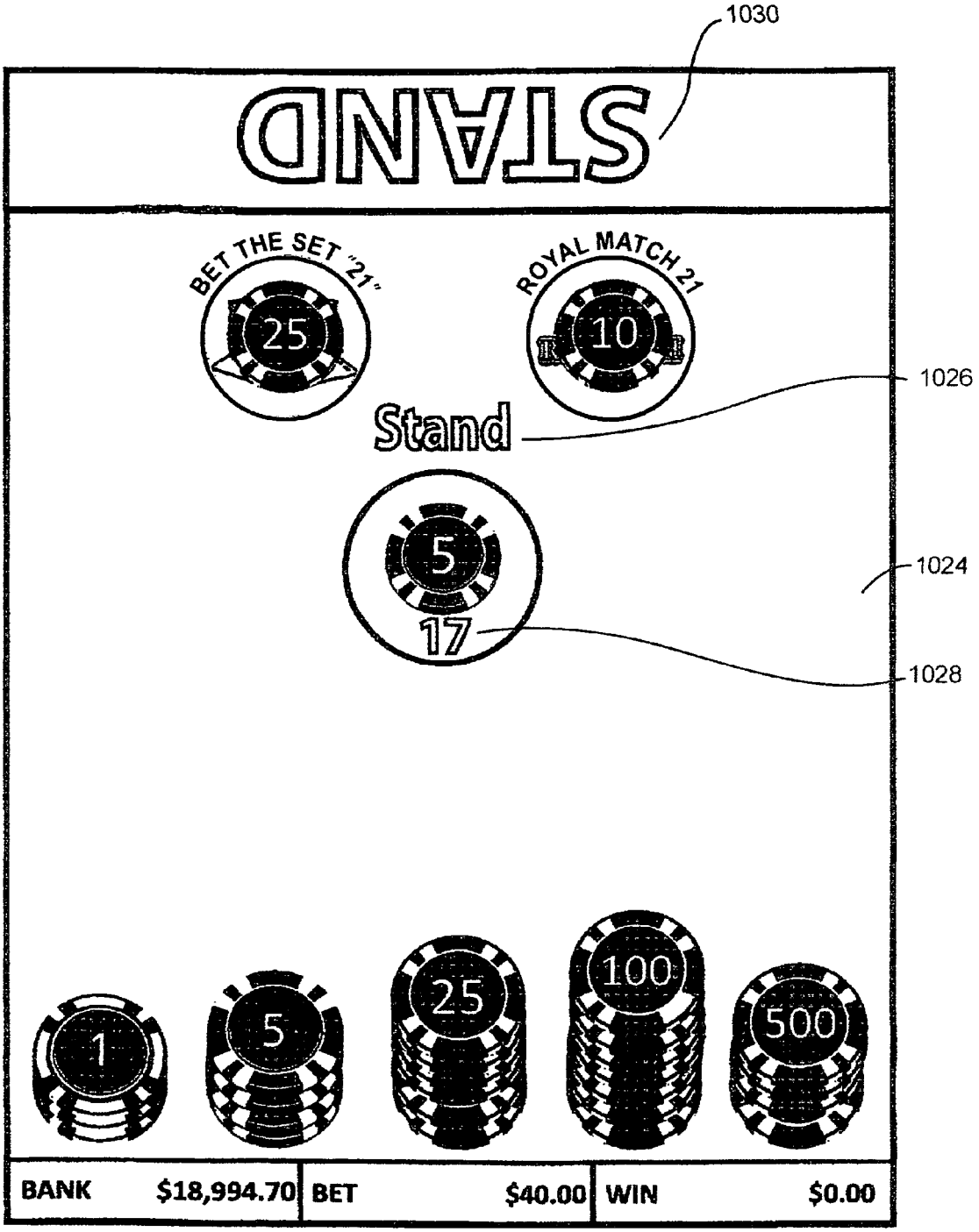
FIG. 26 is an example of a player-interface screen shot after correction of an egregious error after a player's being shown the option to perform the "undo" of FIG. 24.

FIG. 26 shows the screen 1024 after an election to hit on a hard 17 (as shown in area 1028) was changed to "stand" 1026. The player instructions to stand 1026 are repeated in dealer area 1030 of the screen 1024. The dealer then responds by continuing with the round of play rather than dealing additional cards to that player position.

The prompts, alone or in combination with the dealer instructions, advantageously prevent a dealer from removing cards from the shoe before a card is needed, and otherwise help to prevent the player from reconsidering a poor play decision, and spending extra time changing his play decisions. Giving players the opportunity to undo an obvious error not only speeds game play, but it builds goodwill between the player and the house. Any game features that strengthen a connection between the player and the house will assist in keeping players coming back to the property. This is particularly significant for casinos who cater to local customers (who gamble often) or repeat customers who take multiple trips per year to a casino resort.

An example of player interface 1000 is shown in FIG. 23. There are betting circles for wagers 1004, 1006, and 1008 appropriate for the underlying game of ROYAL MATCH 21® blackjack, virtual chips 1009, indicators for a bank for credits 1011, bets placed 1013, and winning outcome 1015 for a current round of play.

The top portion of player interface 1000 is known as a dealer split screen area 1110. Dealer split screen area 1110 is oriented toward a dealer and indicates to the dealer an action a player desires to take, or, preferably, when the player has made an egregious error. In this example, a player has been dealt a hand with a point count total of 17 (not shown) and must select an action to proceed with a round of play. An action prompt indicates the player must select to either stand or hit 1002. If appropriate, another prompt would appear, giving the player a choice to "double down."

As shown in FIG. 24, should the player select an action that meets the predetermined disadvantageous criteria, alert prompt 1010 is then triggered for display. In this example, the player must confirm the selected action by pressing "YES" 1014 or undo the selected action by pressing "NO" 1012. In this embodiment, dealer split screen 1016 remains blank until alert prompt 1010 is cleared. This is a visual indication to the dealer that play may not continue.

Figure 27:
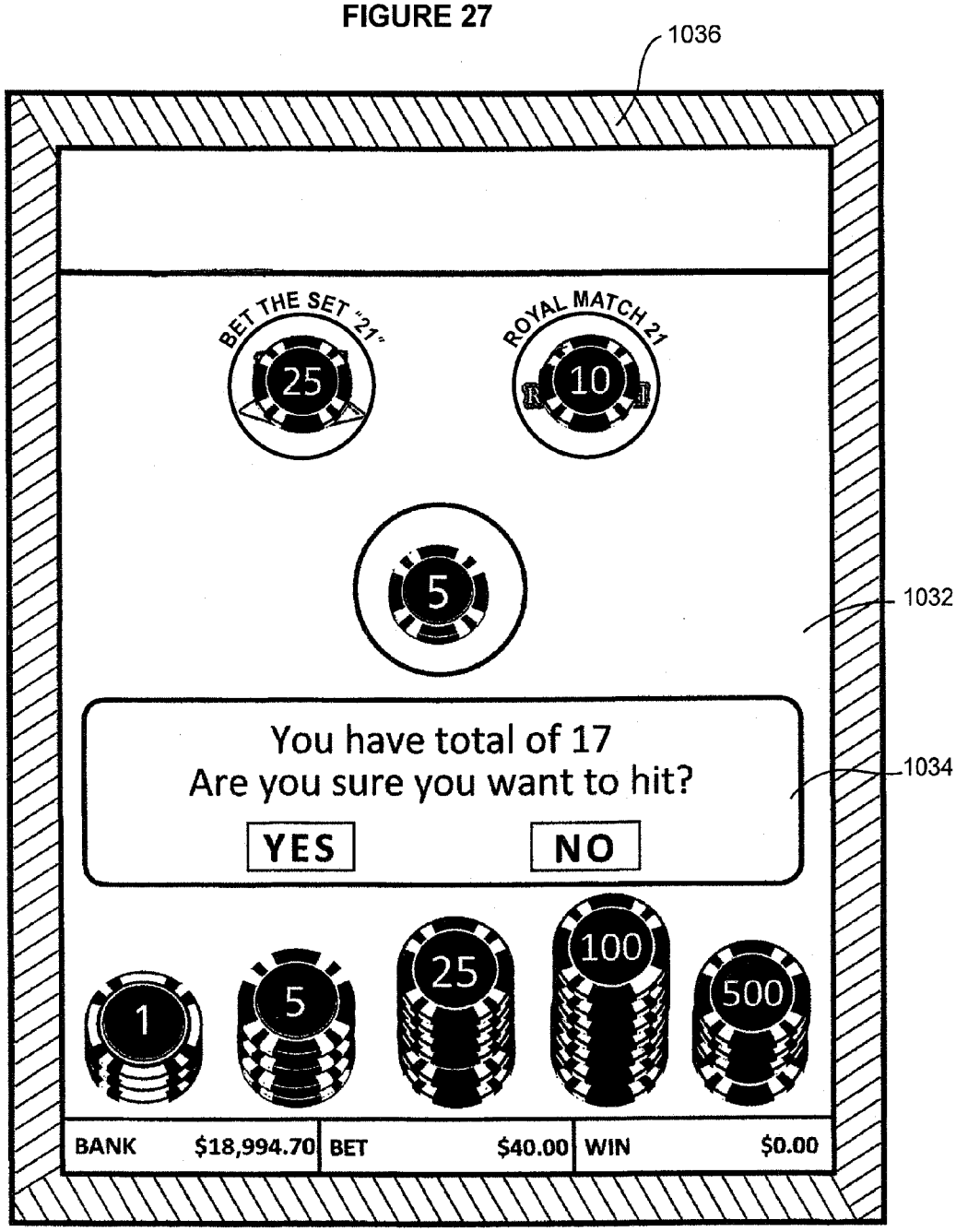
FIG. 27 is another alternative screen shot of an embodiment of an "undo" notification and option with a visual indication for a dealer.

FIG. 25 shows an alternative embodiment, wherein the visual dealer indication is presented as dealer pause 1020. Alternatively, other icons or symbols to present a visual indication to the dealer are also contemplated. Another alternate embodiment is shown in FIG. 27. In this embodiment, the visual indication to the dealer that the player has made an egregious error is represented as a halo 1036 around player interface 1032. Play may not continue until alert prompt 1034 is cleared. Halo 1036 may be computer generated or may be an actual light source mounted adjacent player interface 1032.

This application and the technology described herein is related to Shuffle Master, Inc.'s Chipless Gaming Table System, or I-TABLE®, family of applications, including U.S. patent application Ser. No. 12/218,583, filed Jul. 15, 2008, and U.S. patent application Ser. No. 12/231,759, filed Sep. 5, 2008, the disclosures of which are incorporated herein by reference in their entireties.

Although significant specificity has been provided in the description of apparatus, methods, systems, components and game rules, these specifics are not intended to limit the scope of the generic invention described, but are intended to provide examples within the generic scope of the invention claimed.

What is claimed:

1. A method of playing a casino table card game, comprising:

receiving a play election from a player of the casion table card game at a processor;

determining, using the processor, if the play election meets or exceeds a predetermined level of disadvantage to the player, the processor determining if the predetermined level of disadvantage to the player has been met or exceeded using at least one of data in the form of a look-up table indicating at least one of respective levels of advantage and respective levels of error of at least two play elections available to the player and a program to calculate and compare at least one of respective levels of advantage and respective levels of error of at least two play elections available to the player;

if the processor determines that a predetermined level of disadvantage to the player has at least been met, causing a sensory indication to be provided to the player of such determination;

offering the player an option to withdraw or confirm the play election;

responsive to a withdrawal of the play election, receiving an alternative play election at the processor; and responsive to the alternative play election, allowing play of the casino table card game to proceed; or responsive to confirmation of the play election, allowing play of the game to proceed.

2. The method of claim 1, further comprising selecting the casino table card game from the group consisting of: blackjack, poker, a blackjack variant, a poker variant, baccarat, and a baccarat variant.

3. The method of claim 1, wherein the play election is selected from the group consisting of a wagering decision, a card hit decision, a card discard decision, a stand decision, and a draw decision; and wherein all play elections, alternative play elections and play election confirmations received by the processor are transmitted via an electronic interface.

4. The method of claim 3, further comprising indicating all play elections, alternative play elections and play election confirmations to a dealer on a display.

5. The method of claim 2, further comprising displaying a prompt to the player when a play election is made that is objectively disadvantageous to the player.

6. The method of claim 1, further comprising displaying a prompt to the player for only some play elections that are disadvantageous to the player.

7. The method of claim 5, further comprising displaying a prompt on at least one of a player display and a dealer display, and accepting responses to prompts appearing on the dealer display input by a dealer.

8. The method of claim 2, wherein the casino table card game is blackjack, a sensory indication is provided and an option to withdraw a play election is given to the player when the play election made by the player is to take a hit when a player has a point count equal to or greater than a count of a hard 17 or greater.

9. The method of claim 7, wherein the casino table card game is blackjack, a prompt is provided and an option to withdraw a play election is given a player when the election made by the player is to take a hit when a player has a point count equal to or greater than a count of a hard 17 or greater.

10. The method of claim 1, further comprising confirming the play election via an electronic player interface.

11. The method of claim 1, further comprising providing playing card information to the processor from at least one source selected from the group consisting of a delivery shoe with a playing card reader, a shuffler with a playing card reader, a playing card reader on a gaming table over which playing cards are moved one-at-a-time, and an overhead camera imaging system.

12. A gaming system for a card game, the system comprising:

a card handling device including apparatus configured to read at least one playing card information indicia selected from the group consisting of suit and rank;

a gaming table;

a player interface having a display for each player position associated with the gaming table;

at least one game controller in communication with the apparatus to receive read card information from the card delivery system;

the at least one game controller programmed to, responsive to received read card information for a subject player position, identify at least one play selection for the card game input through the player interface for the subject player position that is less advantageous than at least one other play selection available for the read card information;

the at least one game controller containing at least one of 1) a look-up table of relative advantages of play selections and 2) a program to calculate relative advantages of play selections available at a time in the play of a game where a player may exercise at least one play selection from at least two alternatives and the at least one game controller is programmed to compare a play selection to at least one other play selection to identify relative player advantage of the play selection made to the at least one other play selection;

the at least one game controller programmed to provide a player at the subject player position with a visual indication on the display of the player interface for the subject player position that a less advantageous play selection made by the player is a possible game play error; and the at least one game controller enabling the player interface for the subject player position, where a less advantageous play selection has been indicated as a possible game play error, to accept withdrawal of the play selection for the subject player position and accept an alternative play selection, or to accept a confirmation of the play selection.

13. The system of claim 12, wherein the player interface is configured to enable a player position to withdraw the play selection and make an alternative play selection or confirm the play selection through touch-sensitive input structure associated with the player interface.

14. The system of claim 12, wherein the card delivery system is selected from the group consisting of a delivery shoe with a playing card reader, a shuffler with a playing card reader, a playing card reader on a gaming table over which playing cards are moved one-at-a-time, and an overhead camera reading playing cards that are positioned face-up.

15. The system of claim 12, further comprising:

a dealer game play interface, wherein the interface comprises a display; and wherein the at least one game controller is programmed to receive the at least one playing card information indicia, determine game outcomes, determine if a dealer is playing according to house rules and prompt the dealer to correct an error in dealer game play by providing an image indicating an error on the display.

16. The system of claim 15, wherein the card handling device is selected from the group consisting of a card delivery shoe, a card shuffler, a card reader mounted on the table and an overhead card imager.

17. The system of claim 12, wherein the card handling device is selected from the group consisting of a card delivery shoe, a card shuffler, a card reader mounted on the table and an overhead card imager.

18. Apparatus for the play of a casino playing card wagering game comprising:

a system for providing playing card information to at least one player and to a processor;

a player input interface configured to enable the at least one player to enter at least one strategic decision in the play of the casino playing card wagering game after at least a partial hand of playing cards is provided to the at least one player;

the processor programmed for analyzing any entered at least one strategic decision to determine if that entered at least one strategic decision is disadvantageous as compared to at least one other strategic decision available to the player at that time;

memory containing at least one of 1) data in the form of a look-up table of relative advantages of strategic decisions and 2) a program to calculate relative advantages of strategic decisions available at a time in the play of a game where a player may exercise at least one strategic decision from at least two alternatives and the processor is programmed to compare an entered strategic decision to at least one other strategic decision to determine if that at least one entered strategic decision is disadvantageous compared to the at least one other strategic decision;

a video display viewable from a position of the at least one player;

the processor programmed to cause a visual prompt to the at least one player on the video display if the at least one strategic decision entered by the at least one player is more disadvantageous relative to the at least one other strategic decision available; and the processor programmed to enable the player input interface to accept withdrawal of the at least one entered strategic decision and accept an alternative strategic decision through the player input interface, or to confirm the at least one entered strategic decision entered by the at least one player.

19. The apparatus of claim 18, wherein the processor is programmed for blackjack play and the at least one disadvantageous strategic decision is selected from the group consisting of:

a player hitting on a hard 17 to 20, a player hitting on a two-card 21, a player doubling down on a hard 12 or greater, a player hitting on a soft 12 or greater, a player standing on a soft 16 or less, a player standing in an 11.

* * * * *

UNITED STATES PATENT AND TRADEMARK OFFICE

CERTIFICATE OF CORRECTION

PATENT NO. : 8,287,347 B2
APPLICATION NO. : 12/291223
DATED : October 16, 2012
INVENTOR(S) : Roger M. Snow and Jennifer K. Farrar It is certified that error appears in the above-identified patent and that said Letters Patent is hereby corrected as shown below:

On the title page:

In ITEM (57) ABSTRACT:

| | |
|---|---|
| COLUMN 2, LINE 1, | change "system is disclosed that provides the" to --system provides a-- |
| COLUMN 2, LINE 3, | change "to a player" to --to the player-- |
| COLUMN 2, LINE 6, | change "provides the dealer" to --provides a dealer-- |

In the specification:

| | | |
|---|---|---|
| COLUMN 3, | LINE 31, | change "pay-tables" to --pay tables-- |
| COLUMN 3, | LINE 62, | change "a"pay tables"" to --a "pay tables"-- |
| COLUMN 8, | LINE 16, | change "player, and analyzes" to --player, analyzes-- |
| COLUMN 10, | LINE 17, | change "best pption," to --best option,-- |
| COLUMN 16, | LINE 51, | change "seveb cards" to --seven cards-- |
| COLUMN 17, | LINE 16, | change ""paytables,"" to --"pay tables,"-- |
| COLUMN 17, | LINE 24, | change "12/075,008 filed" to --12/075,008, filed-- |
| COLUMN 18, | LINE 27, | change "**40** is" to --is-- |
| COLUMN 18, | LINE 49, | change "screen **17**" to --area **17**-- |
| COLUMN 19, | LINE 10, | change "has inputt" to --has input-- |
| COLUMN 19, | LINE 27, | change "dealer area" to --dealer display area-- |
| COLUMN 19, | LINE 67, | change "master-slave , where" to --master-slave, where-- |
| COLUMN 21, | LINE 20, | change "manufacturers of" to --manufacturers or-- |
| COLUMN 22, | LINE 8, | change "non-flash" to --non-Flash-- |
| COLUMN 24, | LINE 53, | change "made on the" to --made in the-- |
| COLUMN 25, | LINE 48, | change "screen , is" to --screen, is-- |
| COLUMN 27, | LINE 8, | change "Jackpot system." to --jackpot system.-- |
| COLUMN 35, | LINE 32, | change "visa versa," to --vice versa,-- |
| COLUMN 36, | LINE 21, | change ""hepl" buttons," to --"help" buttons,-- |
| COLUMN 36, | LINE 39, | change "$10,000.00,may" to --$10,000.00, may-- |
| COLUMN 39, | LINE 51, | change "alternate" to --alternative-- |

Signed and Sealed this
Ninth Day of February, 2016

Michelle K. Lee

Michelle K. Lee
*Director of the United States Patent and Trademark Office*

In the specification:

| | | |
|---|---|---|
| COLUMN 40, | LINE 7, | change “games ,such” to --games, such-- |
| COLUMN 41, | LINE 25, | change “shows the” to --shows a-- |

In the claims:

| | | | |
|---|---|---|---|
| CLAIM 9, | COLUMN 43, | LINE 19, | change “given a player” to --given to a player-- |